US007454816B2

(12) United States Patent
Popper et al.

(10) Patent No.: US 7,454,816 B2
(45) **Date of Patent: *Nov. 25, 2008**

(54) STRETCH BREAK METHOD, APPARATUS AND PRODUCT

(75) Inventors: Peter Popper, Wilmington, DE (US); Joseph Anthony Perrotto, Landenberg, PA (US); Glen E. Simmonds, Hampstead, NC (US); Albert S. Tam, Hockessin, DE (US); William Charles Walker, Wilmington, DE (US); Joseph Leonda Jones, New Castle, DE (US); Peter Artzt, Denkendorf (DE); Heinz Mueller, Denkendorf (DE); David Carlton Visser, Wilmington, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 304 days.

This patent is subject to a terminal disclaimer.

(21) Appl. No.: 11/034,296

(22) Filed: Jan. 12, 2005

(65) Prior Publication Data

US 2006/0150372 A1 Jul. 13, 2006

Related U.S. Application Data

(63) Continuation of application No. 09/979,808, filed as application No. PCT/US00/16231 on Jun. 13, 2000, now Pat. No. 7,100,246.

(60) Provisional application No. 60/139,096, filed on Jun. 14, 1999.

(51) Int. Cl.
*D01G 1/00* (2006.01)

(52) U.S. Cl. ..... 19/0.35

(58) Field of Classification Search ..... 19/0.35, 19/0.39, 0.56, 0.58; 57/2

See application file for complete search history.

(56) References Cited

U.S. PATENT DOCUMENTS

| | | | |
|---|---|---|---|
| 2,439,815 | A | 4/1948 | Sisson |
| 2,721,440 | A | 10/1955 | New et al. |
| 2,784,458 | A | 3/1957 | Preston et al. |
| 3,110,151 | A | 11/1963 | Bunting, Jr. et al. |
| 3,454,460 | A | 7/1969 | Bosley |

(Continued)

FOREIGN PATENT DOCUMENTS

| | | |
|---|---|---|
| DE | 843283 | 3/1977 |

(Continued)

OTHER PUBLICATIONS

International Search Report Dated Oct. 18, 2000, International Application No. PCT/US00/16231, International Filing Date: Jun. 13, 2000.

(Continued)

*Primary Examiner*—Shaun R Hurley

(57) ABSTRACT

A method for stretch breaking fibers to produce a staple yarn and operating a staple fiber spinning machine, and an apparatus for performing such method, that enables the production of a plurality of products of lot size smaller than a large denier tow product. The process includes at least two break zones and a consolidation zone downstream from a second break zone to form a staple yarn. The filaments are broken in a second break zone downstream from the first break zone by increasing the speed of the fiber fed into the process.

10 Claims, 30 Drawing Sheets

U.S. PATENT DOCUMENTS

| | | | |
|---|---|---|---|
| 3,469,285 | A | 9/1969 | Garrison |
| 3,562,093 | A | 2/1971 | Griffiths et al. |
| 3,577,873 | A | 5/1971 | Waters |
| 3,671,379 | A | 6/1972 | Evans et al. |
| 3,824,776 | A | 7/1974 | London, Jr. |
| 3,914,488 | A | 10/1975 | Gorrafa |
| 3,945,188 | A | 3/1976 | Muller |
| 4,074,512 | A | 2/1978 | Matt |
| 4,080,778 | A | 3/1978 | Adams et al. |
| 4,118,921 | A | 10/1978 | Adams et al. |
| 4,221,345 | A | 9/1980 | Schippers et al. |
| 4,356,690 | A | 11/1982 | Minorikawa et al. |
| RE31,376 | E | 9/1983 | Sheehan et al. |
| 4,403,470 | A | 9/1983 | Nelson |
| 4,434,530 | A | 3/1984 | Miessen et al. |
| 4,497,167 | A | 2/1985 | Nakahara et al. |
| 4,547,933 | A | 10/1985 | Lauterbach |
| 4,667,463 | A | 5/1987 | Minorikawa et al. |
| 4,736,578 | A | 4/1988 | Shaffer |
| 4,768,336 | A | 9/1988 | Stahlecker et al. |
| 4,825,633 | A | 5/1989 | Artzt et al. |
| 4,856,147 | A | 8/1989 | Armiger et al. |
| 4,882,222 | A | 11/1989 | Talley, Jr. et al. |
| 4,924,556 | A | 5/1990 | Gilhaus |
| 4,965,919 | A | 10/1990 | Fujita et al. |
| 5,006,294 | A | 4/1991 | Bice et al. |
| 5,048,281 | A | 9/1991 | Dallmann et al. |
| 5,102,713 | A | 4/1992 | Corbin et al. |
| 5,195,313 | A | 3/1993 | Coons, III |
| 5,481,863 | A | 1/1996 | Ota |
| 5,497,608 | A | 3/1996 | Matsumoto et al. |
| 5,640,745 | A | 6/1997 | Bertsch et al. |
| 5,736,243 | A | 4/1998 | Aneja |
| 6,013,366 | A | 1/2000 | Kent et al. |
| 6,048,481 | A | 4/2000 | Heffner et al. |
| 6,052,878 | A | 4/2000 | Allred et al. |
| 6,438,934 | B1 | 8/2002 | Foster et al. |
| 6,513,315 | B1 | 2/2003 | Alavione et al. |
| 6,606,846 | B2 | 8/2003 | Land |
| 6,701,704 | B2 | 3/2004 | Foster et al. |
| 7,100,246 | B1 * | 9/2006 | Perrotto et al. ..... 19/0.35 |
| 2005/0188672 | A1 | 9/2005 | Simmonds |
| 2006/0165982 | A1 | 7/2006 | Simmonds |

FOREIGN PATENT DOCUMENTS

| | | | |
|---|---|---|---|
| DE | 39 26 930 | A1 | 2/1991 |
| DE | 101 61 419 | | 6/2003 |
| EP | 0 122 949 | | 10/1984 |
| EP | 0 532 458 | B1 | 9/1996 |
| EP | 0811 711 | A2 | 12/1997 |
| FR | 2 322 223 | | 9/1952 |
| GB | 843 283 | | 8/1960 |
| GB | 924 086 | | 4/1963 |
| GB | 1 058 551 | | 2/1967 |
| GB | 2 321 651 | | 8/1998 |
| JP | 54 125724 | | 9/1979 |
| JP | 4091243 | A | 3/1992 |
| WO | WO 1985000393 | A1 | 1/1985 |
| WO | WO 98/48088 | A1 | 10/1998 |
| WO | WO 03/050336 | A1 | 6/2003 |
| WO | WO 03/29539 | | 9/2007 |

OTHER PUBLICATIONS

International Search Report Dated Jun. 22, 2004, International Application No. PCT/US03/33696, International Filing Date: Oct. 21, 2003.

P. Grosberg et al. The Insertion of 'Twist' Into Yarns by Means of Air-Jets Part 1: An Experimental Study of Air-Jet Spinning, Journal of Textile Institute. 1987, pp. 189-219.

* cited by examiner

STRETCH BREAK METHOD, APPARATUS AND PRODUCT

This application is a continuation of U.S. application Ser. No. 09/979,808, which was filed Nov. 21, 2001 now U.S. Pat. No. 7,100,246 off of International Application No. PCT/US00/16231 (filed Jun. 13, 2000), which claimed the benefit of U.S. provisional application Ser. No. 60/139,096, filed Jun. 14, 1999.

FIELD OF INVENTION

This invention relates generally to a fiber conversion and spinning process, and more particularly concerns methods for stretch-breaking continuous filament fibers to form discontinuous filament fibers and consolidating these fibers into yarns.

BACKGROUND

Spun yarns of synthetic staple fibers have been produced by cutting continuous filaments into staple fibers, which are then assembled into individual yarn in the same manner as fibers of cotton or wool. A simpler direct spinning process is also used wherein parallel continuous filaments are stretch-broken and drafted between input rolls and delivery rolls in what is sometimes called a stretch break zone or a draft cutting zone to form a sliver of discontinuous fibers which is thereafter twisted to form a spun yarn as disclosed, for example, in U.S. Pat. No. 2,721,440 to New or U.S. Pat. No. 2,784,458 to Preston. Such early processes were slow due to the inherent speed limitations of a true twisting device. As an alternative to true twisting, Bunting et al in U.S. Pat. No. 3,110,151 discloses consolidating staple fibers to make a yarn product using an entangling, or interlacing, jet device for entangling into yarn. Such a product can be produced faster than true twisting, but is not comparable to conventional spun yarns in strength, cleanness, and uniformity. Alternatively, U.S. Pat. No. 4,080,778 to Adams et al discloses a process where a 1500-5000 denier tow of continuous filaments may be heated and drawn, and is then stretch-broken and drafted in a single zone and exits at high speed through an apertured draft roll and an aspirator to maintain co-current flow of fluid and fiber through the roll nip. The discontinuous, unconsolidated filaments are then consolidated in an entangling jet of a type disclosed in Bunting to make a yarn of 50-300 denier. Static charges are removed in the stretch-breaking and drafting zone to minimize splaying. Static removal devices are also placed adjacent the roll pairs that forward the filaments through the process. About 1.5-20% of the discontinuous filaments produced in the stretch-breaking zone exceeds 76 cm in length. The yarn axis is required to be vertical throughout the process. The resultant product is a consolidated yarn with excellent strength, generally higher than ring-spun yarns, which is slub-free and clean.

Multiple stretch-break zones are taught in U.S. Pat. No. 4,924,556 to Gilhaus for progressively reducing the discontinuous filament length for large denier tows which are built up from combining several low weight tows over tensioning guide bars and guiding members. In this way distortions of less than 4.5 can be run with low weight feed tows and production capacity remains high. The combined tows are drawn without breaking in a distortion and heating zone (zone I) at one horizontal level and then passed sequentially through one or more progressively shorter, stretch-breaking zones, (zones II-V) arranged horizontally in another level to conserve floor space. The stretch-breaking zones may comprise one or more "preliminary" breaking zones that progressively shorten the fibers, and one or more breaking zones that set the average fiber length and set the variability of fiber length (% CV). The sliver formed may be processed in an entwining mechanism (to facilitate subsequent handling), heat treated, and collected in a canister. It is expected that the sliver would be further processed, as in a spinning machine, to produce small denier yarns. The process handles feed tows of 3.0 denier per filament and 110,000-220,000 denier, and in a band having a width greater than 270 mm in the drawing and breaking zones. In the example illustrated in FIG. 1, a first preliminary breaking zone, zone II, is at least 500 mm long and the filament lengths resulting from this zone have a "nearly normal distribution" of fiber lengths between a few millimeters and the length of zone II. The zone II length is an optimization between a longer length, which reduces the breaking forces, and a shorter length, which avoids floc breaks and improves operating conditions. There is a second preliminary breaking zone, zone III, which is at least 200 mm and less than 1000 mm which is "considerably shorter" than zone II. There is then a first breaking zone, zone IV, which sets the average fiber length and appears shorter than zone III; and a second breaking zone, zone V, which eliminates overly long fibers, sets the variations in fiber length (characterized by % CV), and appears shorter than zone IV. In zone V, the "breaking distortions" (believed to be speed ratios) are at least 2× those in zone IV.

A horizontal in-line process for making a fasciated yarn from a tow of fibers is taught by Minorikawa et al in U.S. Pat. No. 4,667,463. The process involves drawing the tow over a heater in an elongated area having a narrow width, draft cutting the tow, and subjecting the draft cut fibers to an amendatory draft cutting step and a yarn formation step. The length of the zone in the amendatory draft cutting step is about 0.4 to 0.9 times the length of the draft cutting zone and the draw ratio for the amendatory draft cutting is at least 2.5×. The drawing preferably occurs in two stages to achieve a draw ratio of 90-99% of the maximum draw ratio and the drawn fiber is then heat treated. The yarn formation step uses a jet system for consolidating the fibers by creating wrapper fibers around the fiber core and wrapping them around the core fibers. Occasionally, apron bands are used in the amendatory draft cutting zone and yarn formation zone to regulate the peripheral fibers. The product is described in U.S. Pat. No. 4,356,690 to Minorikawa et al as being characterized by the fact that more than about 15% of the filaments in the yarn have a filament length of less than 0.5 times the average filament length of the yarn and more than about 15% of the filaments in the yarn have a filament length greater than 1.5 times the average filament length of the yarn. In the examples shown, the maximum output speed of the process making yarns of 174 to 532 denier (30.5 to 10 cotton count) is 200 meters/minute (ex. 6) with most examples run at about 100 meters/minute.

There is a problem with the products produced by Adams et al in that the 1.5-20% of the discontinuous filaments exceeding 76 cm in length that are produced in the single stretch-breaking zone cause problems in further processing (primarily roll wraps) especially if a non-vertical process orientation is chosen. There is also a problem with long filaments in the product of Adams in that it limits the number of filament ends that are available to protrude from the yarn and provide a yarn with a comfortable feel and look for textile applications.

In the case of Gilhaus' horizontal orientation, it may only be easily applied to processing large tows where it is believed the large number of filaments contribute to good intra-bundle friction between discontinuous filaments so bundle integrity can be maintained in the process without difficulty. In the case of Adams, the small numbers of filaments in the unconsolidated discontinuous yarn provide little frictional cohesion. A vertical orientation is believed required to eliminate lateral forces on the delicate yarn due to gravity before consolidation strengthens the yarn.

Adams proposes doing all stretch breaking in one zone and any drafting of the yarn in the same zone. Such a multipurpose zone makes independent optimization of final yarn parameters difficult or impossible.

Minorikawa et al may have a problem controlling discontinuous filaments as evidenced by the use of apron bands. This lack of control and the use of apron bands may limit the speed of his process to that disclosed in his examples which at 200 m/min is too slow for commercial production of a single low denier yarn line.

There is a need for an improved process for producing a stretch-broken yarn where the operating parameters can be independently optimized, where the process is not constrained to operate in a vertical orientation, and where excessively long filaments are not present that may separate from the filament bundle and wrap in the processing equipment and limit the number of filament ends in the yarn. There is a need for a process that can operate robustly and at a high speed above 250 m/min to make production of one yarn line at a time directly from tow economically attractive.

SUMMARY OF THE INVENTION

Applicants have developed a process, and an apparatus for performing the process, that produces a small denier, discontinuous filament yarn with filament lengths shorter than about 64 cm (25 in) that results in a high number of filament ends per inch from continuous filament feed yarn. The new process operates at rates that make production of individual yarns commercially feasible. The production rates greatly exceed those of ring spun staple yarns that traditionally have a high number of filament ends per inch. The process permits operation in either a vertical or horizontal orientation without sacrificing runnability. The process is adaptable to a variety of continuous filament yarn polymers and for blending dissimilar continuous filament yarns. In preferred embodiments, the process utilizes at least two break zones for obtaining the preferred filament lengths in the final yarn product having an average filament length greater than 6.0 inches and the speed ratio D1 of the first break zone and the speed ratio D2 of the second break zone should be at a level of at least 2.0. In addition, a relationship L2/L1 between the second break zone length L2 and the first break zone length L1, is constrained to be in a range of 0.2 to 0.6 to achieve the desired overall filament lengths, length distribution, and good system operability. Following the break zones, there is a consolidation zone for consolidating the discontinuous filaments in the yarn and intermingling them by any of a variety of means to maintain unity of the yarn. The process includes improvements to systems having one or more stretch break zones.

One feature of the new process is based on the belief that it is important to arrange for some "double gripped" filaments throughout the stretch-break and drafting process. Double-gripped filaments are those that are long enough to span the distance between two roll sets for each stretch breaking and drafting zone. Double-gripped filaments provide some support for the other filaments so there is good cohesion of the filament bundle in each zone that aids runnability, especially when making low denier yarns with few filaments. If low speed ratios are utilized in the break zones, this is believed to result in more long filaments that can serve as double-gripped filaments, but this requires more break zones to achieve a high overall speed ratio to improve productivity. It also results in more zones required to reduce the filament lengths to a low level that is desirable for producing yarns with a large number of filament ends. Protruding filament ends are believed to give the yarn a better feel, or "hand". Applicants have discovered there is a preferred operating process for optimizing machine runnability when making small denier yarns with shorter fibers to optimize the filament ends per inch. To enhance productivity, the overall speed ratio of the process must remain high and the speed ratio increase must be shared by at least two break zones while maximizing the runnability which requires maintaining a certain minimum proportion of double gripped fibers in each zone. Applicants have discovered that to produce a desirable product certain process parameters must be carefully controlled. The relationship of speed ratio D1 of the first break zone being ≧2.0 and the speed ratio D2 of the second break zone being ≧2.0 should also preferably satisfy the following equation:

$$(D2-1)/(D1-1) \geqq 0.15$$

More preferably, the relationship should satisfy the following equation:

$$(D2-1)/(D1-1) \geqq 0.15 \text{ and is } \leqq 2.5$$

In a still more preferred embodiment, the zone length of the second zone is also constrained to be less than or equal to 0.4 times the first zone length.

In another preferred embodiment, a separate zone is provided primarily for drafting the already broken filaments without further breaking.

In further embodiments, a draw zone is also utilized to draw the fiber without breaking filaments in a draw zone that precedes the break zones and can draw the fiber with or without the application of heat. Additionally an annealing zone is employed when desired to heat the fibers and control product features such as shrinkage. An annealing zone is most often part of the drawing zone, but may be applied at a variety of locations in the process.

The process produces novel products by providing the opportunity to introduce a variety of fibers to the process in a way not previously disclosed to make a wide range of stretch broken yarns. For instance, with a variety of different zones employed in the process, additional fiber can be introduced at different locations in the process to achieve unusual and novel results. Typical of such products are those that blend continuous filament yarns with the discontinuous filament yarns by introducing the continuous filament yarns at a location downstream from the break and draft zones and upstream of the consolidation zone or zones. Other products employ polymeric materials with properties not envisioned for use in a stretch-breaking process, especially one with applicant's unique operating procedures. Such products include the following:

- a yarn comprising a consolidated, manmade fiber of discontinuous filaments of different lengths, the filaments intermingled along the length of the yarn to maintain the unity of the yarn, wherein the average length, avg, of the filaments is greater than 6 inches, and the fiber has a filament length distribution characterized by the fact that 5% to less than 15% of the filaments have a length that is greater than 1.5avg.
- a yarn comprising a consolidated, manmade fiber of discontinuous filaments of different lengths, the filaments intermingled along the length of the yarn to maintain the unity of the yarn, wherein the average length of the filaments is greater than 6 inches, and wherein the fiber includes continuous filaments intermingled with the discontinuous filaments along the length of the yarn, the continuous filaments having less than 10% elongation to break.

a yarn comprising a consolidated, manmade fiber of discontinuous filaments of different lengths, the filaments intermingled along the length of the yarn to maintain the unity of the yarn, wherein the average length of the filaments is greater than 6 inches, and wherein the fiber includes continuous filaments intermingled with the discontinuous filaments along the length of the yarn, the continuous filaments comprise elastic filaments having an elongation to break greater than about 100% and an elastic recovery of at least 30% from an extension of 50%.

a yarn comprising a consolidated, manmade fiber of discontinuous filaments of different lengths, the filaments intermingled along the length of the yarn to maintain the unity of the yarn, wherein the average length of the filaments is greater than 6 inches, wherein at least 1% of the discontinuous filaments in the yarn by denier comprises a fiber having a filament-to-filament coefficient of friction of 0.1 or less. Preferably, the low friction component is a fluoropolymer.

a yarn comprising a consolidated, manmade fiber of discontinuous filaments of different lengths, the filaments intermingled along the length of the yarn to maintain the unity of the yarn, wherein the average length, avg, of the filaments is greater than 6 inches, and the fiber has a filament length distribution characterized by the fact that 5% to less than 15% of the filaments have a length that is greater than 1.5avg, and wherein the filament cross-section has a width and a plurality of thick portions connected by thin portions within the filament width, and the thin portions at the ends of the discontinuous filaments are severed so the thick portions are separated for a length of at least about three filament widths to thereby form split ends on the filaments.

a yarn comprising a consolidated, manmade fiber of discontinuous filaments of different lengths, the filaments intermingled along the length of the yarn to maintain the unity of the yarn, wherein the average length, avg, of the filaments is greater than 6 inches, and the fiber has a filament length distribution characterized by the fact that 5% to less than 15% of the filaments have a length that is greater than 1.5avg, and the fiber in the yarn comprises two fibers that have visually distinct differences detectable by an unaided eye. Preferably, the differences are a difference in color, the colors of the fibers excluding neutral colors having a lightness greater than 90%, and wherein the colors of the fibers have a color difference of at least 2.0 CIELAB units, the lightness and color difference measured according to ASTM committee E12, standard E-284, to form a multicolored yarn.

a yarn comprising a consolidated, manmade fiber of discontinuous filaments of different lengths, the filaments intermingled along the length of the yarn to maintain the unity of the yarn, wherein the average length, avg, of the filaments is greater than 6 inches, and wherein at least 1% of the discontinuous filaments in the yarn by denier comprises a fiber having filaments with a latent elasticity of 30% or more. Preferably, the fiber is a bicomponent yarn comprising a first component of 2GT polyester and a second component of 3GT polyester.

Different processes are disclosed for making some of the products just discussed. Other processes are disclosed for converting a conventional staple spinning machine into a machine for making feed fiber for a stretch break type machine. The processes involve managing the operation of the spinning machine, spinning at least 500 fibers at a spinning position, to simultaneously produce a plurality of products, having an individual lot size about 20 to 200 lbs, collected into a container, the lot size being smaller than a lot of the single large denier tow product; and providing at least one spinning position with a means for collecting tow from the at least one spinning position into a container making a low denier tow product.

Various improvements to conventional stretch break processes are disclosed including:

gathering the loose filament ends in the break zone and adjacent the exit nip rolls and directing them toward the fiber core so the loose ends in all directions around the core are constrained to be within a distance from the center of the core of not greater than the distance of the center of the core from each respective end of the exit nip rolls for the break zone to minimize wrapping of the loose ends on the exit nip rolls.

arranging the paths of the fiber through the functional zones in a stretch break process to be folded so when a path vector in a first functional zone is placed tail to tail with a path vector in a next sequential functional zone there is defined an included angle that is between 45 degrees and 180 degrees resulting in a compact floor space for the process.

arranging the path of the discontinuous filament fiber at the exit of the first break zone and at the entrance and exit of the second break zone to first contact the fiber to an electrically conductive nip roll before contacting it to an electrically non-conductive nip roll and to only separate the fiber from an electrically non-conductive nip roll by first separating the fiber from the electrically non-conductive nip roll before separating it from an electrically conductive nip roll to thereby minimize static buildup in the fiber as it passes through the nip rolls.

Other variations in the process and products produced thereby will be evident to one skilled in the art of fiber processing from the description that follows.

DESCRIPTION OF THE FIGURES

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

Figure 1:
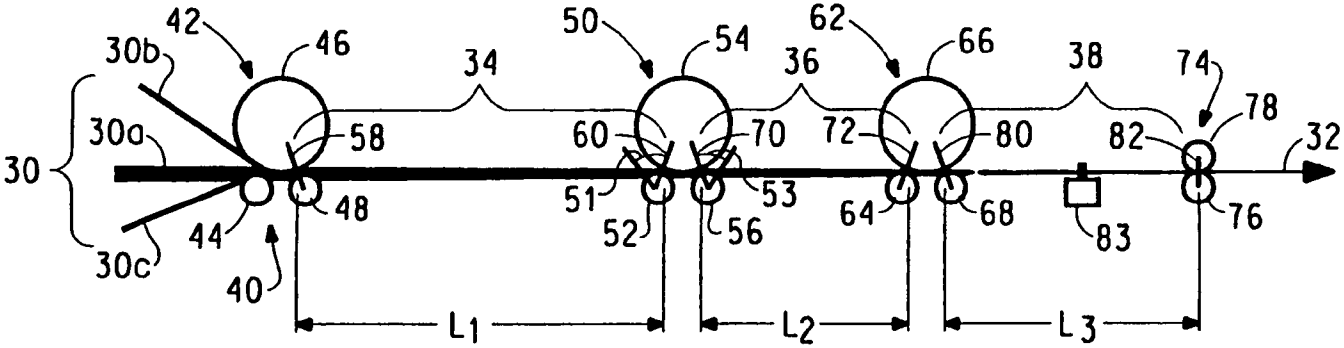
FIG. 1 is a schematic elevation view of a process line that includes a first and a second break zone and a consolidation zone.

Referring now to the drawings, FIG. 1 shows a schematic of a preferred process for stretch breaking a fiber 30 to form a yarn 32 using at least a first break zone 34 and a second break zone 36 and a consolidation zone 38. Fiber 30, which may comprise several fibers 30*a*, 30*b*, and 30*c* is fed into the process at a process upstream end 40 through a first set of rolls 42, comprising rolls 44, 46, and 48. Roll 46 is driven at a predetermined speed by a conventional motor/gearbox and controller (not shown) and rolls 44 and 48 are driven by their contact with roll 46. The fiber 30 is fed to a second set of rolls 50, thereby defining the first break zone 34 between roll sets 42 and 50. Roll set 50 comprises roll 52, roll 54 and roll 56. Roll 54 is driven at a predetermined speed by a conventional motor/gearbox and controller (not shown) and rolls 52 and 56 are driven by their contact with roll 54. The first break zone 34 has a length L1 between the nip of roll 46 and roll 48, which lies on line 58 between their centers, and the nip of roll 52 and 54, which lies on line 60 between their centers. The fiber speed is increased within the first break zone 34 by driving the fiber at a first speed S1 with roll set 42 and driving it at a second speed S2, higher than speed S1, with roll set 50. The comparison in speeds of the fiber at the two roll sets, 42 and 50, defines a first speed ratio D1=S2/S1. There should not be any slippage between the roll and the fiber, thus, the fiber speed and roll surface speed at the driven roll 46 are the same, and the fiber speed and roll surface speed at the driven roll 54 are the same. Increasing the speed of the fiber within first break zone 34 causes filaments in the fiber longer than the length L1 to be stretched until the break elongation of the fiber is exceeded and the filaments gripped by both roll sets will be broken. In the first zone, to break the filaments, the speed ratio D1 should be such that the maximum imposed strain on the filaments exceeds the break elongation of the fiber, which is a known requirement for stretch breaking of fiber. If the fiber fed into the process is a fiber composed entirely of continuous filaments, and the above conditions for breaking filaments are met, all the filaments will be broken in the first break zone. After the continuous filaments are broken, the now discontinuous filament fiber may also be drafted in first break zone 34 to reduce the denier of the fiber as the speed of the fiber continues increasing until it reaches the speed S2 of the roll set 50.

The fiber 30 is fed to a third set of rolls 62, thereby defining the second break zone 36 between roll sets 50 and 62. Roll set 62 comprises roll 64, roll 66 and roll 68. Roll 66 is driven at a predetermined speed by a conventional motor/gearbox and controller (not shown) and rolls 64 and 68 are driven by their contact with roll 66. The second break zone 36 has a length L2 between the nip of roll 54 and roll 56, which lies on line 70 between their centers, and the nip of roll 64 and 66, which lies on line 72 between their centers. The fiber speed is increased within the second break zone 36 by driving the fiber at the second speed S2 with roll set 50 and driving it at a third speed S3, higher than speed S2, with roll set 62. The comparison in speeds of the fiber at the two roll sets, 50 and 62, defines a speed ratio D2=S3/S2. There should not be any slippage between the roll and the fiber, thus, the fiber speed and roll surface speed at the driven roll 54 are the same, and the fiber speed and roll surface speed at the driven roll 66 are the same. Increasing the speed of the fiber within second break zone 36 causes most filaments in the fiber longer than the length L2 to be stretched until the break elongation of the fiber is exceeded and most filaments gripped by both roll sets (doubly gripped filaments) will be broken. In the second zone, to break the filaments, the speed ratio D2 should be such that the maximum imposed strain on the doubly gripped filaments exceeds the break elongation of the fiber, which is a known requirement for stretch-breaking of fiber having discontinuous filaments. The discontinuous filament fiber may also be drafted in the second break zone 36 to reduce the denier of the fiber as the speed of the fiber continues increasing until it reaches the speed S3 of the roll set 62.

The fiber 30 is fed to a fourth set of rolls 74, thereby defining the consolidation zone 38 between roll sets 62 and 74. Roll set 74 comprises roll 76 and roll 78. Roll 76 is driven at a predetermined speed by a conventional motor/gearbox and controller (not shown) and roll 78 is driven by its contact with roll 76. The consolidation zone 38 has a length L3 between the nip of roll 66 and roll 68, which lies on line 80 between their centers, and the nip of roll 76 and 78, which lies on line 82 between their centers. The consolidation zone includes some means of consolidation, such as an interlace jet 83 shown between the roll sets 62 and 74. The fiber speed can be decreased slightly within the consolidation zone 38 by driving the fiber at the third speed S3 with roll set 62 and driving it at a fourth lower speed S4 with roll set 74. The comparison in speeds of the fiber at the two roll sets, 62 and 74, defines a speed ratio D3=S4/S3. There should not be any slippage between the roll and the fiber, thus, the fiber speed and roll surface speed at the driven roll 66 are the same, and the fiber speed and roll surface speed at the driven roll 76 are the same. The interlace jet interconnects the filaments by entangling them with one another to form a staple yarn and in doing so it can slightly shorten the length of the fiber as the yarn is formed which accounts for the decreased speed in this particular consolidation zone. In some cases it may be desired to increase the fiber speed within the consolidation zone 38 by driving the fiber at the third speed S3 with roll set 62 and driving it at a fourth speed S4, higher than speed S3, with roll set 74. In this case some drafting would occur in the consolidation zone 38 as the speed of the fiber continues increasing until it reaches the speed S4 of the roll set 74.

With continuing reference to FIG. 1, the roll sets 42, 50, and 62 have been shown as three roll sets with the fiber passing substantially "straight" through the roll sets there being a slight wrapping around the rolls. This frequently is a simple effective way to provide good gripping of the fiber and have a simple fiber thread up path for the process. It is believed to be important to control static charge build up on the fibers as they are broken in the break zones 34 and 36. Free fiber ends created by filament breaking tend to extend from the surface of the fiber repelled by static forces as the filaments slide one on the other. These extending statically charged free ends tend to wrap on the nip rolls, especially in roll sets 50 and 62, thereby creating machine stoppages. It is believed to be beneficial to contact the fiber with an electrically conductive roll surface to dissipate the static charge. This can be done by making at least one of the rolls of the nip rolls, gripping the unconsolidated discontinuous fiber, a metallic conductive surface, for instance, rolls 44, 48, 52, 56, 64, and 68. Roll 76 may also be a conductive surface, but this is not as important since the free ends are consolidated with the fiber core when passing through this nip. Likewise, roll 44 may not need to be metallic since the fiber at this point is still a bundle of continuous filaments and no free ends are present. At roll 48, due to the dynamic filament breaking taking place in break zone 34, there may be some free ends present so having roll 48 with a conductive surface may be beneficial. In the case of roll set 50, rolls 52 and 56 are metallic surfaces contacting a non-conductive, resilient, elastomer surface on roll 54. It is also important when contacting a roll set, such as 50, to arrange the path of the discontinuous filament fiber at the entrance and exit of the roll set to first contact the fiber to an electrically conductive nip roll before contacting it to an electrically non-conductive nip roll and to only separate the fiber from an electrically non-conductive nip roll by first separating the fiber from the electrically non-conductive nip roll before separating it from an electrically conductive nip roll to thereby minimize static buildup in the fiber as it passes through the nip rolls. In other words, the first surface contacted by the fiber entering a nip set should be a conductive surface and the last surface contacted by the fiber exiting a nip set should be a conductive surface. If instead the fiber was peeled away from the elastomeric surface of roll 54 after leaving metal roll 56, a static charge would be generated as the fiber and elastomer were separated and it would not be readily dissipated since the fiber itself is electrically non-conductive. Accordingly, the rolls 52 and 56 are angularly located around the center of roll 54 so a wrap angle 51 of about 5 degrees or more occurs on roll 52 before the fiber makes contact with roll 54, and a wrap angle 53 of about 5 degrees or more occurs on roll 56 after the fiber breaks contact with roll 54. This situation is repeated for roll set 62.

Since many of the roll wraps seem to occur as the fiber is exiting a nip between rolls, it is believed to also be important to keep the fiber in contact with a rigid nip roll, such as a metallic nip roll, as the fiber leaves a resilient elastomeric nip roll regardless of whether the rigid or resilient surfaced rolls are conductive or non-conductive. In this way, if the fiber tends to get embedded in the resilient surface of the elastomeric roll, it can be "peeled" away from the resilient surface by following the rigid surface of the opposing nip roll as the fiber takes a small wrap on the rigid roll. The wrap angles around the metal surfaced rolls discussed above would accomplish this purpose. This is believed to minimize roll wraps. If the rigid roll surface is electrically conductive, this is a further advantage as mentioned above.

Figure 1A:
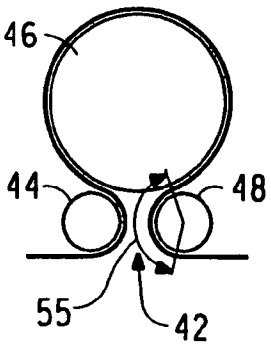
FIG. 1A is a close up of a roll set where the fiber path is an "omega" path especially useful with high strength fiber or fiber with a low coefficient of friction.

FIG. 1A shows another way of threading up the roll sets called an "omega" wrap, referring to roll set 42. In this alternative, the fiber is fed in under roll 44, rather than over the top, and is then wrapped around roll 44, roll 46, and under roll 48. This increases the surface contact substantially between the fiber and the rolls 44, 46, and 48. This is a useful technique if the fiber demands good frictional engagement with the roll set to avoid fiber slippage over the roll set. Conditions when this is required may be when the fiber is a high strength fiber and a large breaking force is required to be developed by the roll sets, or when the fiber has a very low coefficient of friction between filaments in the fiber and between the fiber and the roll surface. Fluoropolymer fiber, having a coefficient of static friction between filaments of less than or equal to about 0.1, would be such a fiber that would benefit from an "omega" wrap when processing it by stretch breaking. With this omega wrap, the roll 48 has a conductive surface and has a large wrap angle 55 of greater than 90 degrees with the fiber after it has broken contact with roll 46 that has a non-conductive elastomer surface. This will effectively dissipate the static generated as the fiber separates from the elastomer surface as discussed above.

Throughout the industry there are a variety of meanings attributed to the term fiber. For purposes of this specification the term fiber means an elongated textile material comprising one or multiple ends or bundles of the same or different material comprising multiple filaments that can be discontinuous or continuous and are unconsolidated, thereby retaining significant mobility between the filaments. Filaments are single units of continuous or discontinuous (i.e. finite length) material. The term yarn or staple yarn means an elongated textile material that comprises a consolidated fiber including discontinuous filaments, where the consolidated fiber has a substantial tensile strength and unity along the length of the yarn and filament mobility is present, but limited. Continuous filaments may also be present in the yarn or staple yarn.

The feed fiber for the above described process may come from a wound package of fiber or may come from a container of piddled fiber from which the fiber may be freely withdrawn as will be discussed below. The consolidated yarn may be wound into a package or piddled into a container for transfer to another process or for shipping; or passed on to other machine elements for further processing.

A break zone and breaking the filaments refers to increasing the speed of fiber comprising continuous or discontinuous filaments in a zone for the primary purpose of breaking fibers in a way that more than 20% and preferably more than 40% of the filaments are broken. When continuous filaments or discontinuous filaments longer than the break zone are fed into the break zone 100% of the filaments are broken. A break zone and breaking the filaments may also include cutting or weakening all or a portion of the continuous or long discontinuous filaments such as with a cut-converter device or breaker bar device (as described in U.S. Pat. No. 2,721,440 to New or U.S. Pat. No. 4,547,933 to Lauterbach) which reduces the breaking forces imposed at the nip rolls and controls some of the randomness of the breaking position of the filaments in the fiber.

The first break zone and second break zone means two distinct break zones with the second one occurring after the first one in the progression of the fiber through the two break zones. It is intended that the second break zone does not have to be right next to the first break zone and the first break zone does not have to be the first zone in a process. The feed fiber entering the first break zone can be continuous filament fiber, a discontinuous fiber of long length filaments that are to be broken in the first break zone, or a combination of continuous and discontinuous filament fiber. It is intended that consolidating includes interconnecting the filaments in the fiber by any means of consolidating, such a single fluid jet, multiple fluid jets, a true twisting device, an alternate ply twisting device, an adhesive applicator or the like, a wrapping device, etc.

To achieve a practical breaking of fiber in a single break zone, it is known that the tension to break a fiber decreases as the speed ratio to break the fibers increases. At a very low speed ratio of less than two, the tension increases rapidly and as it does it is believed that the tension consolidates the fiber so that the friction between adjacent filaments increases and individual filament breaking becomes more difficult. As a result, the tension becomes high and very erratic which leads to operability problems and breakage of the entire fiber rather than random individual filament breaking. For this reason, it is desired to operate each break zone at a speed ratio of 2.0 or greater. This is also advantageous for product throughput efficiencies. It is also desired to provide a large number of filament ends in the consolidated yarn. This can be done by making the zone length of the second break zone considerably shorter than the first break zone to shorten the filaments in the fiber and create more filament ends per inch of consolidated yarn. It is preferred to make the second break zone length, L2, less than or equal to 0.6 times the first zone length, L1. In a more preferred embodiment, it is desired to make the second length L2 less than or equal to 0.4 times the first length L1. There is a practical limit to the minimum length of the second draw zone where it will be breaking nearly all of the fiber filaments coming from the first zone. This is undesirable since it increases the tension to a high level and it is known that the breaking forces increase as the length of the zone decreases. A practical lower limit for L2 for break zone 2 is $L2 \geqq 0.2\ L1$. The corollary to this logic is that it is desireable to make the first zone considerably longer than the second break zone because it is known that the tension to break filaments decreases in long zones. It is believed important for L1 to be long for any given average filament length produced (e.g. established by the second break zone) to decrease the breaking forces required and to present a longer filament length to breaking forces which exposes more filament weak points for breaking. It is believed desireable to have an average filament length greater than 6.0 inches, which means from two-break-zone experience that L2 is roughly greater than about two times the average filament length or 12.0 inches, which means L1 is greater than 1.67×12.0 or 20.0 inches at the maximum desired L2/L1 ratio of 0.6.

Figure 2:
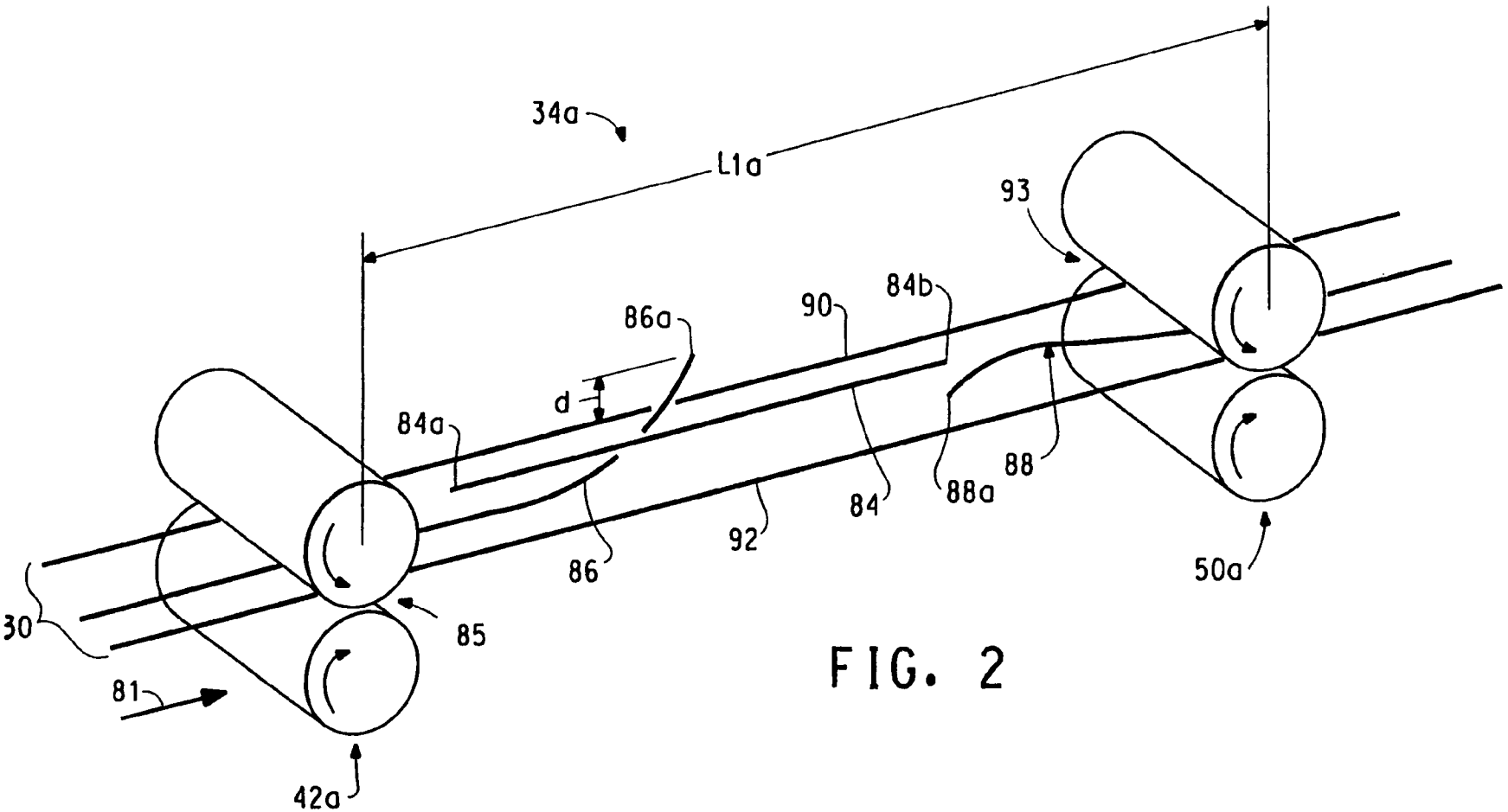
FIG. 2 is a schematic perspective view of filament ends and double gripped filaments in a fiber being stretch-broken between two sets of rolls.

There is a relationship between the first and second break zones that insures that the process has good operability and the yarn has certain desirable characteristics of filament length and distribution and to provide an increased frequency of filament ends in a stretch-broken yarn. Good operability also provides for the possibility of robust high speed operation at output speeds greater than 200-250 yards/minute, and especially greater than about 500 yards/minute. A definition of double gripped filaments will first be discussed in reference to FIG. 2, to better understand the relationship between the first and second break zones. FIG. 2 shows a fiber 30 comprising only continuous filaments, traveling in a direction 81 and passing through a break zone 34*a*, such as the first break zone 34 in FIG. 1. The break zone 34*a* extends over a length L1*a* between two sets of rolls 42*a* and 50*a*. The roll set 42*a* is driven at a first speed S1*a* and the roll set 50*a* is driven at a second speed S2*a* that is higher than speed S1*a* to define a speed ratio D1*a*=S2*a*/S1*a*. The speed of fiber 30 is increased in the break zone 34*a* so that all the continuous filaments being fed in at an upstream end 85 are to be broken in length L1*a*. Although shown at a position just after roll set 42*a*, upstream end 85 refers to a position either just before, just after, or in the nip of roll set 42*a*. Throughout this discussion, upstream refers to the direction the fibers are coming from and downstream refers to the direction the fibers are going toward. The fiber has an elongation to break that is expressed in a percent and represents the percent elongation of a filament of the fiber in the direction of an applied load just before the filament breaks. Typical elongation to break values for spun manmade fibers before strengthening by drawing can be about 300% for polyester, and after strengthening by drawing can be about 10% for polyester. At any instant in time, such as the time depicted in FIG. 2, there are some filaments that are broken, such as filaments 84, 86 and 88, and some filaments that are being stretched and are not yet broken, such as filaments 90 and 92. Filament 84 is referred to as a floating uncontrolled filament since it has neither upstream end 84*a* or downstream end 84*b* gripped and controlled by either roll set 42*a* or 50*a*. Filament 86 is referred to as a single gripped uncontrolled filament with a downstream uncontrolled end since it is gripped and controlled only by one roll set 42*a* and a downstream end 86*a* is uncontrolled by either roll set 42*a* or 50*a*. If the end 86*a* protrudes some distance d from the central region of the fiber 30 as shown, it may present a problem at roll set 42*a* or 50*a* by wrapping around one of the rolls rather than proceeding through the process in direction 81. Filament 88 is referred to as a single gripped controlled filament which is gripped and controlled by one roll set 50*a* and has upstream end 88*a* which is not gripped by either roll set 42*a* or 50*a*. End 88*a* is less of a problem than end 86*a* in that it is being pulled through the process rather than being pushed as is end 86*a*. End 88*a* is less likely to separate from the central region of the fiber as does end 86*a*. Filaments 90 and 92 are referred to as double gripped support filaments since they are gripped and controlled by both roll sets 42*a* and 50*a* at the instant of time shown. They act as a "scaffold" to hold the other uncontrolled filaments in place in the central region of the fiber. They are under significant tension, unlike the other filaments that are only singly gripped, and so they tend to hold the other filaments tightly in the central region and limit the protrusions of ends like end 86*a*. At a next instant in time, filaments 90 and 92 will be broken, but at that next instance in time other filaments, such as filament 86 whose end 86*a* will become gripped by roll set 50*a*, will become double gripped. It is believed to be important to provide at least a minimum number of double gripped filaments present at any instant in time to maintain a scaffold of filaments to assure good runnability of the process. The total number of filaments at the upstream end 85 is equal to the number of double gripped filaments plus the number of uncontrolled filaments, both floating and single gripped.

A modeling process is used to predict the number of double gripped filaments under a variety of process conditions. The analytical expression works for a single zone with continuous feed filaments. The simulation imposes the same first principles for a multi-zone process where the feed into each zone can be continuous or discontinuous. Single zone results agree well with each other. An analytic expression for a support index in a single break zone was derived from first principles using the following assumptions:

- Feed fiber is continuous
- Mass is conserved in the zone
- Fiber speed is specified at the upstream and downstream boundaries of the zone
- Filaments break independently
- Filaments break uniformly along the zone length The derived expression for a "support index" is:

$$SI=-Ln(((D/(1+eb))-1)/(D-1))/(D*(1-(0.5/(1+eb))))$$

where SI=Number of support fibers/Number of uncontrolled fibers

- Ln=natural logarithm
- D=draft=velocity ratio in the zone
- $e_b$=elongation to break of fiber; 10% is expressed as 0.1

A Monte Carlo computer simulation was developed to analyze a coupled process with multi-zone breaking and drafting. The simulation tracks fiber motion through the process, with fiber speed in each zone imposed (as an example) by gripping roll-sets. The imposed kinematics dictates the motion of single gripped and double gripped filaments. Randomness occurs during the breaking of double gripped filaments. Following the treatment of Ismail Dogu, "The Mechanics of Stretch Breaking", (Textile Research Journal, Vol. 42, No. 7, July 1972), the filament builds up strain until the break elongation is reached, at which time it breaks randomly along the zone length. Filament breaks are independent from others in the fiber. Floating filaments are treated in a number of ways, from "ideal drafting"—filaments take on the upstream roll-set speed until the leading end reaches the downstream roll-set—to options where its speed depends on the speed of neighboring filaments. Simulation results agree well with single zone analytical predictions for the support index and process tension, and with measured process tension. The simulation model is run in Matlab® 5.2 from Mathworks, Inc. of Natick, Mass. 01760. Results can be obtained with a reasonable effort for 1000 filaments on a computer with an Intel Pentium II, 450 MHz processor. It is also practical to handle up to 3000 filaments with this system. Simulation of fiber length distribution for a two-zone breaking process agrees well with the measured distribution.

With continuing reference to FIG. 2, when looking at the number of double gripped filaments it is useful to discuss the number as a percent comparing the number of double gripped filaments to the number of uncontrolled filaments at the upstream end of a zone length, such as upstream end 85 of length L1*a*. The number of double gripped filaments is, by definition, the same at the upstream end 85 and downstream end 93 of zone length L1*a*. The number of uncontrolled filaments is always more at the upstream end than the downstream end of zone length L1*a*. At the downstream end of L1*a*, the fiber of discontinuous filaments has been drafted due to the speed ratio, D1*a*, so the denier of the fiber is always less at the downstream end. There are always more uncontrolled filaments that need to be supported at the upstream end for the same number of double gripped support filaments.

Figure 3:
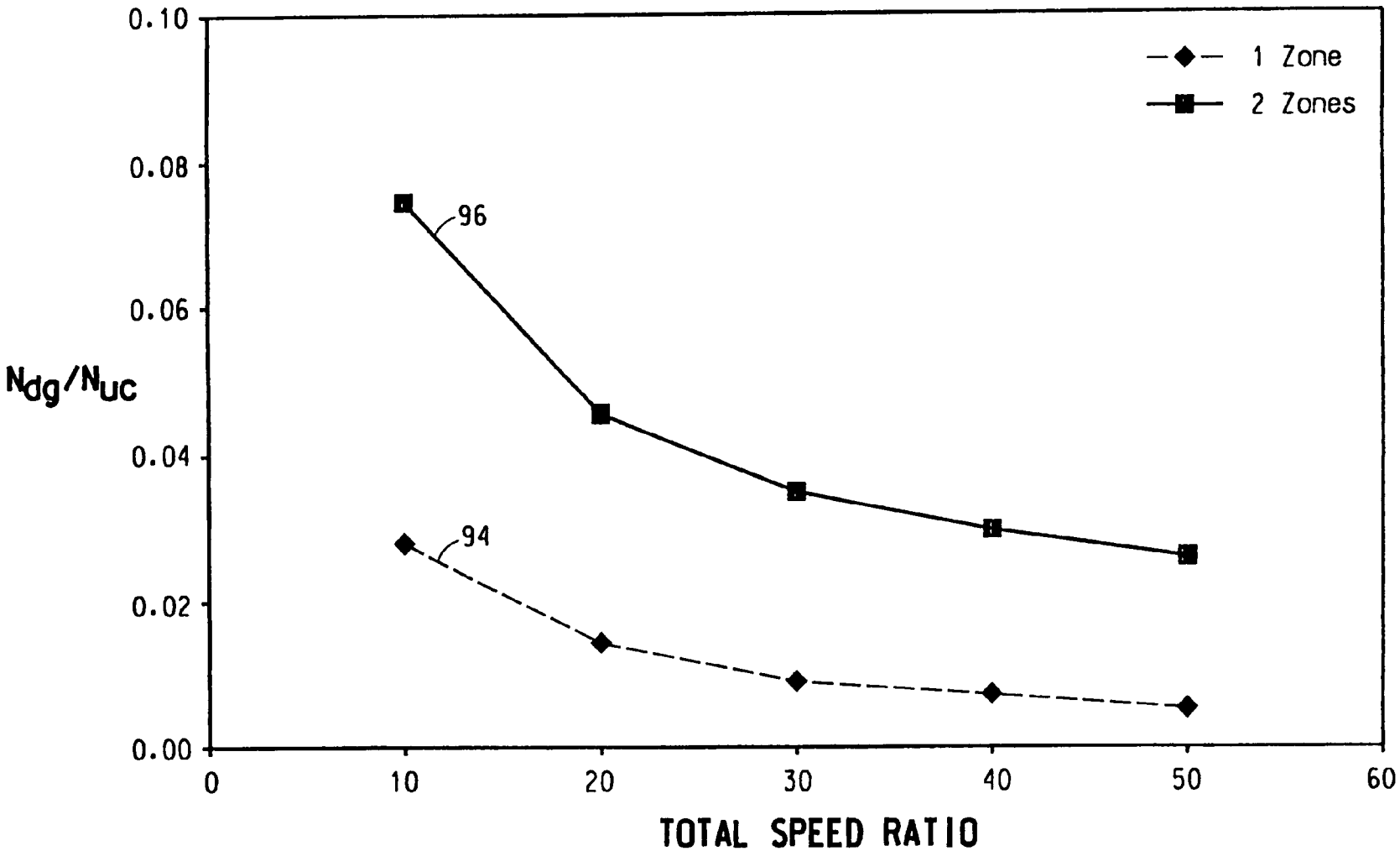
FIG. 3 is a graph of a double gripped fiber ratio versus a total speed ratio for two cases of stretch breaking fibers using a simulation model.

Reference is now made to FIG. 3, which shows the results of a modeling simulation of one case where one break zone is employed to accomplish a total speed ratio and another case where two break zones are employed to accomplish the same total speed ratio. It is known, that the total speed ratio for multiple zones can be calculated by multiplying together the individual speed ratios for individual zones (Dt=D1×D2) or by calculating the overall speed ratio (Dt=S3/S1). On the vertical scale of FIG. 3 is shown the ratio of the number of double gripped support filaments, $N_{dg}$, to the total number of uncontrolled filaments, $N_{uc}$, counted at the upstream end of the single zone, and at the upstream end of the second break zone for the two break zones (i.e. for the assumptions made for the two zones this will be the lowest value of $N_{dg}/N_{uc}$). Other assumptions for the two zones are:

- L2=0.33 L1
- D1=D2
- D1≧2.0; D2≧2.0
- elongation to break of the fiber in both break zones, $e_b$=0.121

The curves in the figure relate the total speed ratio to the ratio of double gripped filaments and uncontrolled filaments, $N_{dg}/N_{uc}$. The single zone case is shown in a dashed line 94 with diamond data points and the two zone case is shown in a solid line 96 with square data points. As can be seen for all conditions of the same total speed ratio, the two zone case always provides a higher ratio of double gripped filaments to uncontrolled filaments, which it is believed, will provide better process operability.

Looking at the single break zone in FIG. 3, one can see that as the speed ratio increases, the number of double gripped filaments decreases and as the speed ratio decreases, the number of double gripped filaments increases. Applying this observation to the two zones, one can see a problem for achieving a given total speed ratio. If one wants to increase the number of double gripped filaments in the first zone by decreasing the speed ratio in the first zone, the speed ratio must necessarily increase in the second zone to maintain the same total speed ratio. This will then decrease the number of double gripped filaments in the second zone, which is undesirable. This problematic relationship is illustrated in FIG. 4.

Figure 4:
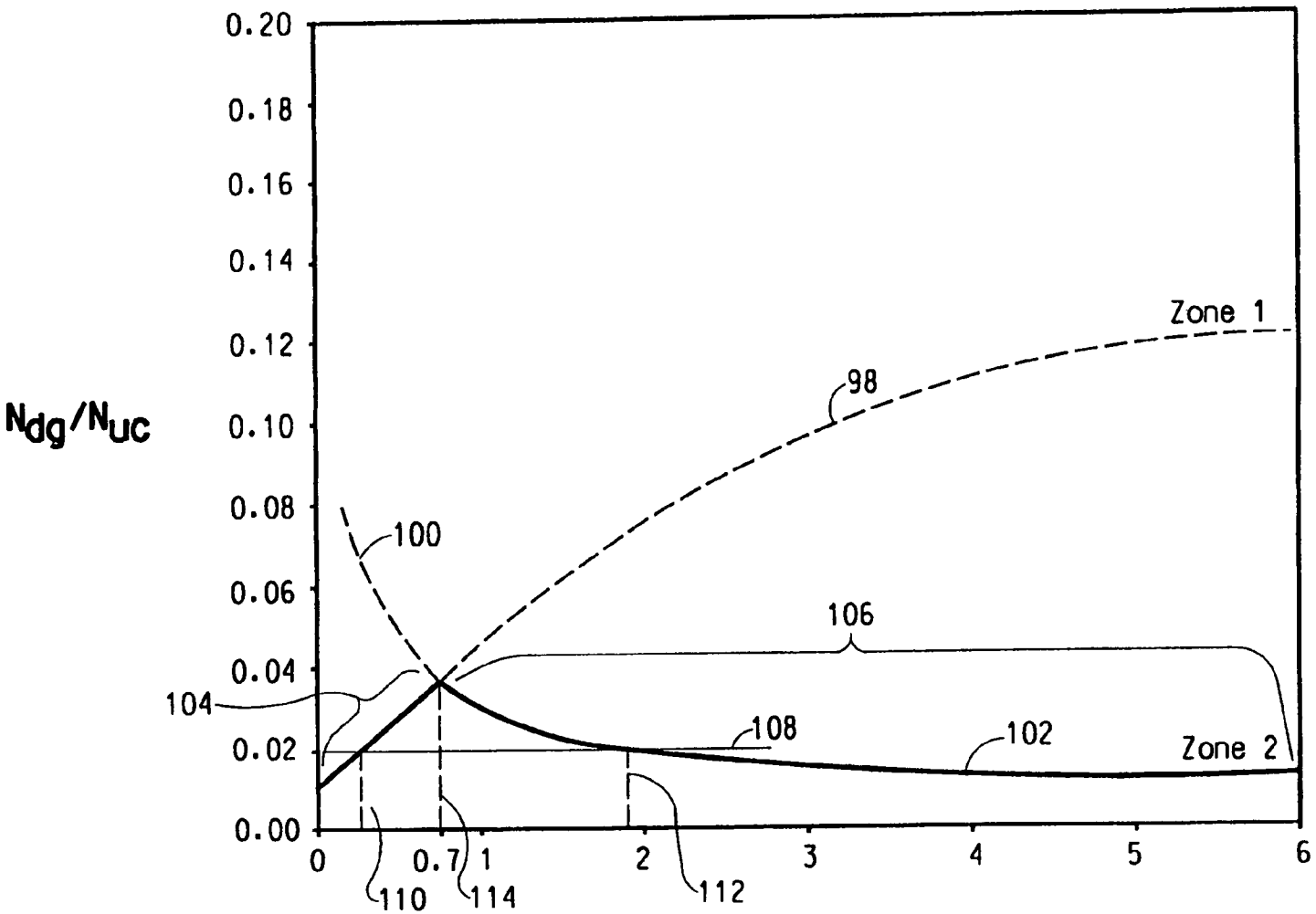
FIG. 4 is a graph of a double gripped fiber ratio versus a speed ratio for a single case of two break zones for stretch breaking fibers using a simulation model.

FIG. 4 shows $N_{dg}/N_{uc}$ along the vertical axis as in FIG. 3, however, along the horizontal axis is a relationship between the speed ratios of the two break zones. Since a speed ratio of 1 for a zone means the speed "in" equals the speed "out" and no breaking of filaments is taking place, the value of 1 is subtracted from the first break zone speed ratio D1 and the second break zone speed ratio D2 when comparing the two speed ratios. In this case when the second speed ratio is equal to 1, the relationship (D2−1)/(D1−1) will equal zero and the value where the curve intersects the vertical axis will indicate $N_{dg}/N_{uc}$ for a single break zone. For instance, for the case of Dt=25 and D2=1, the value at the vertical axis will be about 0.01 which is the same as the value for Dt=25 looking at the single zone in FIG. 3. The assumptions for the curves in FIG. 4 for the two zones are:

Dt=25
D1>=2.0; D2>=2.0
L2=0.33 L1
$e_b$=0.1

Since the second zone speed ratio is in the numerator, the curve 100 for the second zone has the shape of the curves in FIG. 3. Since the first zone speed ratio is in the denominator, the curve 98 for the first zone has a shape that is the inverse of the curves in FIG. 3. Moving along the horizontal axis, one can see that the lowest value encountered in one of the two zones for $N_{dg}/N_{uc}$ (that will determine an operability limit) is represented by the heavy solid line 102 that includes a portion 104 of the first break zone curve 98 for the values of $N_{dg}/N_{uc}$ less than about 0.7 and includes a portion 106 of the second break zone curve 100 for the values of $N_{dg}/N_{uc}$ greater than about 0.7. If a level of 0.02, or 2%, is set as a desirable minimum for $N_{dg}/N_{uc}$ as represented by line 108, this would indicate that a value of (D2−1)/(D1−1) of between about 0.2 (where dashed line 110 intersects the horizontal axis) and 2.0 (where dashed line 112 intersects the horizontal axis) should be maintained at the conditions indicated for this plot. The optimum condition would be about 0.7 (where dashed line 114 intersects the horizontal axis) where both zones would have a value of $N_{dg}/N_{uc}$ of about 0.04 or 4%. The value of $N_{dg}/N_{uc}$ drops rapidly below the optimum value of 0.7 for (D2−1)/(D1−1), and drops much less rapidly above 0.7. Also the value for $N_{dg}/N_{uc}$ essentially levels out above a value of about 5.0 for (D2−1)/(D1−1). An upper limit for (D2−1)/(D1−1) is therefore less critical than a lower limit to assure good operability of the stretch-break process using two break zones.

Figure 5:
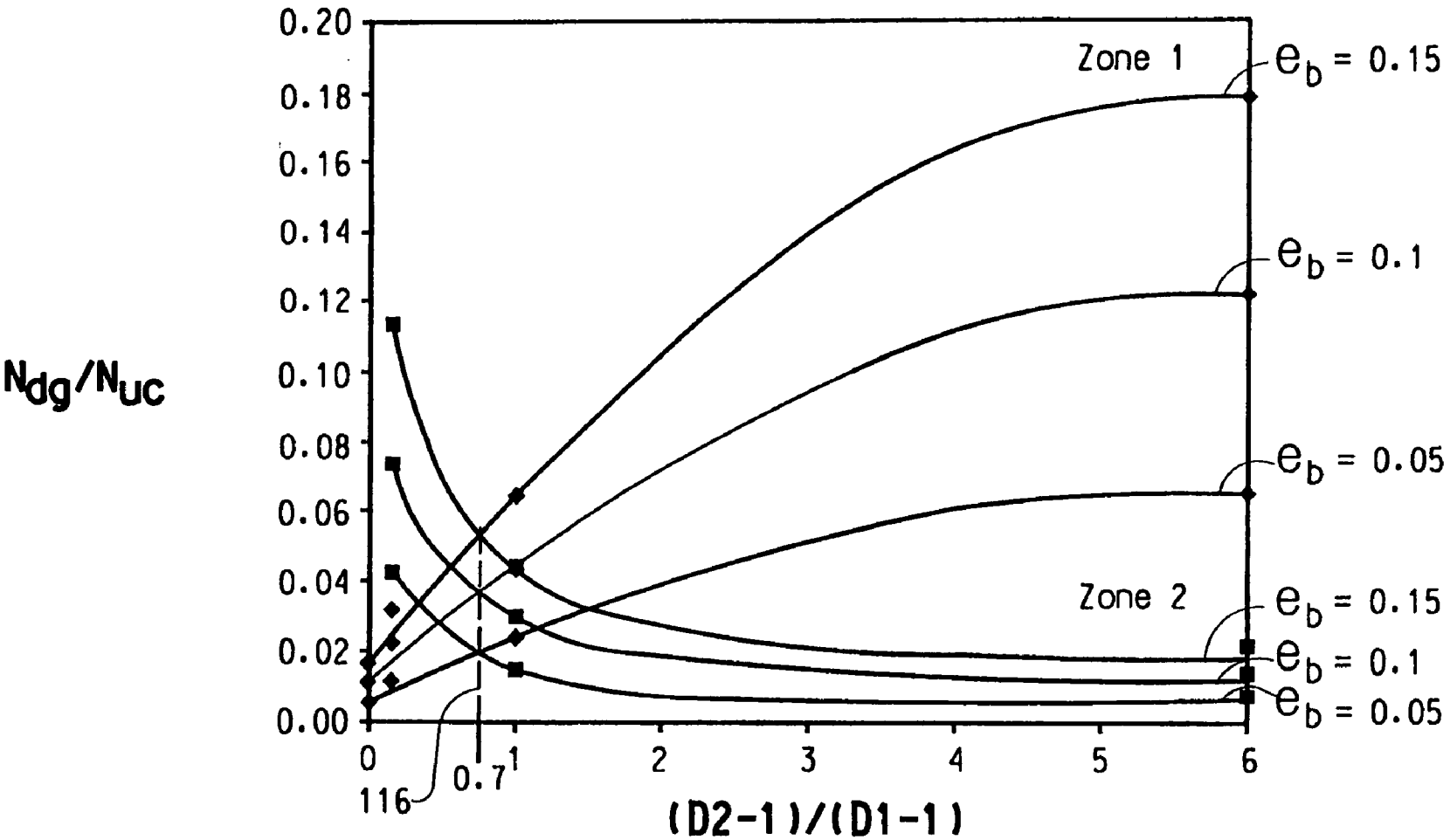
FIG. 5 is a sensitivity plot of the information of FIG. 4 looking at variations in the fiber elongation to break, $e_b$.

The modeling simulation process was applied to additional two zone cases and was used to explore the sensitivity of the optimum values for (D2−1)/(D1−1) to maximize the number of double gripped fibers to give an acceptable value of $N_{dg}/N_{uc}$ for good operability. FIG. 5 shows the sensitivity to the fiber elongation to break parameter. Three different curves are plotted similar to the curves in FIG. 4 where each curve represents a different value for the fiber elongation to break, $e_b$. The curves representing the value of $e_b$=0.1 are exactly the same as for the curves in FIG. 4. Assumptions for the three curves are:

Dt=25
D1>=2.0; D2>=2.0
L2=0.33 L1

It can be seen that the number of double gripped fibers increases with an increase in $e_b$ from 0.05 to 0.15, but the value for the optimum of (D2−1)/(D1−1) stays about the same at about 0.7, where dashed line 116 passes through the intersection of each pair of zone curves and the horizontal axis. If one wished to improve operability of a given two break zone process, one could keep all process parameters except $e_b$ the same, and add some fibers that have a higher elongation to break to improve the operability. However, this may change the yarn product properties.

Figure 6:
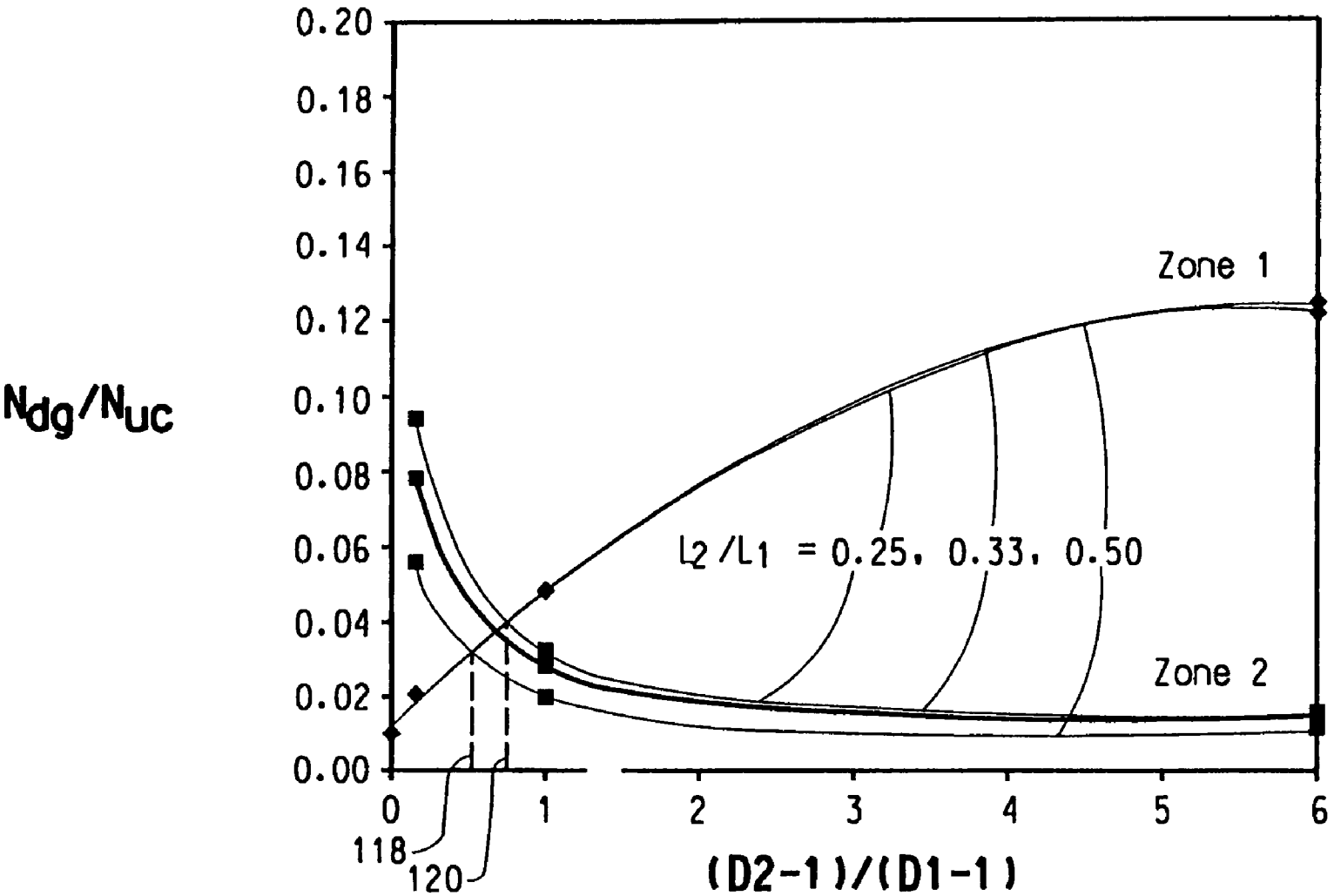
FIG. 6 is a sensitivity plot of the information of FIG. 4 looking at variations in the length of break zone 2 compared to the length of zone 1.

FIG. 6 shows the sensitivity to the ratio of zone lengths parameter. Three different curves are plotted similar to the curves in FIG. 4 where each curve represents a different value for the ratio of the break zone length L2 to L1. The value of L2=0.33 L1 is the same as for the curves in FIG. 4. Assumptions for the three curves are:

Dt=25
D1>2.0; D2>2.0
$e_b$=0.1

For zone 1, all three curves are the same and fall on top of one another. It can be seen that the number of double gripped fibers ($N_{dg}/N_{uc}$ ratio) increases only slightly as L2 decreases from 0.5L1 to 0.25 L1, and at the same time the value for the optimum of (D2−1)/(D1−1) changes only slightly from about 0.5 to about 0.8. This change in (D2−1)/(D1−1) can be seen between where dashed line 118 passes through the intersection of each pair of zone curves for L2=0.5 L1 and the horizontal axis, and where dashed line 120 passes through the intersection of each pair of zone curves for L2=0.25 L1 and the horizontal axis. It seems that in a two break zone process, varying the ratio between L2 and L1 by reducing L2 from 0.5 L1 to 0.25 L1 can improve operability of the process slightly.

Figure 7:
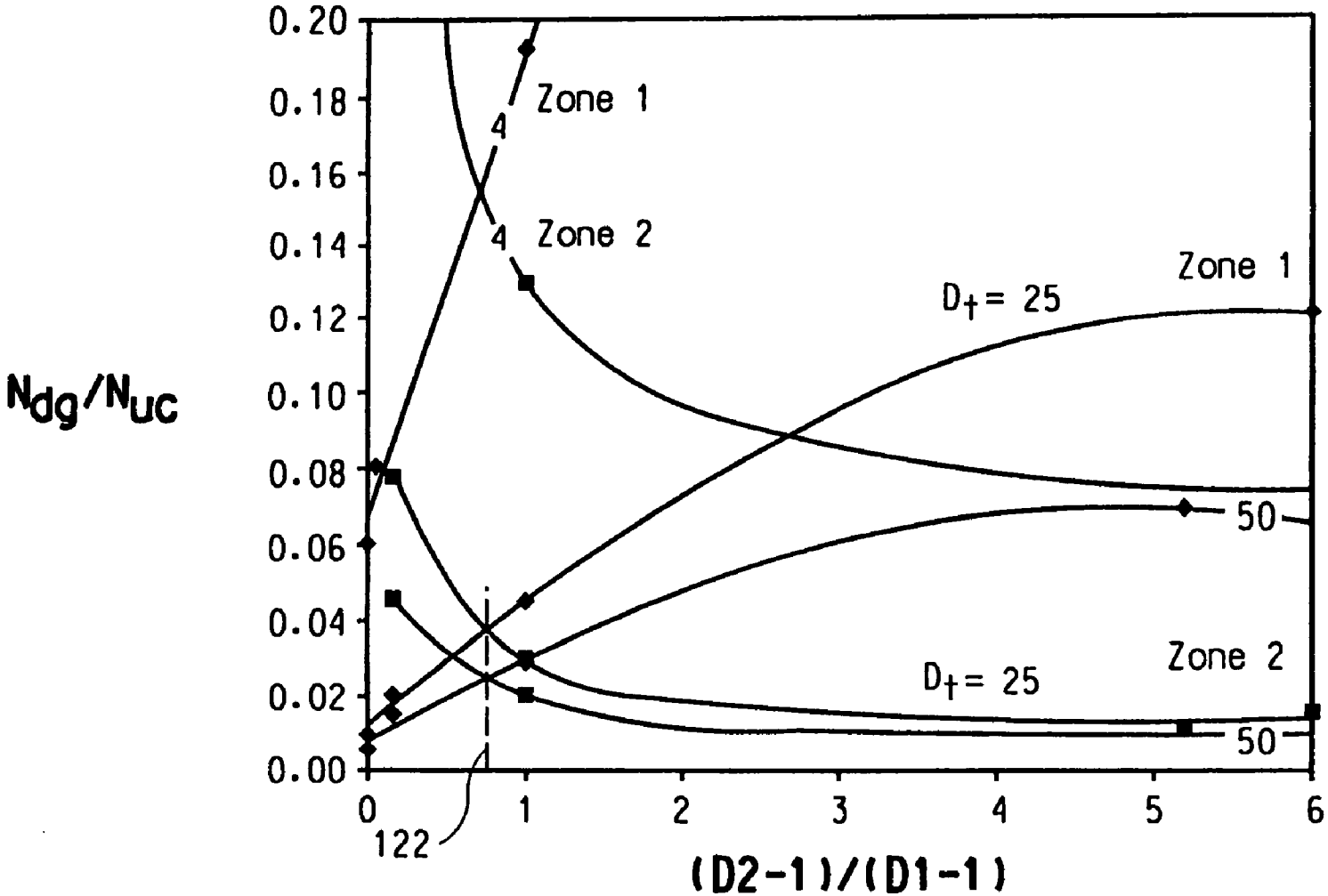
FIG. 7 is a sensitivity plot of the information of FIG. 4 looking at variations in the total speed ratio for the two break zones.

FIG. 7 shows the sensitivity to the total speed ratio parameter. Three different curves are plotted similar to the curves in FIG. 4 where each curve represents a different value for the total speed ratio, Dt. The curves representing the value of Dt=25 are exactly the same as for the curves in FIG. 4. Assumptions for the three curves are:

$e_b$=0.1
D1≧2.0; D2≧2.0
L2=0.33 L1

It can be seen that the number of double gripped fibers increases with a decrease in Dt from 50 to 4, but the value for the optimum of (D2−1)/(D1−1) stays about the same at about 0.7, where dashed line 122 passes through the intersection of each pair of zone curves and the horizontal axis. If one wished to improve operability of a given two break zone process, one could keep all process parameters except Dt the same, and decrease Dt to improve the operability. Since process productivity is highly dependent on Dt, however, this change to improve operability may make the process uneconomical.

Figure 8:
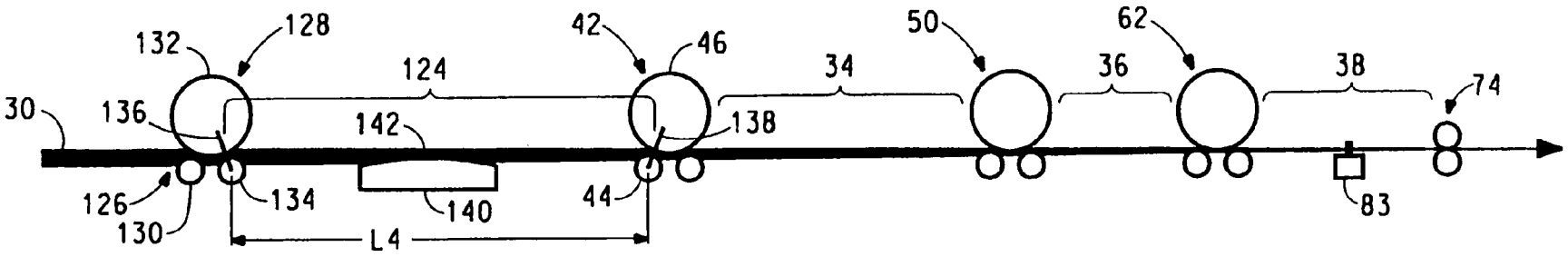
FIG. 8 is a schematic elevation view of a process line that includes a draw zone, a first and a second break zone, and a consolidation zone where the draw zone may also function as an annealing zone.

FIG. 8 is a schematic elevation view of another embodiment of the stretch-break process line that includes the addition of a draw zone 124 to the embodiment of FIG. 1 which has a first break zone 34, a second break zone 36, and a consolidation zone 38. The draw zone may also function as an annealing zone. Fiber 30, which may comprise several fibers 30*a*, 30*b*, and 30*c* as in FIG. 1, is now fed into the process at a process upstream end 126 through a zeroth set of rolls 128, comprising rolls 130, 132, and 134. Roll 132 is driven at a predetermined speed by a conventional motor/gearbox and controller (not shown) and rolls 130 and 134 are driven by their contact with roll 132. The fiber 30 is then fed to the first set of rolls 42, thereby defining the draw zone 124 between roll sets 128 and 42. The draw zone 124 has a length L4 between the nip of roll 132 and roll 134, which lies on line 136 between their centers, and the nip of roll 44 and 46, which lies on line 138 between their centers. The fiber speed is increased within the draw zone 124 by driving the fiber at a feed speed, Sf, with roll set 128 and driving it at the first speed, S1, higher than speed Sf, with roll set 42. The comparison in speeds of the fiber at the two roll sets, 128 and 42, defines a draw speed ratio D4=S1/Sf. There should not be any slippage between the roll and the fiber, thus, the fiber speed and roll surface speed at the driven roll 132 are the same, and the fiber speed and roll surface speed at the driven roll 46 are the same.

Within the draw zone 124 there can be a fiber heater 140 that may take many forms; the form shown here is a curved surface 142 that contacts the fiber over a length that can easily be varied by changing the length of the arc the fiber follows over the surface 142. For longer heating times at a given fiber speed at the upstream end 126 and a given draw speed ratio D4, the arc and contact length would be longer. Drawing of the fiber may occur as soon as the fiber is exposed to the tension in the draw zone 124, so for some polymers, the drawing or elongation of the fiber may occur just as the fiber is leaving the nip of the upstream rolls, such as rolls 132 and 134. For some polymers, the draw occurs over a very short length, such as less than 1.0 inch. In this case, the heater serves to anneal the drawn fiber rather than heat it for drawing. For this type of fiber, if draw heating is required, the rolls 132 and 134 may be heated. Other polymers may not draw until they experience some heat by contact with the surface of the heater 140. The length of the draw zone is not critical, and is primarily sized to accommodate the heating device 140. In some cases of operating the draw zone, the fiber would be drawn without heating (the heater would be turned off and retracted from contact with the fiber) and in other cases, the fiber would be heated during the drawing process as shown. In some cases, the fiber may have a draw speed ratio D4 equal to about one and the fiber may only be heated without stretching. In this case, the draw zone would function as an annealing zone.

A draw zone and drawing the fiber refers to stretching continuous filament fiber in a way that essentially none of the filaments are broken; the filaments remain continuous. Heating the fiber may or may not be included in drawing. An annealing zone and annealing the fibers refers to heating a continuous or discontinuous filament fiber while constraining the length of fiber without significant stretching, and may include some small overfeed of the fiber into the annealing zone where D4 is a number slightly less than 1.0.

Using the process of FIG. 8, a new product can be made comprising feeding at least two different fibers into the process and combining them before breaking in the break zone, the fiber differences being differences in denier per filament and one of the fibers having a denier per filament of less than 0.9 and the other fiber having a denier per filament greater than 1.5. The two fibers would go through the break and consolidation zones together. The two different fibers can be combined as a feed yarn either by spinning a single fiber bundle with two different dpf or by bringing together two different fibers each with a different dpf. In the draw zone, the elongation to break of the fibers should be similar. If this is a problem, one of the fibers could be partially pre-drawn to be compatible with the other, or both fibers could be totally pre-drawn and the fibers fed through the draw zone without drawing. The advantage of such a new product is that the structural stiffness of the yarn can be determined by the larger dpf fiber while the softness can be controlled by the smaller dpf fiber. This overcomes some problems with small dpf yarns that have a good hand but are too limp when made into fabric.

Figure 9:
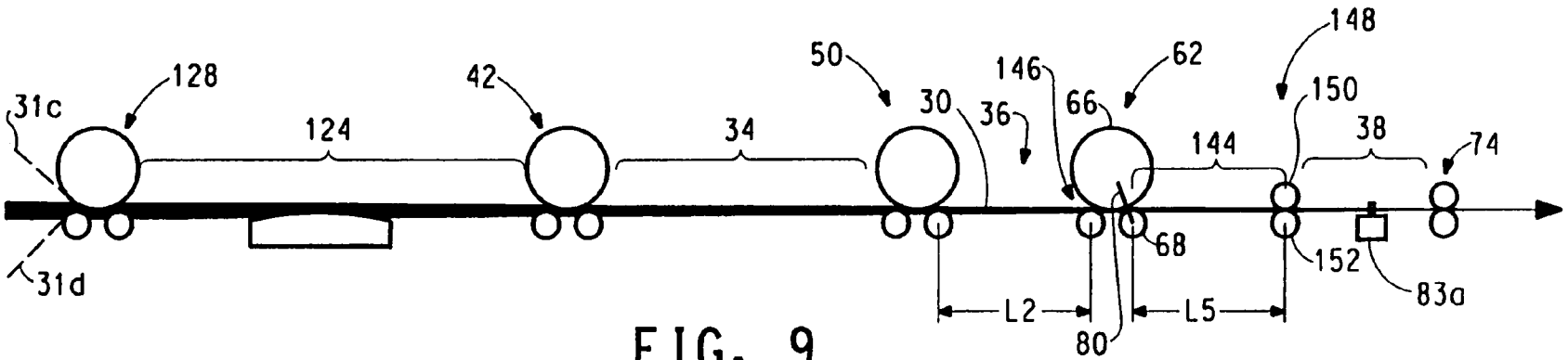
FIG. 9 is a schematic elevation view of a process line that includes a draw zone, a first and a second break zone, a draft zone, and a consolidation zone.

FIG. 9 is a schematic elevation view of another embodiment of the stretch-break process line that includes the addition of a draft zone 144 to the embodiment of FIG. 8 which has a draw zone 124, a first break zone 34, a second break zone 36, and a consolidation zone 38. The draft zone 144 is added between the second break zone 36 and the consolidation zone 38. The fiber 30, exiting the second break zone 36 as in FIG. 8, is now fed into the draft zone after roll set 62. The fiber 30 is then fed to a fifth set of rolls 148, comprising rolls 150, and 152, thereby defining the draft zone 144 between roll sets 62 and 148. Roll 152 is driven at a predetermined speed by a conventional motor/gearbox and controller (not shown) and roll 150 is driven by its contact with roll 152. The draft zone 144 has a length L5 between the nip of roll 62 and roll 68, which lies on line 80 between their centers, and the nip of roll 150 and 152. The fiber speed is increased within the draft zone 144 by driving the fiber at a speed S3 with roll set 62 and driving it at the fifth speed S5, higher than speed S3, with roll set 148. The comparison in speeds of the fiber at the two roll sets, 62 and 148, defines a draft speed ratio D5=S5/S3. Since there should not be any slippage between the roll and the fiber, the fiber speed and roll surface speed at the driven roll 66 are the same, and the fiber speed and roll surface speed at the driven roll 152 are the same. The length L5 should be about the same length as the adjacent upstream break zone, in this case, the second break zone length L2 in the configuration shown. This condition means that very few fibers are broken in the draft zone and instead the discontinuous filaments of the fiber coming from the second break zone will just be slipped past one another to reduce the denier of the fiber by an amount proportional to the draft ratio employed, D5. In some cases, a controlled amount of filaments may be broken to make a more uniform yarn in the same manner as is described for uniformly drafting short staple filaments of a fiber in a PCT application WO 98/48088 to Scheerer et. al. Such a system is also illustrated in catalog CAT. NO. 22P432 97-1-4(NS) published by Murata Machinery, Ltd. entitled "Muratec No. 802HR MJS, Murata Jet Spinner".

A draft zone and drafting the fiber refers to increasing the fiber speed in a zone for the primary purpose of reducing the denier of discontinuous filament fiber in a way that more than 80% of the fibers remain their same length, that is, 20% or less of the fibers are broken. It is intended that the draft zone can be at various locations as long as it is upstream from the consolidation zone, for instance, it may be between the first break zone and second break zone.

Figure 10:
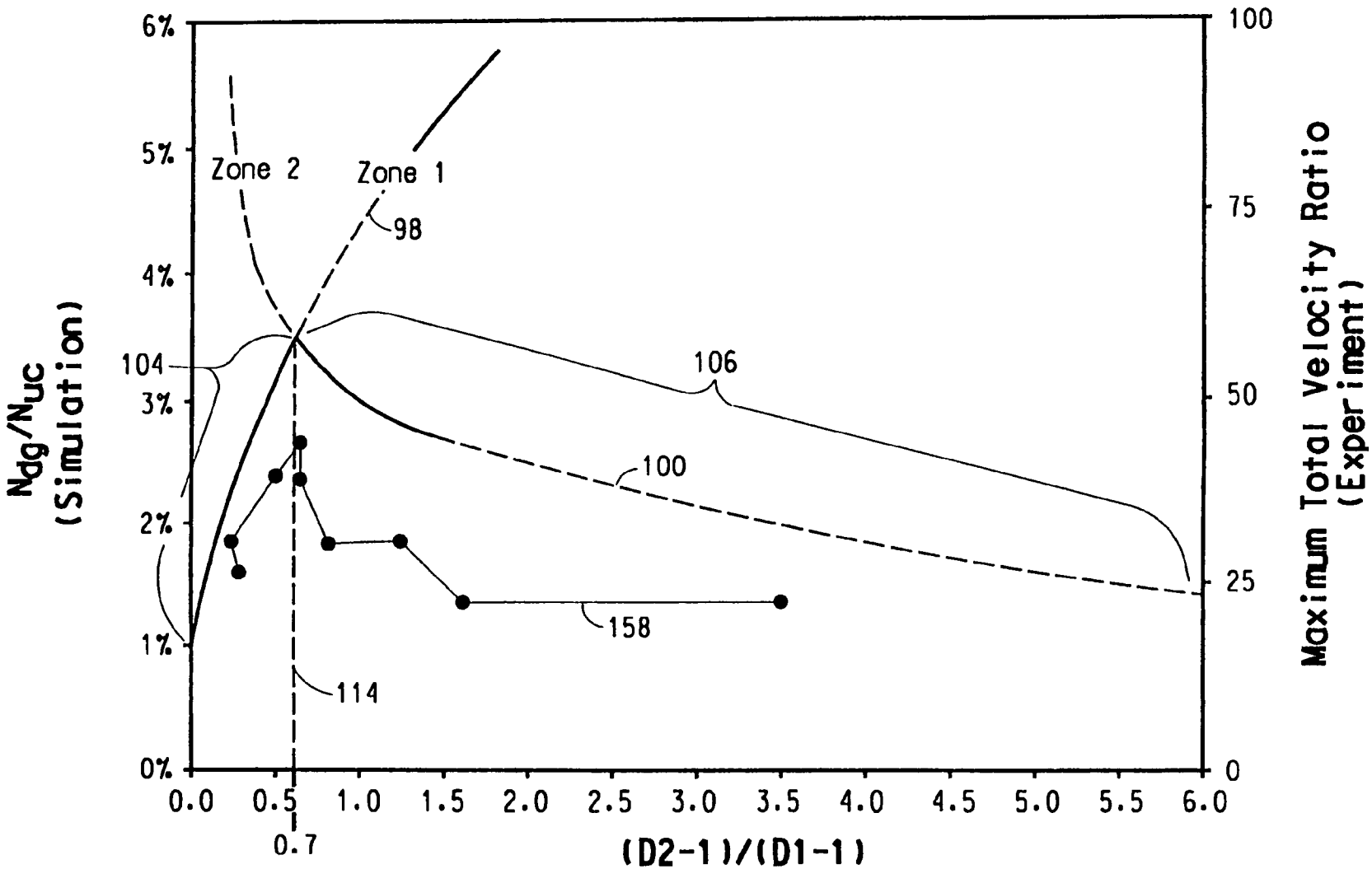
FIG. 10 shows the curves of FIG. 4 with the left vertical axis expanded and a right vertical axis added to compare the FIG. 4 curves with some actual test data.

A process approximating that illustrated in FIG. 8 was operated and data was collected to determine the limits of good operability, which are plotted in FIG. 10. FIG. 10 shows the curves of FIG. 4, with the left vertical axis expanded and a right vertical axis added to permit plotting of some actual process cases that were run to find the limits of good operability. Good operability was indicated when the process could be started up and run making acceptable stretch broken fiber for at least 5 minutes at an input speed of 1 yard per minute (the output speed from the second break zone was limited by machine considerations to about 150 ypm). Poor operability was indicated when filaments of the fiber wrapped around any of the rolls in the process. The consolidation step was omitted to simplify the process since that step usually does not contribute significantly to runnabilty problems. The fiber was withdrawn from the process after roll set 62 (FIG. 8) and was taken up by a waste sucker gun. The tension was indicated at a position within the first break zone L1 at a position about 6 inches from the upstream end of L1 using a guide attached to a load cell lightly contacting the fiber. The tension signal was monitored for variability and spikes when low speed ratios were being run. Tension spikes greater than 2× the nominal tension signal that occurred at a frequency of more than twice per minute indicated poor operability and pulsating operation, whether the process broke down within 5 minutes or not. Parameters held constant for all test runs are:

$e_b$=2.38 feed fiber
$e_b$=0.12 to break zone
L2=0.33 L1
L1=48"; L2=16"
L4=66.25"
draw speed ratio D4=2.43
draw length L4=112
draw temperature=188° C. over a 12" contact surface
feed material was three fibers of 7320 denier continuous filament polyester, each from a wound package.

Figure 10A:
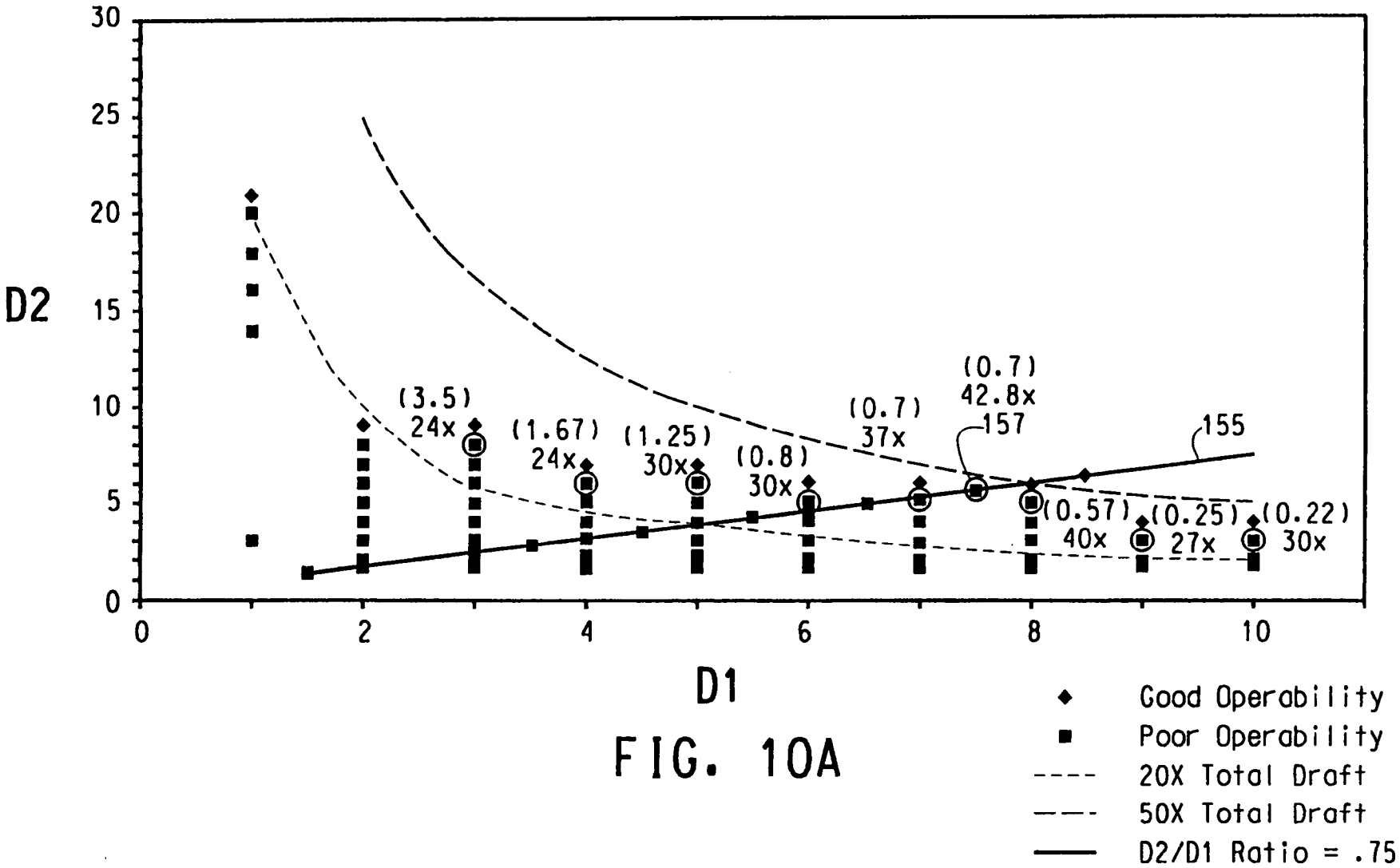
FIG. 10A is a plot of data from a designed test of operability for different values of D1 and D2 to collect optimum data for the plot of FIG. 10.

D1 and D2 were both varied to obtain the maximum overall speed ratio, Dt, by setting D1 at one value and varying D2 until the process would not run. The last run point without an operability breakdown was the point of good operability plotted in FIG. 10 as a function of maximum Dt and (D2−1)/(D1−1). FIG. 10A shows the data that was collected. The circled data points in FIG. 10A are those that were plotted in FIG. 10. Next to each circled data point is the Dt value and, in parentheses, the value of (D2−1)/(D1−1). All circled points for maximum total speed ratio fall between a curve for Dt=20× and Dt=50×. A curve for the optimum operating point for (D2−1)/(D1−1)=0.7 for a variety of total draw ratios in also shown at 155; the maximum total speed ratio for good operability along this line was found to be 42.8× at point 157. For different materials and different zone lengths, these data would be different. The finish used on the fiber is also a consideration for operability. Too much finish and the independent filament mobility and breaking in the stretch break zones is adversely affected and complete fiber break down occurs; too little finish and static becomes a problem and roll wraps are increased. A finish level of less than about 0.1% is preferred and less than about 0.04% is more preferred. A typical finish having 0.04% of a finish comprises a mixture of an ethylene oxide condensate of a fatty acid, an ethoxylated, propoxylated alcohol capped with pelargonic acid, the potassium salt of a phosphate acid ester, and the amine salt of a phosphate acid ester. Some polymers, such as aramids and fluoropolymers, do not require any finish. Other finishes that may be useful for stretch breaking fiber are found in the '778 reference to Adams and Japanese Patent Publication 58[1983]-44787 to Hirose et al.

Referring again to FIG. 10, connecting the data points with line 158 allows one to compare the test data to the simulation curves 98 and 100 taken from FIG. 4. One can see the actual operability data (experiment) follows the general trend indicated by the simulation with the optimum operating point (D2−1)/(D1−1)=about 0.7 being the same as defined by dashed line 114.

Figure 11:
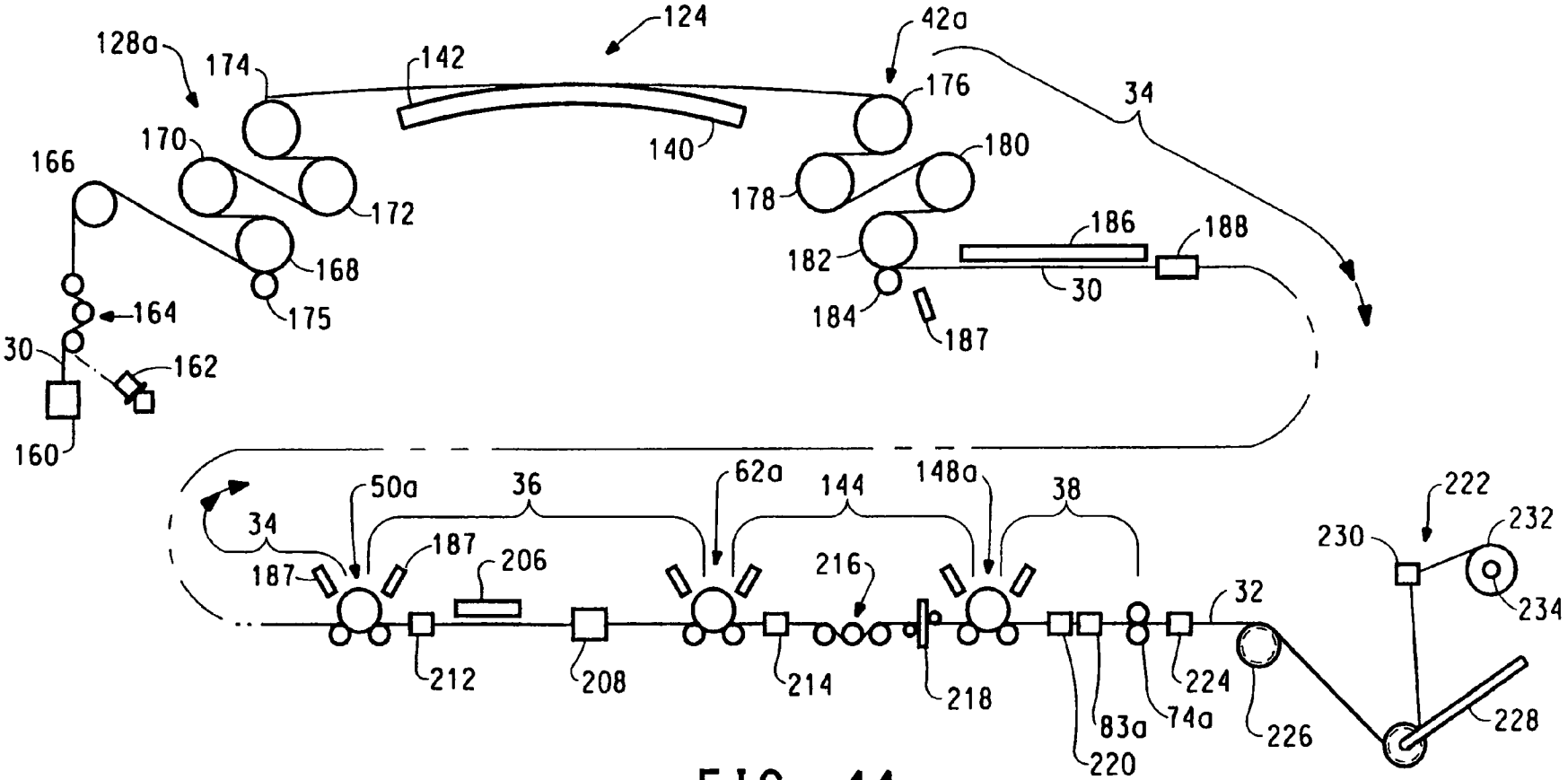
FIG. 11 is a schematic elevation view of a machine for practicing the process in FIGS. 1, 8, and 9 and variations thereof.

An apparatus that can be used for operating the processes of FIGS. 1, 8, and 9 is shown in FIG. 11. The feed fiber 30 is supplied from one or several of a container 160 of piddled fiber or alternatively, feed fiber can be fed from one or several of a wound package 162. The fiber 30 passes through some breaker guides 164 that can be used to bring together multiple ends of fiber and allow the fiber to distribute in a flat ribbon. The fiber then goes over a guide roll 166 and to a roll set 128*a* comprising four rolls 168, 170, 172, and 174, and a nip roll 175, for gripping the yarn securely at the upstream end of a draw zone 124 during threadup of the fiber. All rolls 168-174 are driven by a conventional electric motor/gearbox and controller (not shown), and nip roll 175 is driven by contact with roll 168. The downstream end of the draw zone 124 is defined by another roll set 42*a* comprising four rolls 176, 178, 180, and 182, and a start up nip roll 184. All rolls 176-182 are driven by a conventional electric motor/gearbox and controller (not shown). Start up nip roll 184 is driven by contact with roll 182. It is used to get the fiber started through the process and it is then retracted out of contact with roll 182. Between roll sets 128*a* and 42*a* is an electric heater 140 with curved surface 142 that can have a variable contact length with the yarn as discussed referring to FIG. 8. A source of electrical power (not shown) is attached to the heater.

Following roll set 42*a* is a first break zone 34 with roll set 50*a* at the downstream end which is identical to the roll set 50 in FIGS. 1 and 8. Within first break zone 34 is an electrostatic neutralizer bar 186 adjacent drawn and stretch-breaking fiber 30; and a swirl jet 188 through which the fiber 30 passes. The electrostatic neutralizer bar is electrically energized by an electrical power source (not shown) and is the type sold by Simco, model no. ME 100. Point source static eliminator devices, such as devices 187 may be used in place of or in addition to the bar 186 to control static, especially in the vicinity of the roll sets. As the filaments in the fiber break in break zone 34 and are drafted into a smaller denier fiber, they rub against one another and create an objectionable electrostatic charge that causes the filament ends to be repelled from the central region of the fiber. This fiber looseness and protruding ends presents problems with the fiber breaking apart and loose filaments wrapping on one of the downstream rolls. As mentioned above, one way to combat this problem is with the proper use of metallic surfaces on some of the nip rolls. Another method of combating these problems is gathering the loose filament ends in the break zone and adjacent the exit nip rolls and directing them toward the fiber core so the loose ends in the lateral directions around the core are constrained to be within a distance from the center of the core of not greater than the distance of the center of the core from each respective end of the exit nip rolls for the break zone to minimize wrapping of the loose ends on the exit nip rolls. It is important to apply this method of control in the first break zone where the loose filament lengths may be longer and unsupported over a longer length. It is also advantageous to apply it to the second break zone where loose fibers are still present. A swirl jet 188 is one way to accomplish this method.

Figure 12:
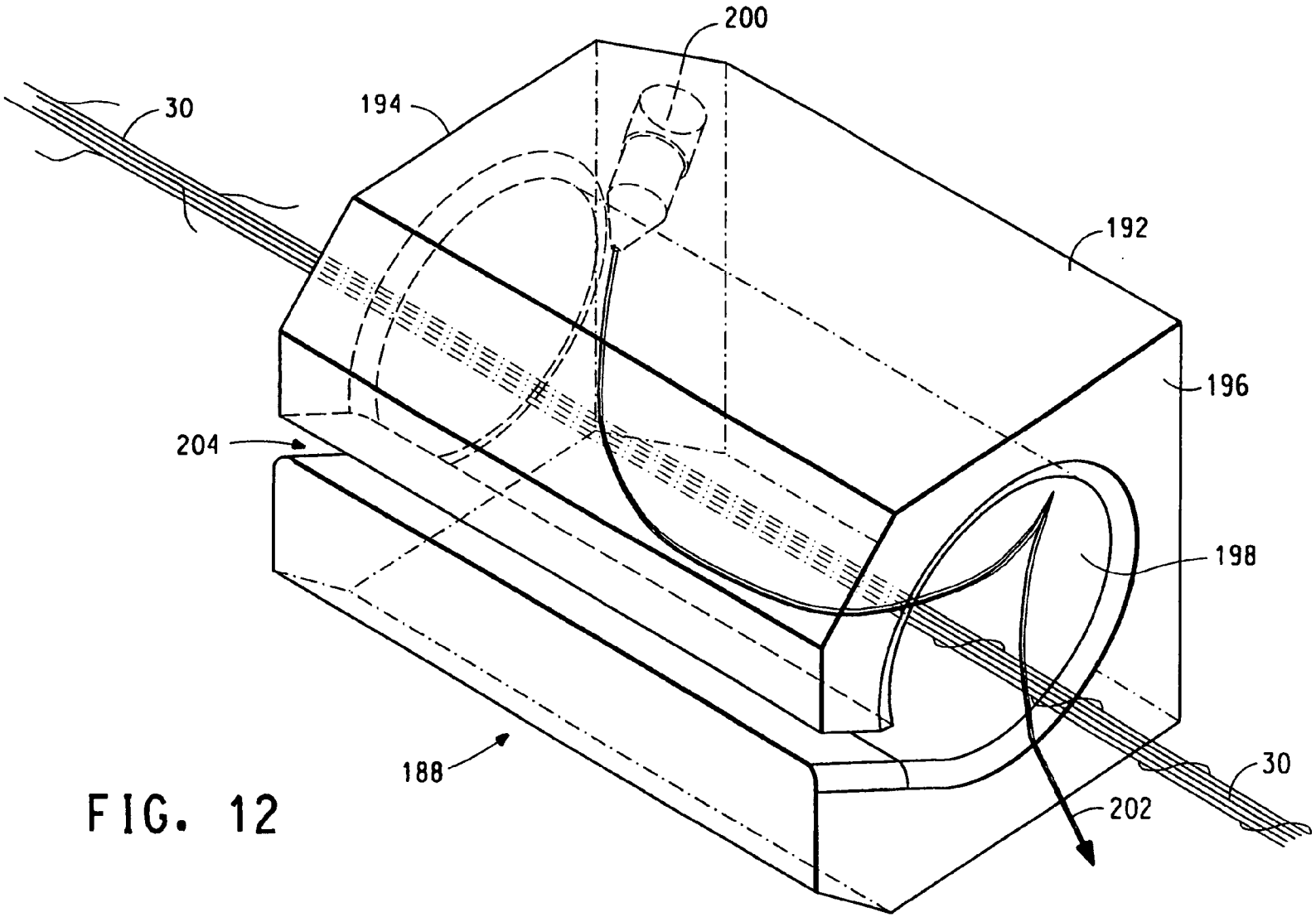
FIG. 12 is a perspective view of a swirl jet from FIG. 11 for swirling loose filaments around the fiber.

Referring now to FIG. 12, the swirl jet 188 introduces a jet of gaseous fluid to gently swirl loose filaments around the central region of the fiber, or fiber core, which is a flat ribbon-like structure. The swirl jet is shown in greater detail in FIG. 12. The swirl jet 188 comprises a body 192 having an upstream end 194, a downstream end 196, and a cylindrical bore 198 extending throughout the length of the body 192. The fiber 30 passes through the bore 198 on its way to roll set 50*a* (see FIG. 11). A fluid passage 200 extends through the body and is in fluid communication with the bore 198 at the upstream end 194 of the body. The fluid passage intersects the bore in a way that the fluid is introduced approximately tangent to the bore and angled toward the downstream end 196 of the body. In this way a counterclockwise swirling fluid flow (referenced at end 196), generally indicated by the spiral flow path 202, is generated within the bore 198. This fluid flow tends to wrap loose filaments, that extend from the central region of the fiber 30, around the fiber core to eliminate long loose ends that may wrap on downstream rolls. The wrapped filaments are loosely gathered around the fiber core. For convenience, a thread up slot 204 is provided in the body 192 along the length of the bore 198 to facilitate threading the fiber 30 in the swirl jet bore.

Figure 34A:
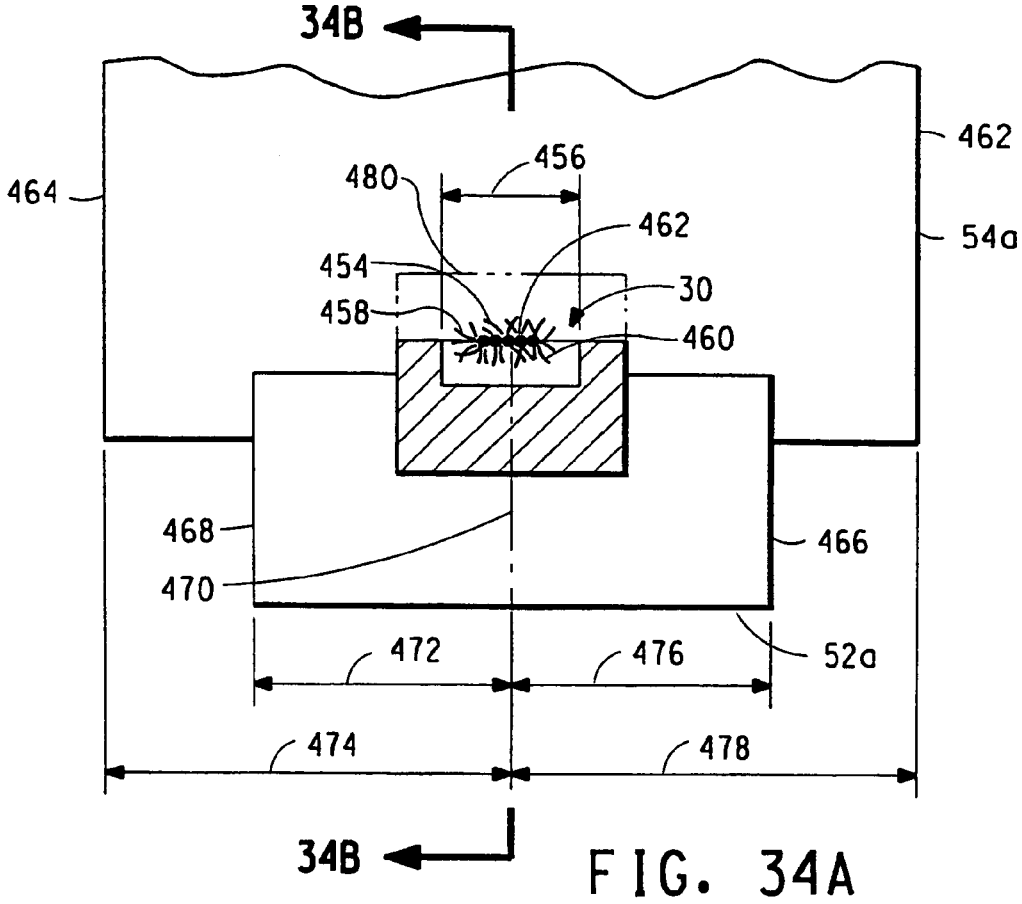
FIGS. 34A and 34B shows cross section views of a trough that gathers loose filaments ends toward the fiber core before the fiber goes through a nip roll.
Figure 34B:
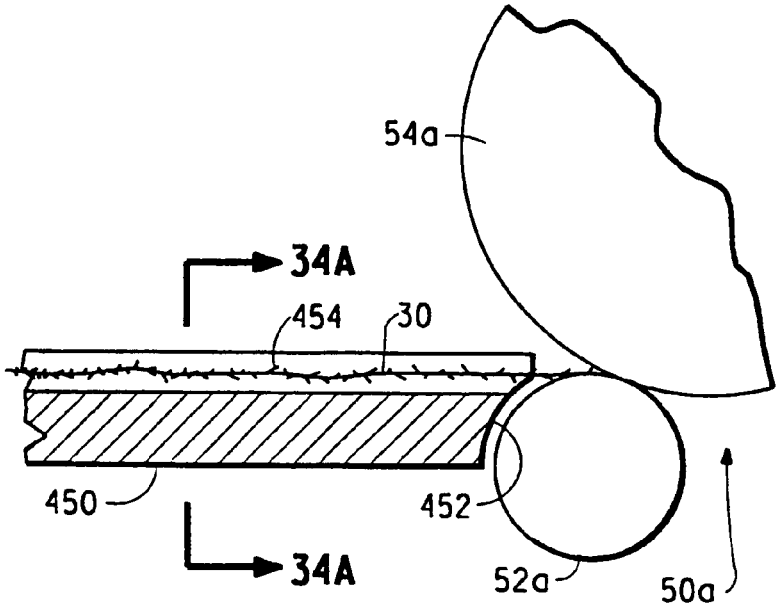

Another way to accomplish the method of gathering the loose filament ends in the break zone and adjacent the exit nip rolls and directing them toward the fiber core is to use a trough as shown in FIGS. 34A and 34B. A trough 450 has a shaped end 452 which is spaced adjacent a nip roll set, such as roll set 50*a* (FIG. 11) at the end of the first break zone 34. The trough has a longitudinal cavity 454 that is sized to accommodate the fiber 30 in the zone and has a width 456 that gathers the loose filaments 458 and 460 on the sides of the fiber core 462 and constrains them from extending out to the ends of the nip rolls in the roll set. The surface of the cavity facing the fiber is an electrically conductive surface. Nip roll 54*a* has ends 462 and 464 and nip roll 52*a* has ends 466 and 468. The center of the fiber core is indicated at 470 and the trough directs the loose filaments toward the fiber core 462 so the loose ends, such as ends 458 extending laterally around the core are constrained to be within a distance from the center of the core of not greater than the distance 472 of the center of the core from end 468 of the exit nip roll 52*a* and distance 474 from the end 464 of exit nip roll 54*a*; in this case, the lesser distance 472 is controlling. Also, the loose ends, such as ends 460 extending laterally around the core are constrained to be within a distance from the center of the core of not greater than the distance 476 of the center of the core from end 466 of the exit nip roll 52*a* and distance 478 from the end 462 of exit nip roll 54*a*; in this case, the lesser distance 476 is controlling.

The trough 450 may only be adjacent the nip rolls exiting the zone and extend a short distance therefrom, or it may extend for nearly the entire length of zone 34 to maintain control of the loose filaments throughout the zone. The trough 450 may optionally have a cover 480 to fully contain the loose filaments in all directions, however, it is most important that the trough contain the filaments laterally to keep them from extending to the ends of the nip rolls where they are susceptible to wrapping on the nip rolls. If a cover is used, it should have access for an air ionizing device.

Referring again to FIG. 11, following roll set 50*a* is a second break zone 36 with roll set 62*a* at the downstream end, which is identical to the roll set 62 in FIGS. 1 and 8. Within second break zone 36 is an electrostatic neutralizer bar 206 adjacent the drawn and stretch-breaking fiber 30; and a swirl jet 208 through which the fiber 30 passes. This is similar to the configuration of the first break zone just discussed. Also present in the second break zone adjacent its upstream end and next to roll set 50*a* is an aspirator jet 212. Aspirator jet 212 provides a gentle flow of gaseous fluid in the direction of travel of fiber 30 to capture and propel loose filaments ends coming out of the roll set 50*a* so they will not wrap on the rolls in roll set 50*a*. Aspirator jet 212 is the type available from Airvac model no ITD 110. Such an aspirator may also be used in the first break zone 34 next to roll set 42*a* if the fiber entering the zone has some discontinuous filaments present.

Following roll set 62*a* is a draft zone 144 with roll set 148*a* at the downstream end which is identical to the roll set 148 in FIG. 9. Within draft zone 144 is an aspirator jet 214, snubbing bars 216, and guide bars 218. The snubbing bars provide some resistance to filament drafting to give a more uniform denier to the fiber. It may also be useful to provide a swirl jet, such as swirl jet 208, upstream and adjacent the roll set 148*a*.

Figure 26:
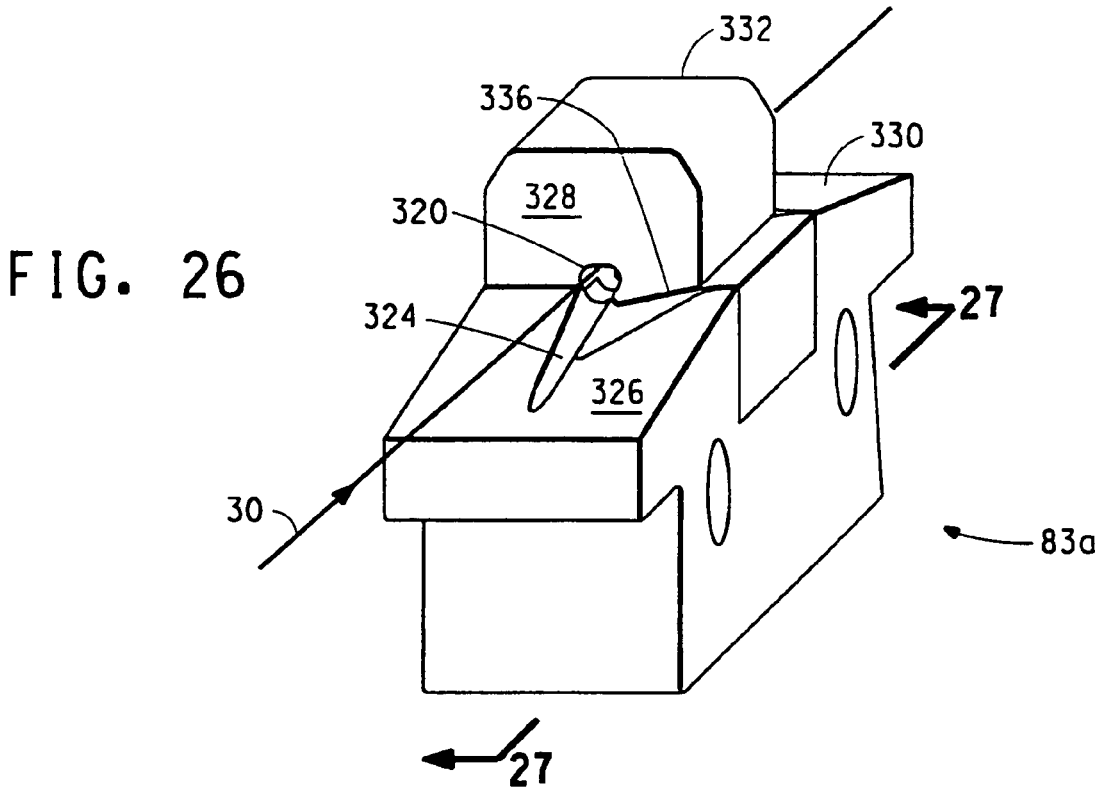
FIG. 26 shows a perspective view of an interlace jet for consolidating the fiber.
Figure 27:
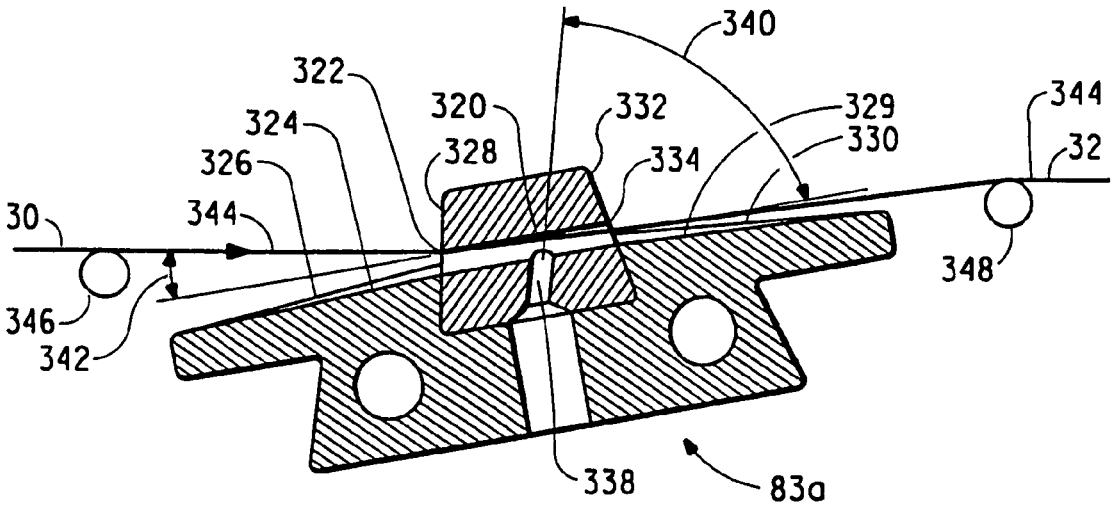
FIG. 27 shows a cross section 26-26 through the jet of FIG. 26.

Following roll set 148*a* is a consolidation zone 38 with roll set 74*a* at the downstream end which is identical to the roll set 74 in FIGS. 1, 8 and 9. Within consolidation zone 38 is an aspirator jet 220 and an interlace jet 83*a*. In practice, interlace jet 83*a* is usually placed in the consolidation zone 38 at a distance from roll set 148*a* of about ⅓ to ½ of the length of the consolidation zone. FIG. 26 shows the interlace jet 83*a* in a perspective view and FIG. 27 a cross section view with a stretch broken fiber 30 entering the fiber passage 320. The fiber passage 320 preferably has a rounded triangle cross-section, seen at the entrance end 322. The jet 83*a* has a first groove wall 324 in an entrance guide surface 326 that provides a coanda effect in conjunction with entrance exterior surface 328 at the entrance end 322; and a second groove wall 329 (FIG. 27) in an exit guide surface 330 of the jet that provides a coanda effect in conjunction with exit exterior surface 332 at an exit end 334 of the fiber passage 320. A string up slot 336 intersects fiber passage 320. Referring to FIG. 27, a fluid inlet passage 338 provides fluid to the fiber passage 320 to interlace the fiber to consolidate it into a yarn. The fluid passage 338 is arranged at angle 340 toward the downstream end of the jet at exit end 334, in the direction of the fiber travel through the jet, to minimize the exhaust of fluid out of the upstream end of the fiber passage. In addition, the interlace jet yarn passage 320 is arranged at an angle 342 relative to the fiber path 344 between roll set 148*a* and 74*a* (FIG. 11) so that fluid which does exhaust out the upstream end of the yarn passage is directed downward away from the fiber path. Guides 346 and 348 may be employed to assist in guiding the fiber through the jet. This handling of exhaust fluid from the upstream end of the yarn passage minimizes the spreading of any loose filaments in the fiber as the fiber enters the interlace jet. Such an interlace jet 83*a* is described in more detail in U.S. Pat. No. 6,052,878 to Allred et al, which is hereby incorporated herein by reference. Other filament interconnecting jets would work in this embodiment. One other such jet is that described in the Murata Jet Spinner catalog and the WO patent publication '088 already referenced above. Another interconnecting jet is described in U.S. Pat. No. 4,825,633 to Artz et al, which is hereby incorporated herein by reference. The fiber 30, after passing through the consolidation device (such as one of the jets just discussed, or other means disclosed above), becomes a consolidated yarn 32 (FIG. 11) having good cohesiveness and strength.

Figure 28:
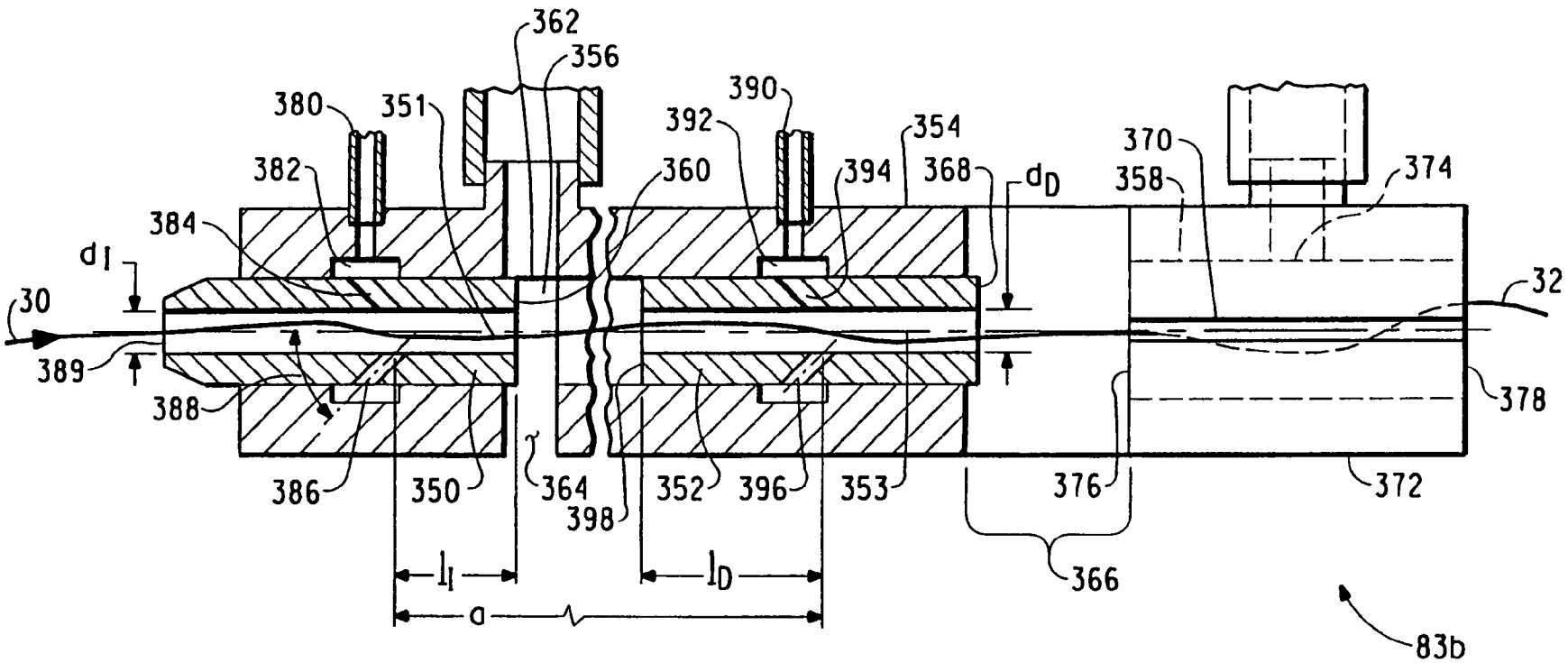
FIG. 28 shows a pneumatic torsion element for consolidating the fiber, where the left half of the figure is in section view taken along the fiber path and the right half is in plan view.

The Artz jet is discussed further referring to FIG. 28 that shows the left half in section view taken along the fiber path and the right half in plan view. In U.S. Pat. No. 4,825,633, the jet is referred to as a pneumatic torsion element, which may be controlled in the manner of U.S. Pat. No. 5,048,281. The pneumatic torsion element 83*b* comprises an injector component or first nozzle 350, having a spinning bore 351, and a torsion component or second nozzle 352, having a spinning bore 353. The two components are held in relation to one another by a common holding device 354 that also houses a first evacuation chamber 356 and a second evacuation chamber 358 for cleaning up debris associated with the fiber. The stretch broken fiber 30 first passes through the bore of first nozzle 350. It is believed that this first nozzle acts to forward the fiber and apply some twist to loose filaments at the periphery of the twisting fiber core that is formed by the second nozzle. The fiber then passes through the bore of second nozzle 352. It is believed that this second nozzle acts to twist the filaments in the fiber core upstream of the second nozzle and through the first nozzle without creating interlace between the filaments in the yarn. Such an understanding is consistent with the operation of the Murata twin-jet arrangement discussed in an article in the Journal of the Textile Institute, 1987, No. 3 pages 189-219 entitled "The Insertion of 'Twist' into Yarns by Means of Air Jets" by P. Grosberg, W. Oxenham, and M. Miao; the article consists of Part I: an Experimental Study of Air-Jet Spinning; and part II: Twist distribution and Twist-Insertion Rates in air-Jet Twisting. First evacuation chamber 356 is located adjacent the exit end 360 of first nozzle 350 and is in fluid communication with a source of vacuum at one side 362 and is in fluid communication with the atmosphere at an opposite side 364. Air flowing from side 364 to 362 across the path of the fiber removes loose broken filaments and polymer or finish powder and dust from the fiber path. The fiber then passes through the second nozzle 352 and through a string-up opening 366 and the second evacuation chamber 358. Both the string-up opening and second evacuation chamber are near the exit end 368 of the second nozzle 352. The second evacuation chamber 358 includes a string-up slot 370 along its length that may be covered after string-up by a cylindrical cover (not shown). Such a cover may rotate about the outer surface 372 of the holding device 354 to cover and uncover the slot, when the surface is a cylindrical surface surrounding the chamber 358 that mates with the cover. The second evacuation chamber is in fluid communication with a source of vacuum at one side 374 and is in fluid communication with the atmosphere at string-up slot 370 (when the cover is open or absent) and ends 376 and 378. Air flowing from ends 376 and 378, and through slot 370, pass along the path of the fiber and remove loose broken filaments and polymer or finish powder and dust from the fiber path. Operation of the torsion element 83*a* is not dependent on the first and second evacuation chambers, but they contribute to reliability of the element by keeping it clean.

The first nozzle or injector component 350 has pressurized gas, preferably air, supplied through a line 380 into a ring channel 382 that directs the fluid to multiple compressed fluid channels, such as 384 and 386. Channels 384 and 386 intersect the spinning bore 351, having a diameter $d_I$, in a known fashion at a location tangent to the bore diameter and at an angle 388 slanted toward the direction of fiber travel through the bore. The intake opening 389 of bore 351 of first nozzle 350 may be a straight cylindrical shape as shown or may be conically tapered and include notches to influence the propagation of twist in the fiber. The second nozzle or torsion component 352 likewise has air supplied through a line 390 into a ring channel 392 that directs the fluid to multiple compressed fluid channels, such as 394 and 396 which intersect bore 353, having a diameter $d_D$. First nozzle 350 has a characteristic distance $l_I$ from end 360 to a channel such as 386, and second nozzle 352 has a characteristic distance $l_D$ from an entrance end 398 to a channel such as 396. The first nozzle 350 is spaced from the second nozzle 352 by a distance "a" measured between compressed fluid channels where they intersect the spinning bore of each nozzle. This distance is adjusted for the particular fiber being processed and may be larger for fibers that have a large average filament length and smaller for fibers having a small average filament length. The first and second nozzles 350 and 352 are adjustably held in place in common holding device 354 by fasteners, such as setscrews (not shown) to facilitate adjustment of the distance "a". Alternatively, each nozzle may have independent holding devices and be mounted spaced apart on the machine frame (not shown). For any process for consolidating discontinuous filament fiber having an average filament length greater than 4.0 inches, and preferably greater than 6.0 inches, it has been surprisingly discovered that the strength uniformity of the yarn is maximized when the distance "a" is set proportional to the average filament length of the fiber.

Referring to the apparatus of FIG. 11, the pneumatic torsion element 83*b* is placed in the consolidation zone 38 in place of the device 83*a* and aspirator 220 is removed. Referring again to FIG. 28, the first nozzle 350 is set as close as possible to the nip roll set 148*a* (FIG. 11), being about 1.0 inch from the nip to the first nozzle location where the fluid channels 384 and 386 intersect spinning bore 351. The second nozzle is set at various distances "a" away from the first nozzle location measured to where the fluid channels 394 and 396 intersect spinning bore 353.

Figure 35:
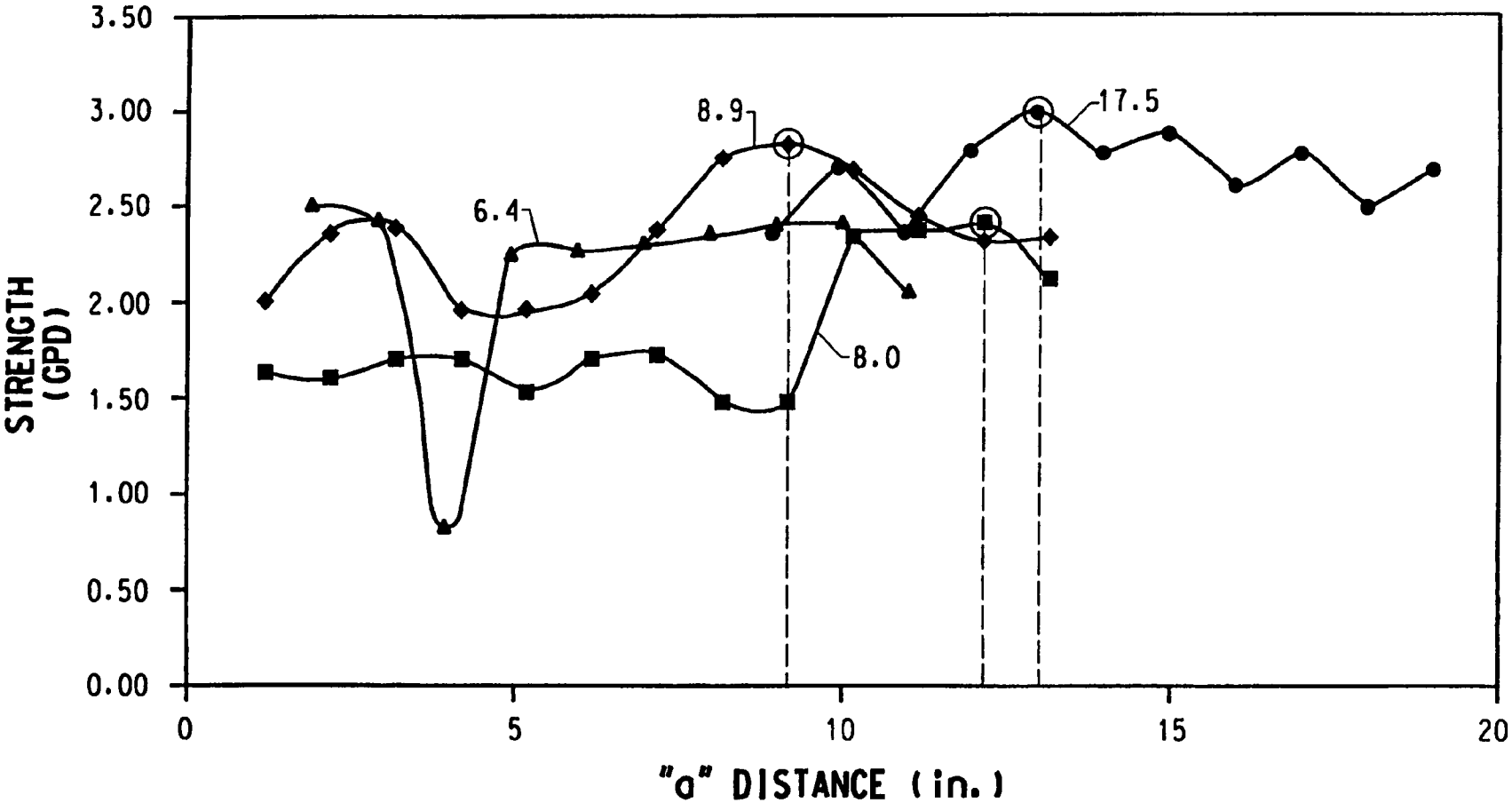
FIG. 35 shows a typical plot of yarn strength versus the distance between two nozzles of a consolidation device for different average filament lengths.

FIG. 35 shows a plot of yarn strength for a yarn having an average filament length "avg", with data points for each average length measured at different spacings "a" between the fluid channels in the first and second nozzles, 350 and 352, respectively in FIG. 28. At each distance, "a", several yarn samples are taken and an average strength number in grams per denier (gpd) is obtained by the Lea Product method. For the curves labeled 8.0, 8.9 and 17.5, it can be seen in the plot that the strength peaks at a particular value where the distance between nozzles is yy inches. Comparing this to the average filament length for the yarn being processed, forms a ratio avg/yy that is useful for selecting the appropriate value for "a". Repeating this test for several different yarn lengths resulted in values for "a" ranging from 0.74 avg to 1.53 avg or preferably 0.5 avg to 2.0 avg, with the mean and preferred value being 1.1 avg. These results will be discussed further referring to tests 20-23 below. Another test (not shown) where the second nozzle remained spaced from the nip rolls and the first nozzle was moved close to the second nozzle resulted in lower strength values for the consolidated yarn, so the important relationship is believed to be the distance between the nozzles, rather than just the distance of the second nozzle from the nip roll.

Referring to FIG. 11, following roll set 74*a* the consolidated yarn is directed to a winder 222. Between roll set 74*a* and the winder 222 is an aspirator jet 224 and a grooved guide roll 226. The winder comprises a dancer arm and grooved roll 228 attached to a controller (not shown) for controlling the winder speed; a traverse mechanism 230 for traversing the yarn 32 along the axis of a yarn package 232; and a driven spindle 234. The winder is of a conventional design that requires no further explanation to one skilled in winding art.

Figure 32:
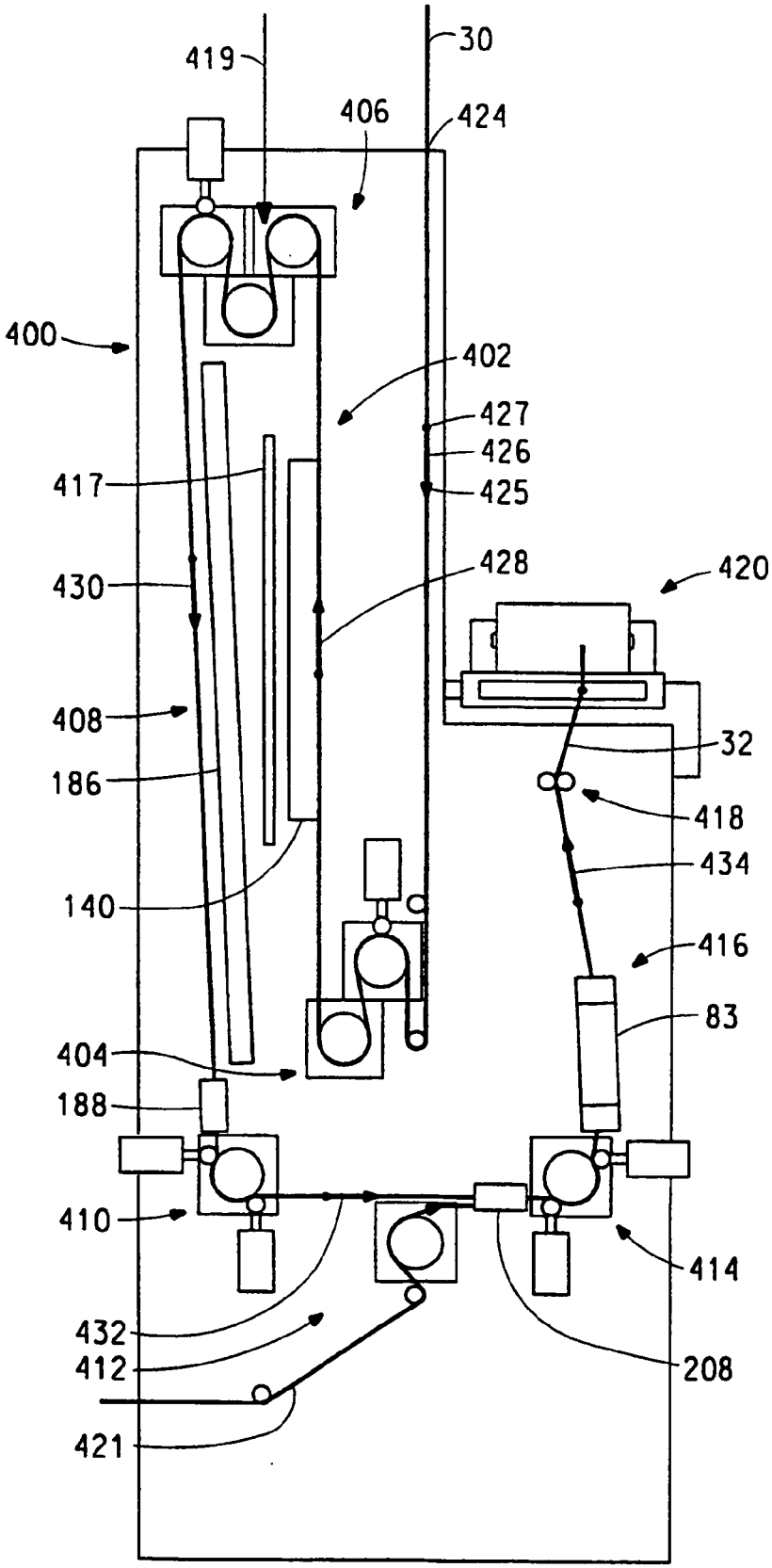
FIG. 32 shows a diagrammatic view of a process line having a folded path that saves floor space.

FIG. 11 shows a process with all the functional zones that in some way treat the yarn being in essentially a straight line path. FIG. 11 shows the functional zones of the draw zone 124, the first break zone 34, the second break zone 36, the draft zone 144, and the consolidation zone 38 all in a line from left to right, the fiber following a substantially straight path through each functional zone, each functional zone path defining a unit path vector (a vector having a direction, and a magnitude of unity) having a head in the direction of fiber travel and a tail. The process functions well, but it takes up a lot of floor space. For production machines in a factory, optimum use of floor space is important to keep costs down. FIG. 32 shows a stretch breaking apparatus 400 for a process where the path of the fiber through one or more of the functional zones is arranged to be folded so when a path vector in a first functional zone is placed tail to tail with a path vector in a next sequential functional zone there is defined an included angle that is between 45 degrees and 180 degrees resulting in a compact floor space for the process.

Referring to FIG. 32, the stretch break apparatus 400 comprises a draw zone 402 between roll sets 404 and 406, a first break zone 408 between roll sets 406 and 410, a second break zone 412 between roll sets 410 and 414, and a consolidation zone 416 between roll sets 414 and 418. The consolidated yarn is wound up on a winder system at 420. Like the apparatus in FIG. 11, the apparatus 400 also includes a heater 140, an electrostatic bar 186, swirl jets 188 and 208, a consolidation device 83, such as 83*a* (FIGS. 26 and 27) or 83*b* (FIG. 28), and various other forwarding jets, guides, nip rolls, etc. In addition, there is a heat shield 417 between heater 140 and the first break zone 408. For flexibility in making various products, a second fiber feed is present at 419 after the draw zone 402 and before the first break zone 408. A third fiber feed location is present at 421 after the second break zone 412 and before the consolidation zone 416. In operation, a feed fiber 30 enters the stretch break apparatus 400 from a creel, not shown, at position 424 in direction of a path vector 426 having a head 425 and a tail 427. Path vector 426 is not a path vector for a functional zone, since the fiber is just being transported at this point and is not being treated in any way. The fiber 30 passes through roll set 404 and travels along a path vector 428 through the functional zone for drawing the fiber, draw zone 402. The fiber 30 then passes through roll set 406 and travels along a path vector 430 through the functional zone for breaking, first break zone 408. The fiber then passes through roll set 410 and travels along a path vector 432 through the functional zone for breaking, second break zone 412. The fiber then passes through roll set 414 and travels along a path vector 434 through the functional zone for consolidating, consolidation zone 416. The consolidated yarn 32 is then wound into a package at winder 420.

Figure 33A:
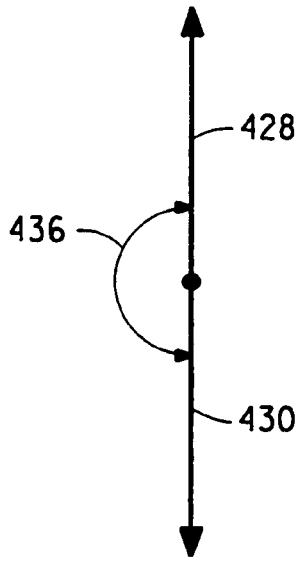
FIGS. 33A, B, and C show diagrammatic views of functional zone path vectors for the zones of FIG. 32.
Figure 33B:
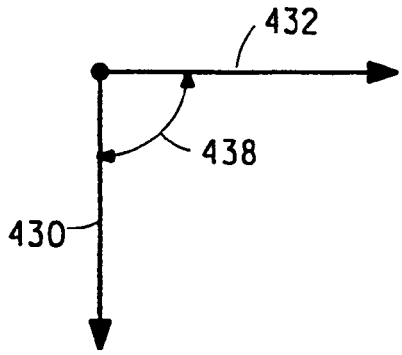
Figure 33C:
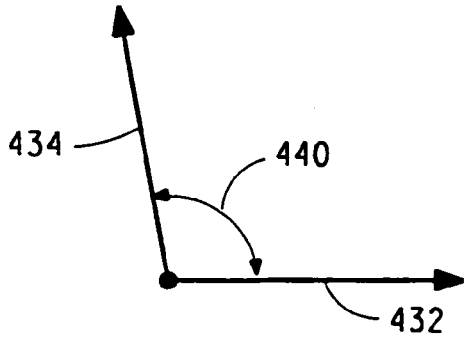

FIGS. 33A, B, and C shows the arrangement of vectors to define the folding that takes place between the paths for the functional zones. In FIG. 33A, sequential functional zone path vectors 428 and 430 are placed together tail to tail. Path vector 430 is placed with its tail coinciding with the tail of path vector 428 and the included angle between the two straight line vectors is indicated at 436 and is about 180 degrees. In FIG. 33B, sequential functional zone path vectors 430 and 432 are placed together tail to tail. Path vector 432 is placed with its tail coinciding with the tail of path vector 430 and the included angle between the two straight line vectors is indicated at 438 and is about 90 degrees. In FIG. 33C, sequential functional zone path vectors 432 and 434 are placed together tail to tail. Path vector 434 is placed with its tail coinciding with the tail of path vector 432 and the included angle between the two straight line vectors is indicated at 440 and is slightly more than 90 degrees. Also, if there were only two functional zones present in the stretch break apparatus, a break zone and a consolidation zone, the path vector 430 of the fiber in the first break zone 408 extends in one direction and the path vector 434 of the fiber in the consolidation zone 416 is folded to extend in a direction substantially 180 degrees opposite to the path in the break zone. This makes for a compact arrangement taking up a minimum of floor space. It is not necessary that all sequential functional zones be folded, but to save space, at least two sequential zones should have the fiber path folded going from one zone to the next.

This folding of the paths of the fiber through the functional zones, so that when a path vector in a first functional zone is placed tail to tail with a path vector in a next sequential functional zone there is defined an included angle that is between 45 degrees and 180 degrees, results in a compact floor space for the apparatus to practice the stretch breaking process. In a case where there are more than two functional zones, there may be a plurality of included angles, each between sequential functional zones where the fiber path is folded. In the case where there are a plurality of folds and included angles, the folded path system of the invention is alternatively defined when the sum of the absolute value of all the individual included angles between sequential functional zones is preferably 90 degrees or more and is most preferably 180 degrees or more. The arrangement shown in FIG. 32 is only one folding arrangement for a stretch breaking process and the concept of folded paths is applicable to other stretch breaking processes and other arrangement of path vectors.

The yarn produced by the apparatus of FIG. 11 is a discontinuous filament staple yarn with a denier that can be readily used in textile end applications without further preparation other than conventional dyeing or the like. The linear density of the staple yarn product is typically about equal to or less than 1000 denier, or alternatively, is a staple yarn having 500 or less filaments per cross-section where the linear density may be more than 1000 denier. It is believed significant that the process can economically operate with a relatively small denier piddled fiber, which eliminates a costly winding step and permits use of undrawn fibers that are sometimes difficult to wind in a package successfully. This is in contrast to a sliver stretch-breaking device such as that in the '556 reference discussed above. The process of the invention using piddled feed fiber 30 for a stretch-break operation to produce a consolidated yarn 32 is believed to be particularly advantageous. Such a process comprises: withdrawing a fiber at a speed greater than 1.0 meter per minute from a container holding continuous filament fiber that has been piddled therein, the fiber having a denier of between 2,000-40,000 and the container holding between 10-200 pounds of fiber, and feeding the fiber to a fiber break zone, and breaking the fiber in the break zone by increasing the fiber speed within a predetermined zone length at a speed ratio greater than 2.0, and consolidating the fiber downstream from the break zone to form a staple yarn. Preferably, before breaking the fiber it is drawn and annealed in a draw zone upstream of the break zone by increasing the fiber speed within a predetermined draw zone length and heating the fiber within the length.

Figure 29:
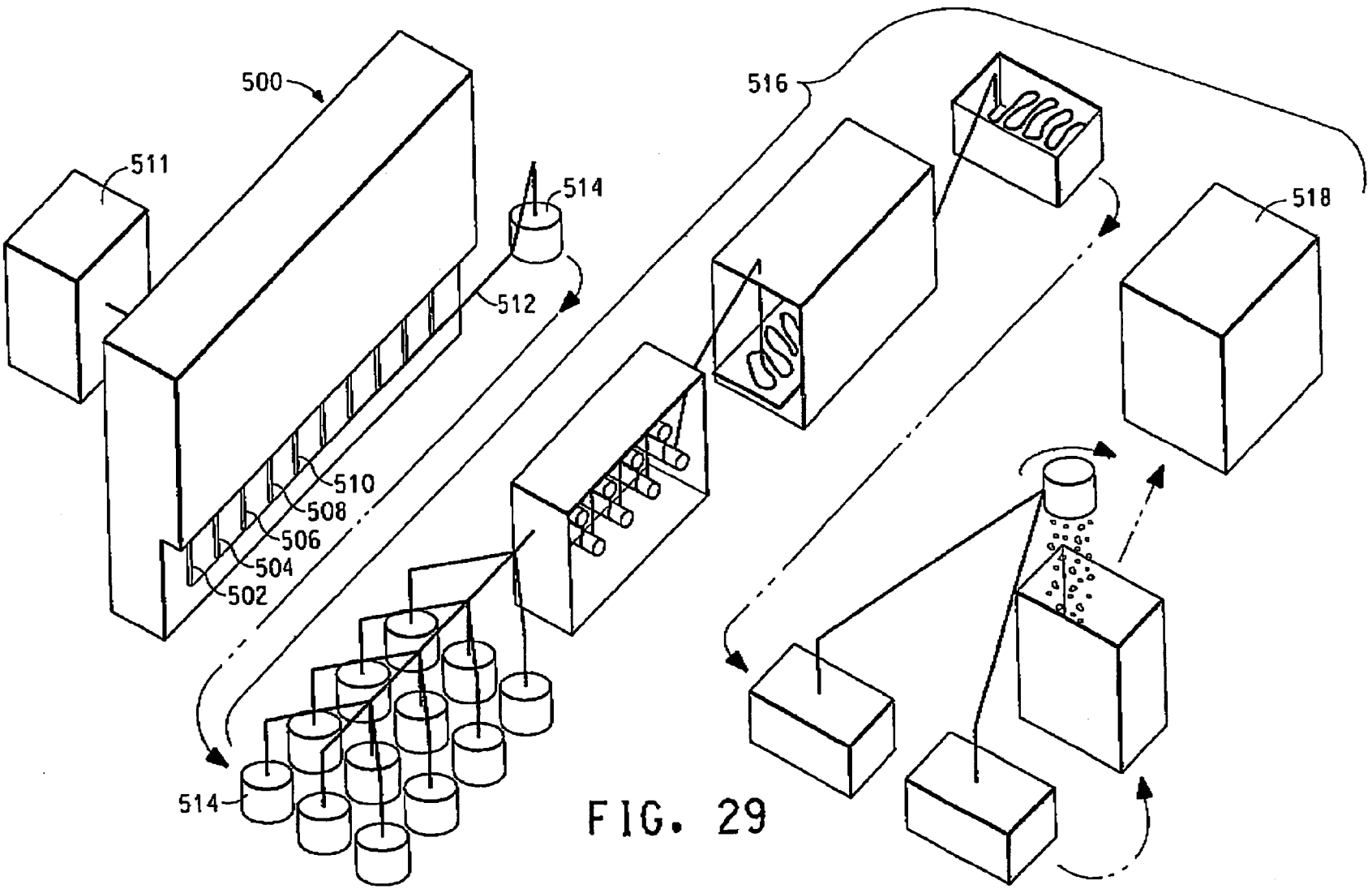
FIG. 29 shows an isometric view of a prior art staple spinning machine to provide large denier tow product feeding a conventional staple yarn process.

The piddled fiber is preferably obtained most economically by a modified method of operating a staple fiber spinning machine having a single polymer supply system feeding multiple spinning positions normally combined together to make a single large denier tow product collected into a container to be later converted to staple fiber. FIG. 29 illustrates such a system having a staple fiber spinning machine 500 with, for instance, 10 positions, such as individual positions 502, 504, 506, 508 and 510, the machine provided with polymer from a single supply at 511. The positions are all combined into a large denier tow product 512, which is piddled into a large container 514. In a conventional staple converting process, the container 514, holding over 1000 lbs of product is combined with other containers and goes through a conversion process, generally designated at 516 that ultimately results in staple fiber being spun into yarn in a carding, combing, spinning system 518.

Figure 30:
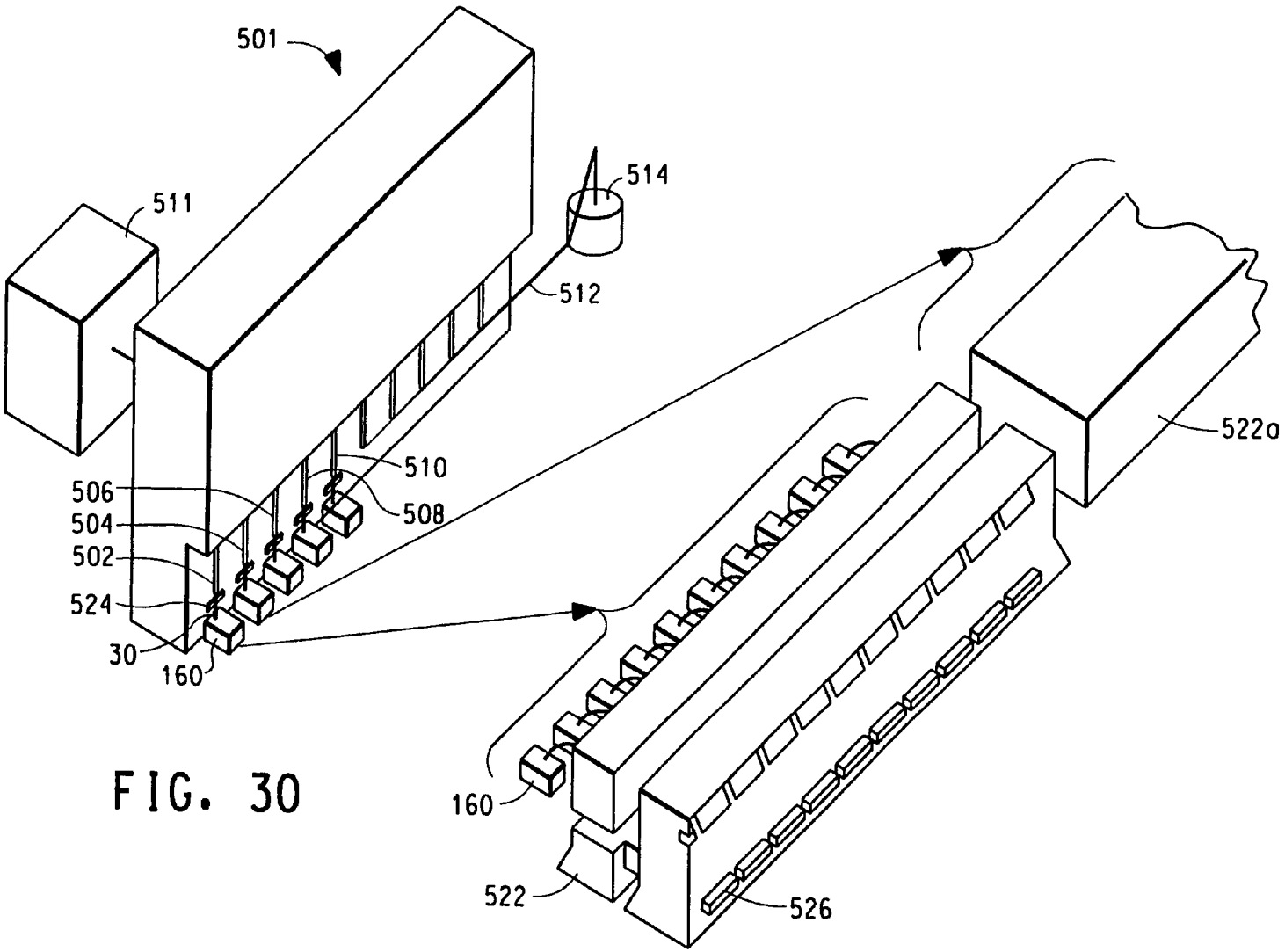
FIG. 30 shows an isometric view of a staple spinning machine modified to provide both low denier and high denier tow product.

Referring now to FIG. 30, he improvement comprises managing the operation of the modified staple spinning machine 501, having at least about 10 spinning positions, to simultaneously produce a plurality of low denier tow products rather than a single large denier tow product, the low denier products each being less than about 20% of the large denier tow product. In FIG. 30, it is envisioned that at least 2 positions, and preferably at least 5 positions, for instance positions 502, 504, 506, 508 and 510 would produce individual low denier tow products and the remaining 5 or more could continue to produce a large denier tow product, or, referring to FIG. 31, all positions on the modified staple spinning machine 503 could produce individual low denier tow products. An individual low denier tow product 30 comprises at least 500 fibers at a spinning position that is collected into an individual container 160 holding about 20 to 200 lbs of low denier tow product. The means for collecting the individual low denier tow product comprises a piddle device 524 or a winder (not shown); preferably a piddle device is used to collect undrawn product into the container 160 in a way that the product can be stored, transported and withdrawn for further processing. A wound package on a tube core from a winder is also a container from which the product can be stored, transported and withdrawn for further processing.

The new method of operating the staple spinning machine also includes changing the fiber product characteristics for at least one spinning position making the low denier product such that the fiber product characteristics differ from the remaining spinning positions making either the low denier product or the large denier product. Such changed fiber product characteristics may include a different denier per filament, a different finish, a different color by direct color injection at the spinning position, a different filament cross section, or other fiber differences commonly available at an individual spinning position.

The new method of operating the staple spinning machine further comprises providing a means to process the low denier tow product from at least one spinning position to convert the low denier tow product to a spun yarn product. Such means illustrated in FIGS. 30 and 31 would preferably comprise the stretch break machine 522 of the invention being supplied from the piddled fiber container 160. Alternatively, the machine could comprise the '463 reference to Minorikawa or the '778 reference to Adams or the like which converts continuous filament fiber to discontinuous filament staple yarn. Each position on the staple fiber spinning machine, such as position 502, could supply the needs of maybe 10 spinning positions, such as position 526, on a stretch break machine 522 so that many stretch break machines, such as 522 and 522*a*, each with a plurality of positions could be supplied with fiber from a single staple spinning machine 500.

Figure 13:
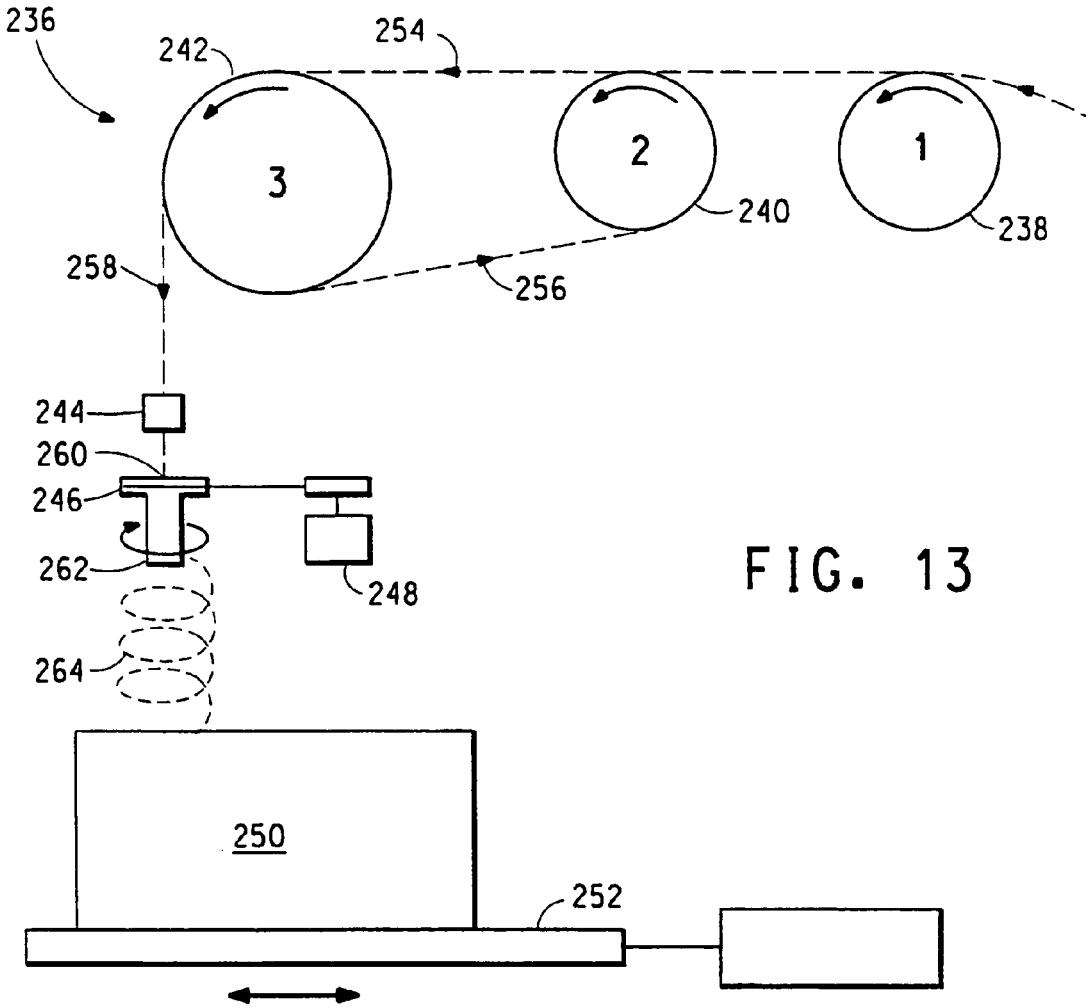
FIG. 13 is a schematic view of a piddling device for piddling feed fiber through a fiber distributing rotor and into an oscillating container.
Figure 14:
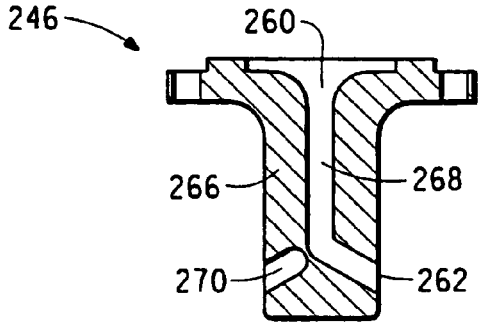
FIG. 14 is a section view of the rotor of FIG. 13.
Figure 31:
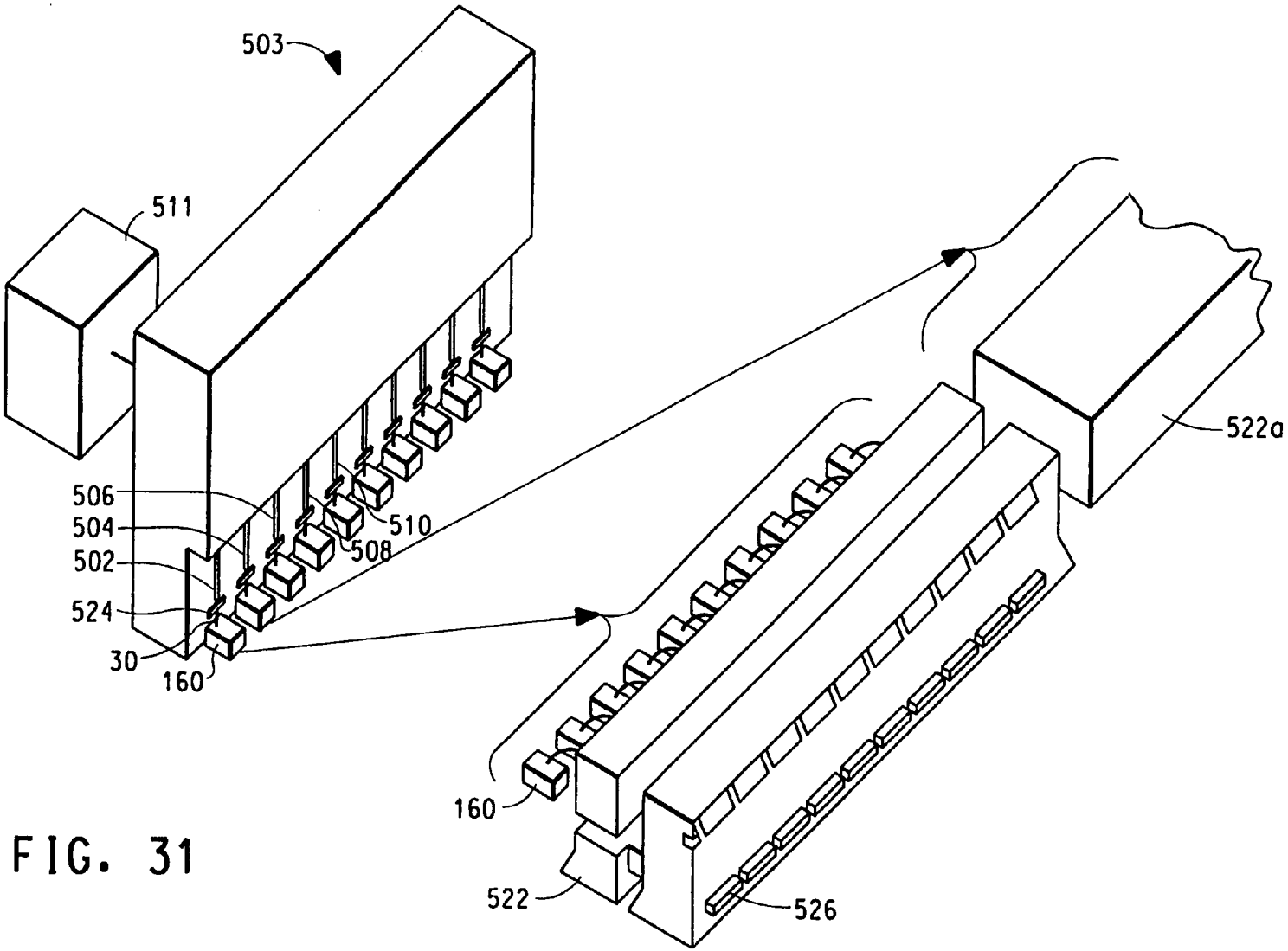
FIG. 31 shows an isometric view of a staple spinning machine modified to provide low denier tow product from individual positions feeding a stretch break yarn process.

The feed yarn 30 can be provided in the piddle container 160 of FIGS. 11, 30, and 31 by a piddling device as disclosed in U.S. Pat. No. 4,221,345 or it can be provided by a device as illustrated in FIGS. 13 and 14. FIG. 13 shows a piddler device 236 that comprises a guide roll 238, an idler roll 240, a drive roll 242, an aspirating jet 244, a fiber distributing rotor 246, a rotor driver 248, a container 250, and a container oscillator 252. The fiber 30 can come from a staple spinning machine for continuous man-made filaments, such as the staple spinning machine 501 or 503 in FIGS. 30 and 31, respectively. The guide roll 238 guides the fiber to an idler/drive roll combination, rolls 240 and 242 respectively, where the fiber makes at least one complete wrap as shown by the arrows 254 and 256 before being fed to the aspirator jet 244 in the direction of arrow 258. The fiber is propelled by a gaseous fluid in the aspirator jet toward an entrance passage 260 in the rotor 246 which is being rotated continuously by rotor driver 248. The fiber passes through the rotor 246 and leaves through a passage exit 262. The fiber then descends in a spiral path 264 into the container 250. As one portion of the container gradually fills with fiber, the container oscillator moves the container slowly under the rotor to progressively fill the container with back and forth layers of spiral-laid fiber. Such a piddle device can operate at speeds consistent with conventional spinning positions and deposit fiber in a way that it can be removed from the container at a slow speed consistent with stretch-breaking speeds.

FIG. 14 shows a detailed cross-section view of the rotor 246, which has a body 266. The entrance passage 260 is located on top of the body 266 at the center of rotation of body 266, and is connected to the passage exit 262 by an angled passage 268 which the fiber 30 (FIG. 11) and fluid from aspirating jet 244 (FIG. 13) can easily pass through. A balancing hole 270 is provided opposite passage exit 262 to balance the rotor and minimize vibration during rotation.

The processes as illustrated in FIGS. 1, 8 and 9 using the apparatus of FIG. 11 can produce a staple yarn having a linear density of less than or equal to 1000 denier or a staple yarn having 500 or less filaments per cross-section. Such a yarn has a unique distribution of filament lengths when the break zones are operated as described above to provide a particular stretch broken yarn. The unique stretch-broken yarn has a particular average filament length, a maximum filament length and a range of filament lengths. Such a stretch-broken yarn has a useful number of filament ends per inch. A substantial percentage of these numerous filament ends can be found as protruding ends extending from the central portion of the yarn to give the yarn a desirable feel or "hand". In a preferred embodiment, the yarn has a numerical average filament length (versus a weight average) that is greater than 6 inches, the maximum length of 99% of the filaments is less than 25 inches, and the middle 98% of the filament lengths defines a length range that is greater than or equal to the average length. The range equals the maximum length of the mid 98% samples minus the minimum length of the mid 98% samples. The yarn can also be characterized as a consolidated, man-made fiber of discontinuous filaments of different lengths, the filaments intermingled along the length of the yarn to maintain the unity of the yarn, wherein the average length, avg, of the filaments is greater than 6 inches, and the fiber has a filament length distribution characterized by the fact that 5% to less than 15% of the filaments have a length that is greater than 1.5 times the average length, avg. Preferably, the filament length distribution also has 5% to less than 15% of the filaments having a length less than 0.5 times avg.

Figure 15:
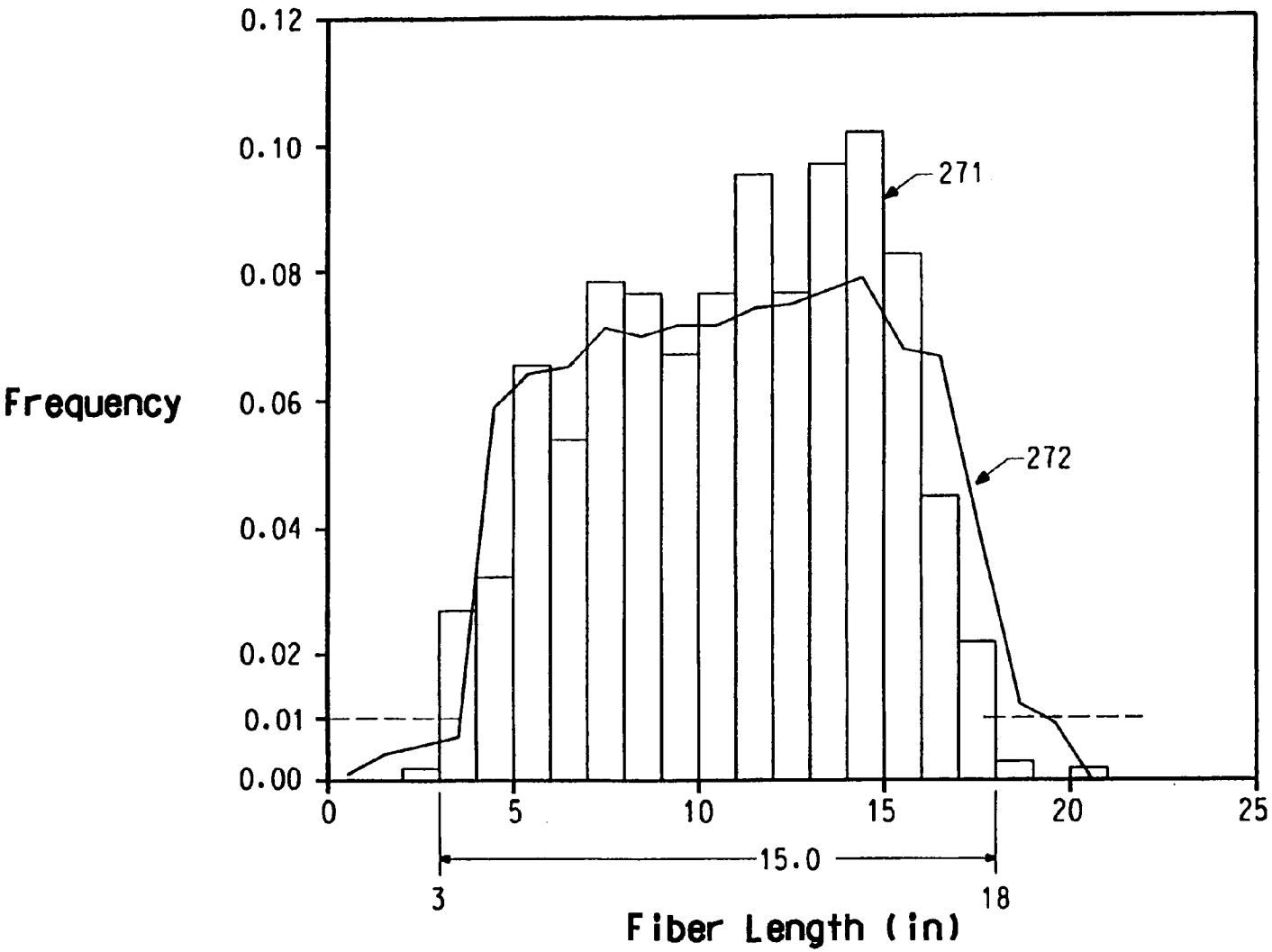
FIG. 15 illustrates a plot of filament length distribution for an actual yarn test and from a simulation of that test.

FIG. 15 illustrates a plot of filament length distribution for a yarn that was made according to the following process parameters:

$e_b$=3.5 feed yarn to draw zone $e_b$=0.247 feed yarn value after draw and entering first break zone $e_b$=0.1 (estimated value entering second break zone)

L1=51.0"; L2=16.9"; (L2=0.33 L1)

D1=3; D2=2; (D2−1)/(D1−1)=0.5 draw speed ratio D4=4.2 draw length L4=112"

draw temperature=188° C. over a 12" contact surface feed material was one fiber of 9147 denier, 6.6 dpf continuous filament nylon from a container of piddled fiber.

The histogram in FIG. 15 represents the actual yarn sample filament length distribution and is labeled 271. The filament lengths were pulled from the fiber before consolidation so they could be easily removed. No draft was employed. The filament lengths were obtained by the process described in U.S. Pat. No. 4,118,921 under the sections entitled "Average Fiber Length", "Fiber Length Distribution", and "Fiber Length Histogram", hereby incorporated herein by reference. It was known by denier measurement and calculation that there were about 192 filaments in the fiber cross-section coming from the second break zone, so 500 filaments were removed from the new end of fiber and the lengths were recorded and grouped in one inch increments. The procedure to get this number of filaments was to repeat the process under "Average Fiber Length" after each batch of 100 filaments. This resulted in the histogram 271 of fiber length and frequency of FIG. 15. The model simulation of the process was set up the same as the actual test process to predict the filament length distribution represented by curve 272 of FIG. 15. As can be seen, the simulation of the filament length distribution is close to the actual filament length distribution. For the actual test, the numerical average filament length was 11.0", and for the simulation the average filament length was 11.1". For the actual test, the length of the middle 98% of filament lengths was from 3" to 18" for a range of 15". For the simulation, the lengths were from 3.5" to 19.5" for a range of 16". For the actual test, the maximum length of 99% of the filaments was 18", and for the simulation, the maximum length was 19.5". Simulation values in these cases were within 10% of the actual values. The number of filaments having a length less than 0.5 times the average, avg, and the number greater than 1.5 times the average were measured and simulated. The measured results are 8.2% less than 0.5 avg and 5.0% greater than 1.5 avg. The simulated results are 11.16% less than 0.5 avg and 10.27% greater than 1.5 avg. These simulation results do not agree as well with the measurements. The measured results of filament distribution for the upper and lower tails of the distribution are thought to be statistically unreliable since there were far too few filaments sampled in the tails of the distribution. In the simulation, 40,000 filaments total are sampled which includes many tail filaments. In the measured distribution only 500 filaments total were measured which included few tail filaments. Alternatively, more filaments could be taken in the measured sample. The data in FIG. 15 is also tabulated in Table I.

Values of the actual test and simulation fall within the limits of the yarn product invention as follows:

- average filament length=11.0 and 11.1 which are ≧6"
- mid 98% range=15" and 16" which are ≧11.0" and 11.1", respectively
- maximum 99% filament length=18" and 19.5" which are ≦25"
- filament lengths less than 1.5 times avg=5.0% and 10.27% which are between 5% and less than 15%
- filament lengths less than 0.5 times avg=8.2% and 11.16% which are between 5% to less than 15%

Table I below illustrates other simulated operating conditions including some comparative example simulations and shows various ranges of operating parameters that fall within the limits of the invention. Some actual test with actual and simulated results are also included.

TABLE I

Figure 16:
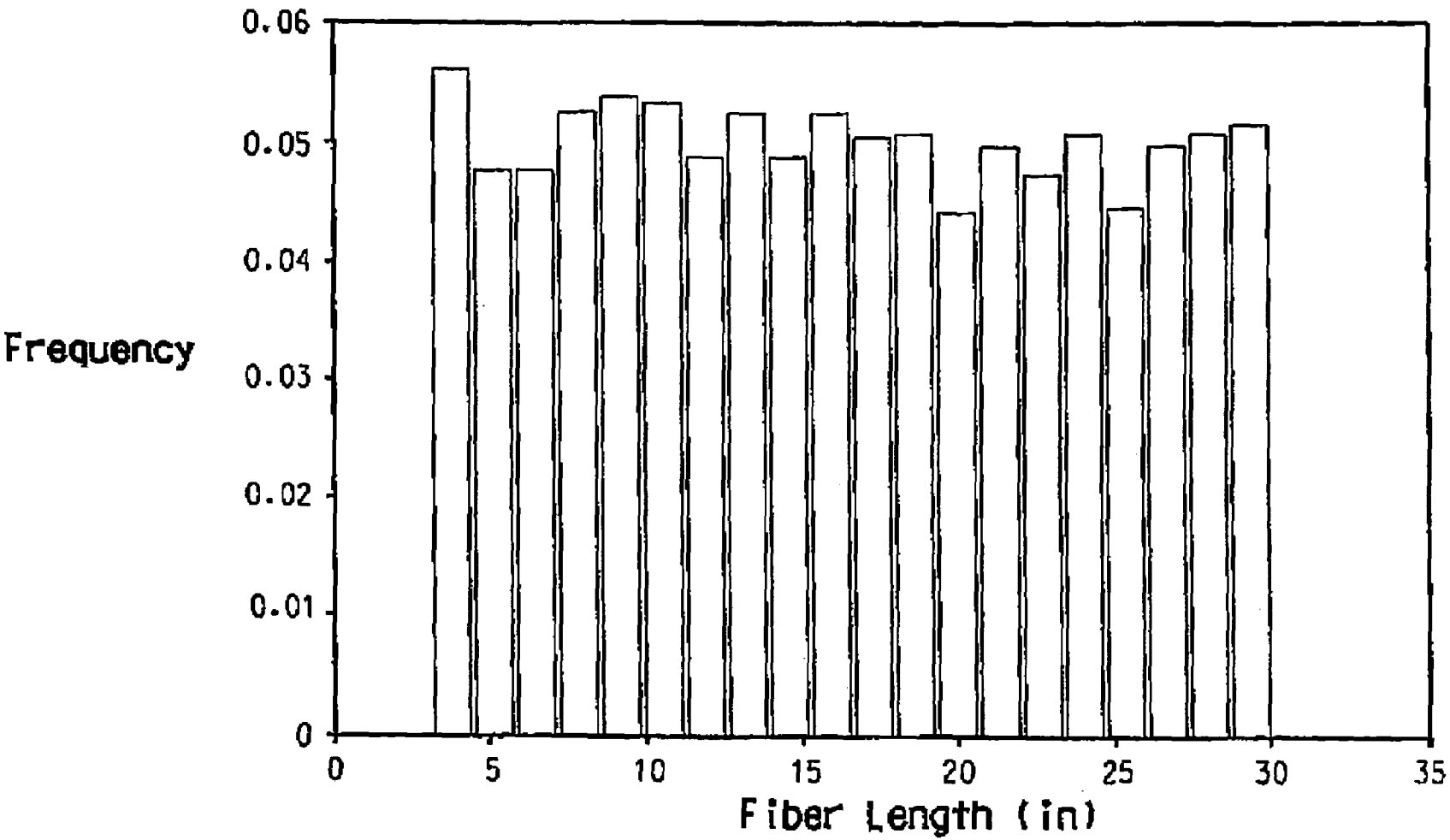
FIGS. 16 and 17 illustrate a simulation of two comparative examples using only a single stretch-break zone and the fiber distribution that resulted, which falls outside of the limits of the invention.
Figure 17:
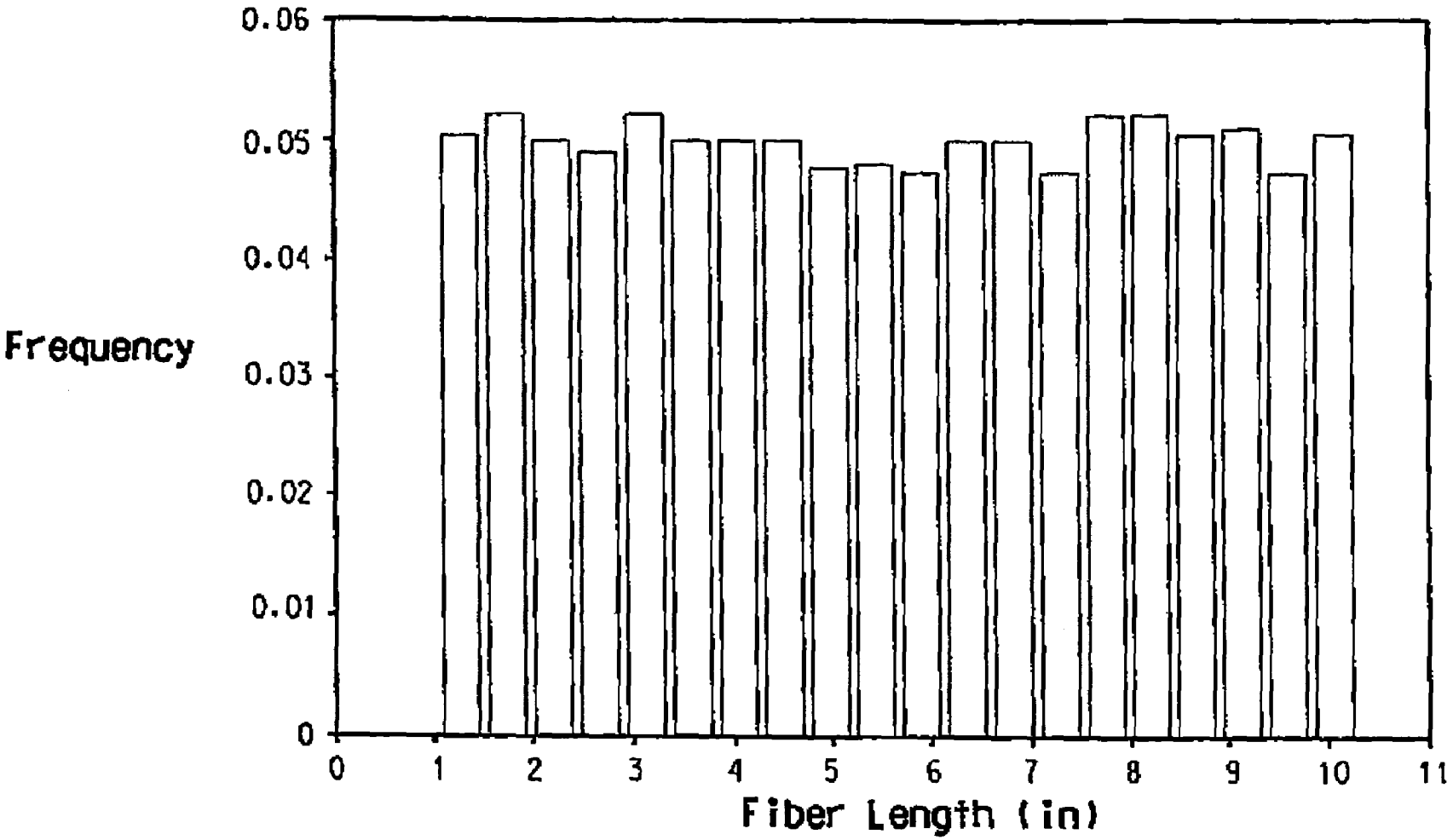

| Example | Dt | D1 | D2 | (D2 − 1)/(D1 − 1) | L1 | L2 | L2/L1 | Ndg/Nuc L1 | Ndg/Nuc L2 | Avg Fila. Length | Feed Fiber Denier | Fila Ends/In | Related Fig/Table | % Filaments <0.5 avg. | % Filaments >1.5 avg. |
|---|---|---|---|---|---|---|---|---|---|---|---|---|---|---|---|
| SIMULATION RESULTS ($e_b$ = 0.1 for each break zone for all simulations) | | | | | | | | | | | | | | | |
| CE1 | 25 | 25 | — | — | 30" | — | | 0.80% | | 16.6" | 1250 | 6 | FIG. 16 | | |
| CE2 | 25 | 25 | — | — | 10" | — | | 0.89% | | 5.7" | 1250 | 18 | FIG. 17 | | |
| A | 25 | 2.5 | 10 | 6 | 30" | 10" | .33 | 12.1% | 1.39% | 6.0" | 1250 | 17 | | | |
| A1 | 25 | 3.8 | 6.6 | 2.0 | 30" | 10" | .33 | | | | | | | | |
| B | 25 | 5 | 5 | 1 | 30" | 10" | .33 | 4.43% | 3.26% | 6.2" | 1250 | 17 | | | |
| B1 | 25 | 5.79 | 4.34 | 0.7 | 30" | 10" | .33 | 3.8% | 3.8% | | | | | | |
| C | 25 | 10 | 2.5 | 0.16 | 30" | 10" | .33 | 2.04% | 7.63% | 6.5" | 1250 | 16 | FIG. 18 | 13.43 | 12.06 |
| D | 25 | 2.5 | 10 | 6 | 48" | 16" | .33 | 12.1% | 1.4% | 9.7" | 755 | | | | |
| E | 25 | 5 | 5 | 1 | 48" | 16" | .33 | 4.5% | 3.0% | 9.8" | 755 | | | | |
| F | 25 | 10 | 2.5 | 0.16 | 48" | 16" | .33 | 2.0% | 7.6% | 10.6" | 755 | | | | |
| G | 30 | 5 | 6 | 1.25 | 50" | 16.5" | .33 | 4.34% | 2.56% | 10.1" | 1200 | 8 | FIG. 19 | 15.49 | 14.30 |
| H | 30 | 10 | 3 | 0.22 | 50" | 16.5" | .33 | 2.04% | 6.14% | 10.6" | 1200 | 8 | | | |
| J | 30 | 5 | 6 | 1.25 | 50" | 10" | .2 | 4.44% | 3.40% | 6.0" | 1200 | 14 | | | |
| K | 30 | 10 | 3 | 0.22 | 50" | 10" | .2 | 1.95% | 8.18% | 6.4" | 1200 | 13 | | | |
| FIG. 15 simul | 25.2 | 3 | 2 | 0.5 | 51" | 16.9" | .34 | | | 11.1" | 9147 | | FIG. 15 simu | 11.16 | 10.27 |
| TESTS RESULTS | | | | | | | | | | | | | | | |
| FIG. 15 meas | 25.2 | 3 | 2 | 0.5 | 51" | 16.9" | .34 | | | 11.0" | 9147 | | FIG. 15 meas | 8.2* | 5.0* |
| Test 20 | | 4.6 | 3.2 | 0.61 | 48" | 16" | .33 | | | 8.9" s | 9700 | | Table II | 14.7 s | 12.4 s |
| Test 21 | | 4.6 | 3.0 | 0.56 | 48" | 28" | .58 | | | 17.5" s | 7800 | | Table II | 13.9 s | 12.4 s |
| Test 22 | | 4.6 | 3.0 | 0.56 | 25.7" | 10" | .39 | | | 6.4" s | 7800 | | Table II | 13.9 s | 12.3 s |
| Test 23 | | — | 10 | — | — | 16" | | | | 8.0" s | 9700 | | Table II | 18.3 s | 18.4 s |
| Test 24 | | 4.37 | 3.36 | 0.7 | 30" | 10.5" | .35 | | | 6.7" s | 7800 | | Table II | 14.1 s | 12.7 s |

s = simulation results
*stastically unreliable

Examples CE1 and CE2 are comparative simulation examples operating at a total speed ratio of Dt=25. In ex. CE1, the break zone length L1 is 30" and the percentage of double gripped filaments is low. When the filament distribution of CE1 is plotted in FIG. 16, it is determined that the maximum length of 99% of the filaments is above 25". In CE2, the break zone length is 10" and the average filament length is less than 6.0" which is believed to contribute to lower strength yarn when interlacing is used for consolidation. The filament distribution of CE2 is plotted in FIG. 17 where it is seen the maximum length of 99% of the filaments is less than 25" which is an improvement over ex. CE1. Since the percentage of double gripped filaments is low in both comparative examples of single break zones, it is expected there will be operability problems running these examples. When tests similar to the simulation conditions were run in single break zones, operability problems occurred at speed ratios approaching 20 for zone lengths down to 20" long and approaching 5 for zone lengths at 10" long.

Figure 18:
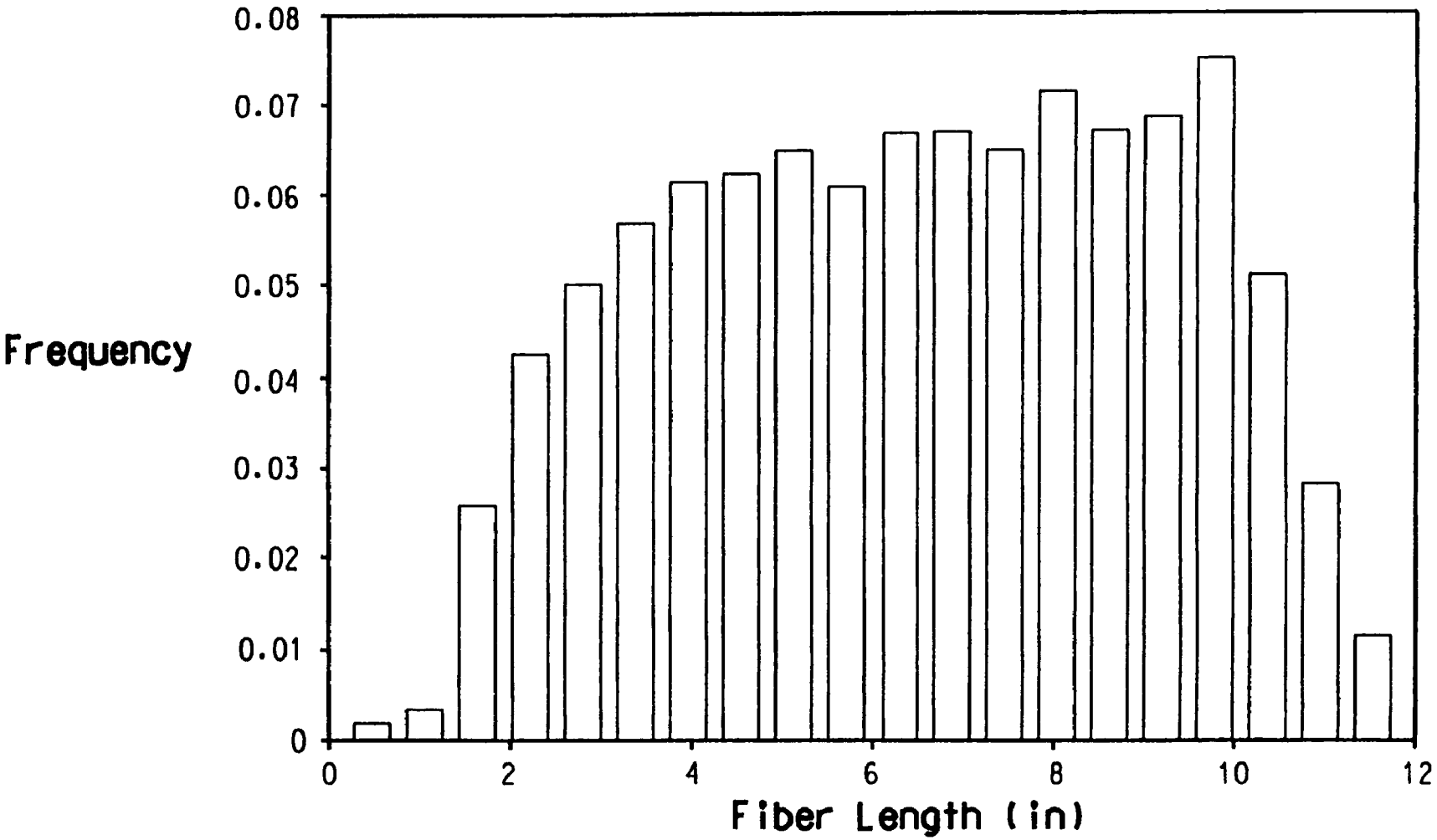
FIGS. 18 and 19 illustrate simulations of other operating conditions and the fiber distribution that resulted, which falls within the limits of the invention.

Examples A, B, C, D, E, and F are simulation examples that were also run at a total speed ratio of Dt=25. Example A illustrates a high speed ratio in the second break zone of D2=10 which resulted in a low percentage of double gripped filaments in the second break zone, although the percentage is more than 50% greater than that in the single break zones of the comparative examples. Example A1 shows that a reduction in the second break zone speed ratio and increase in the first break zone ratio results in a favorable value for (D2−1)/(D1−1) of 2.0. It is expected this would result in an operability improvement over example A. Example B shows a condition where the first and second break zones are operated at the same speed ratio of 5. This gives good results for percentage of double gripped filaments, although the second break zone has a lower value so operability problems would be more likely there. Example B1 illustrates that by reducing the second break zone speed ratio and increasing the first break zone speed ratio one would expect to improve the operability of the second zone so both zones have the same high percentage of double gripped filaments. The approximated value of 3.8% is obtained from the plot of FIG. 4 at a value of (D2−1)/(D1−1) of 0.7. Example C illustrates the effect of a high speed ratio in the first break zone which reduces the percentage of double gripped filaments there compared to examples A and B. At the level of D1=10, however, the percentage of double gripped filaments is higher than that in the second break zone when D2=10 in example A. This is also supported by the actual data in FIG. 10A looking at the maximum operability point 157 for the optimum value of (D2−1)/(D1−1) of 0.7. At this point where Dt=42.8, the value for D1 is 7.5 and for D2 is 5.7. It appears that operability problems related to double gripped filaments occur in the second break zone at a lower level of speed ratio than in the first break zone. The filament distribution for example C is shown in FIG. 18. It has an average length=6.51"(>=6"); a mid 98% range=10"(>=6.51"); and a maximum 99% filament length=11.5"(<=25"). The simulated results for the number of filaments having a length less than 0.5 times the average and the number greater than 1.5 times the average are 13.43% less than 0.5 avg and 12.06% greater than 1.5 avg. This exemplifies the invention and has a good number of filament ends per inch. Examples D, E, and F show similar results to examples A, B, and C respectively when using longer first and second break zones L1 and L2. Since L2=0.33 L1 in each case there is little effect on the percentage of double gripped filaments. The average filament lengths increase as expected.

Figure 19:
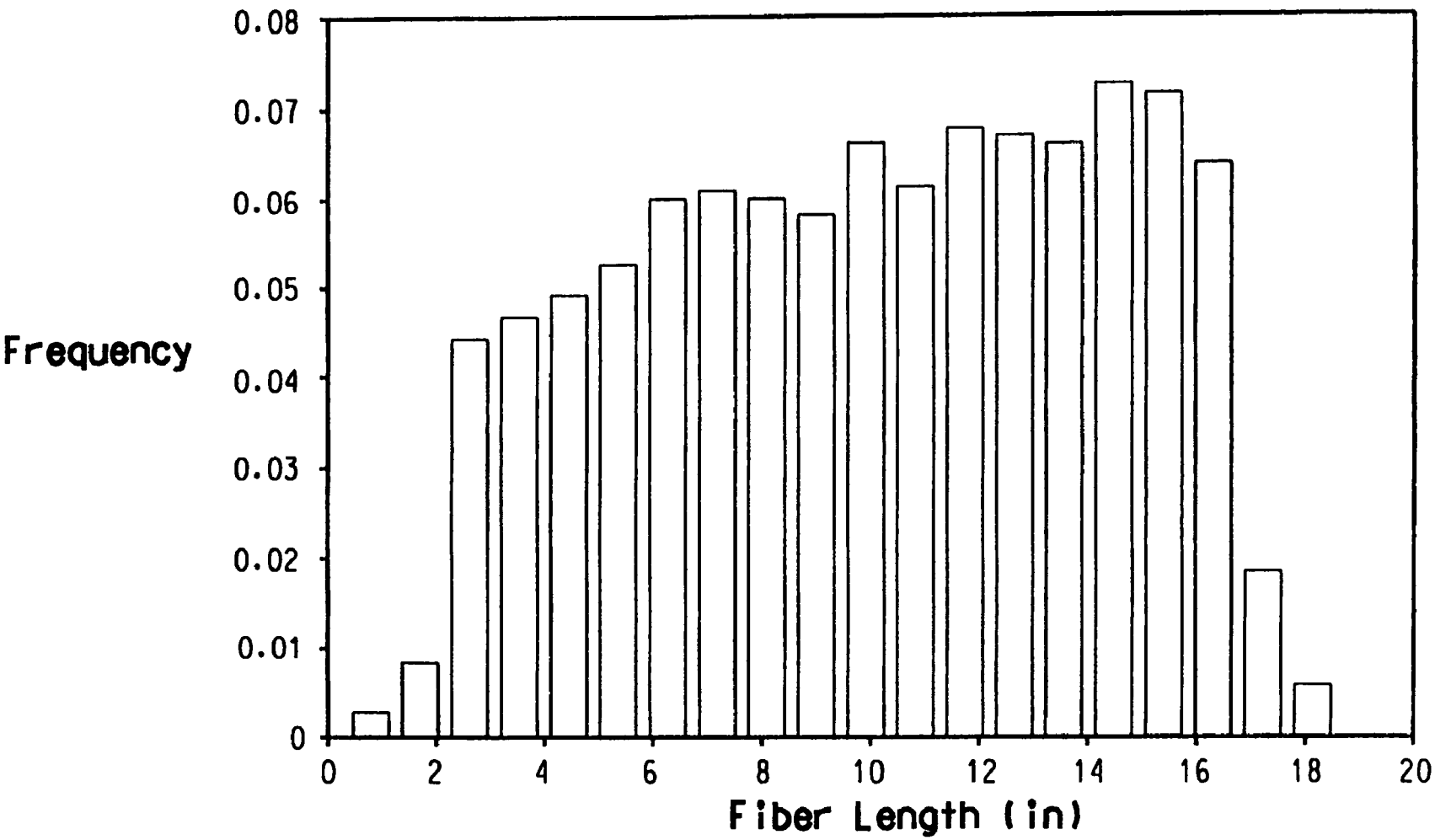

Examples G, H, J, and K are simulation examples that were run at a higher total speed ratio of Dt=30. Different zone lengths were used, but still L2=0.33 L1 for examples G and H. They compare favorably with examples B and C respectively in terms of percentage of double gripped filaments, since the increase in Dt was not significant enough to decrease the percentage much. The filament distribution for example G is shown in FIG. 19. It has a longer average length=10.1"; a wider mid 98% range=15"; and a higher maximum 99% filament length=17.5", than example C. The simulated results for the number of filaments having a length less than 0.5 times the average and the number greater than 1.5 times the average are 15.49% less than 0.5 avg and 14.30% greater than 1.5 avg. Example G has a correspondingly lower filament ends per inch than ex. C, although the reduced denier of feed yarn and increased speed ratio also contribute to the lower value. In examples J and K, L2=0.2 L1, but this change is not enough to make much difference compared to examples B and C respectively.

Figure 20:
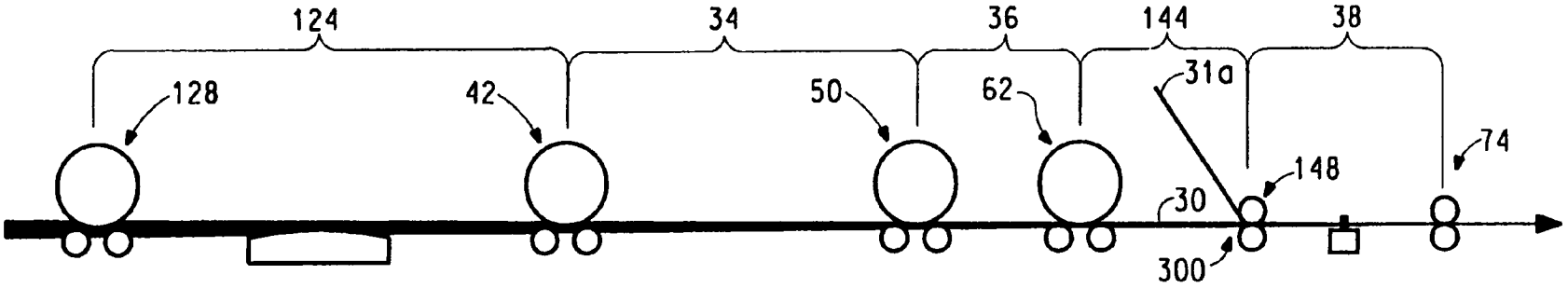
FIG. 20 shows the process schematic of FIG. 9 where an additional feed fiber is introduced at the upstream end of the consolidation zone.

FIG. 20 shows the process schematic of FIG. 9 where a new stretch-broken product can be made by introducing an additional feed fiber 31*a* at the downstream end 300 of the draft zone 144 which is the also the upstream end of the consolidation zone 38. Since the fiber 31*a* will not be subjected to any drafting, the filaments in the fiber 31*a* can be continuous or discontinuous. If continuous filaments are used, they can be high strength filaments with low elasticity such as an aramid fiber, or they can be filaments with high elasticity, such as a spandex-type fiber or a 2GT (1,2-ethane diol (or ethylene glycol) estrified with terephthalic acid) or a 3GT (1,3-propanediol (or 1,3 propylene glycol)-3GT (estrified with terephthalic acid) polyester fiber. A preferred spandex-type fiber is one with elastic filaments having an elongation to break greater than about 100% and an elastic recovery of at least 30% from an extension of about 50%. These additional fibers 31*a* can be added to fibers 30 that preferably include a polymer such as nylon, polyester, aramid, fluoropolymer or Nomex® (brand name for a fiber and paper with raw materials of isophthalyl chloride, methpenylene diamine). Kevlar® aramid fiber of continuous filaments has been combined with polyester in one product; and Lycra® elastic fiber of continuous filaments has been combined with polyester in another product.

Figure 21:
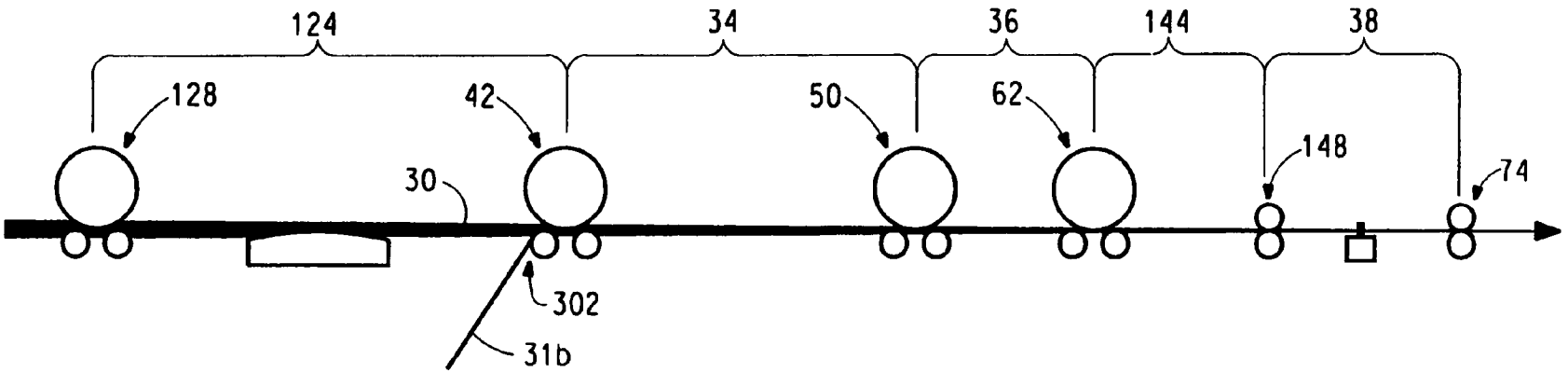
FIG. 21 shows the process schematic of FIG. 9 where an additional feed fiber is introduced at the upstream end of the first break zone.

FIG. 21 shows the process schematic of FIG. 9 where a new stretch-broken product can be made by introducing an additional feed fiber 31*b* at the downstream end 302 of the draw zone 124 which is also the upstream end of the first break zone 34. This is useful if fibers 31*b* which do not require drawing are to be added to drawn fibers 30. Both fibers 30 and 31*b* would be broken at the same time in the first break zone 34 and would continue to be treated together throughout the remainder of the process. Such additional fibers 31*b* are preferably of the polymer group including aramid, fluoropolymer, and Nomex®, and they are added to fibers 30 that preferably include a polymer from the group of nylon or polyester.

Figure 22:
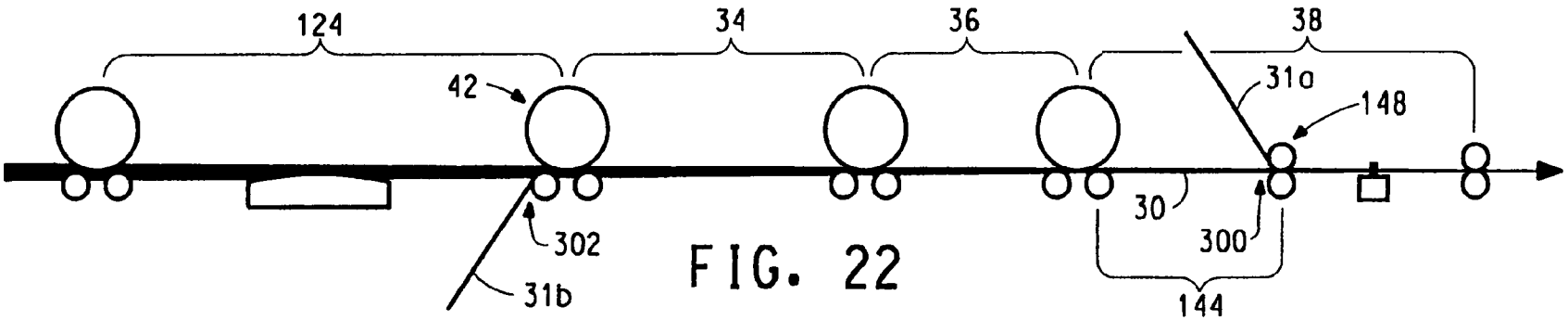
FIG. 22 shows the process schematic of FIG. 9 where a first additional feed fiber is introduced at the upstream end of the first break zone, and a second additional feed fiber is introduced at the upstream end of the consolidation zone.

FIG. 22 shows the process schematic of FIG. 9 where a new stretch-broken product can be made by introducing a first additional feed fiber 31*b* at the downstream end 302 of the draw zone 124 which is also the upstream end of the first break zone 34; and also introducing a second additional fiber 31*a* at the downstream end 300 of the draft zone 144 which is the also the upstream end of the consolidation zone 38. This forms a useful combination of fiber features as discussed referring to FIGS. 20 and 21. A particularly preferred embodiment is to introduce a fluoropolymer as the first additional fiber 31*b*, a spandex-type fiber as the second additional fiber 31*a* with both additional fibers joining a fiber 30 of polyester. Such a yarn product is useful as a textile yarn for weaving or knitting socks. Another product combined discontinuous polyester, as a first feed fiber that was drawn, with a first additional feed fiber of Kevlar® aramid that is stretch broken with the polyester, and that combination combined with a second feed fiber of Lycra® elastic fiber of continuous filaments to form a three component yarn.

The stretch breaking process of the invention is useful when blending fibers that may have already been processed to some degree, such as by incorporating color or a surface treatment that gives the fiber some visual characteristic that can be detected with the unaided eye. Stretch breaking is a useful way to make specialty yarns without involving a lot of additional steps, such as is required in conventional staple blending where the sliver must first be prepared by chopping (cutting), blending, carding, combing, and the like as was generally illustrated at 516 and 518 in FIG. 29. In this conventional system, a large quantity of feed fiber must be prepared to make the process worthwhile, since cleaning the processing equipment after each product run is very labor intensive and time consuming. In the case of stretch breaking, only a small amount of feed fiber needs to be prepared for blending with another fiber, and there is practically no cleanup required to switch to another product blend other than changing packages in a creel. This is particularly useful in preparing small quantities of color blended yarn. Referring to FIG. 9, applicants have discovered that by feeding in a first color fiber 31*c* that is different than a second feed fiber 31*d*, a different color yarn can be produced that is a blend of the two colors. By different colors is meant two colors that are essentially non-white and non-beige variations, although one fiber may be a white or beige and the other a distinctly non-white, non-beige color. The intent is that two distinctly different colors are combined and stretch broken together and then consolidated to create a new distinct color. ASTM committee E12, standard E-284 describes a means to distinguish neutral colors, such as white and beige, based on a lightness measurement with white and beige having a lightness greater than 90%. It also permits distinguishing color hue and shade to detect color difference by using CIELAB units where distinctly different colors would have a CIELAB unit difference of at least 2.0. By blending at least two different colors of fiber, where only one would have a lightness greater than 90% and the others would have a color difference in CIELAB units of at least 2.0, creates a new colored yarn from at least two different feed fibers. The color of the new yarn is distinctly different than any of the feed fiber colors. When processed further into a cloth-like material, the blended color shows up as a mild heather look. Other visual differences that can be blended with applicants stretch breaking process are fibers having a distinct difference in reflectance, absorbence, wettability, and the like.

Figure 23:
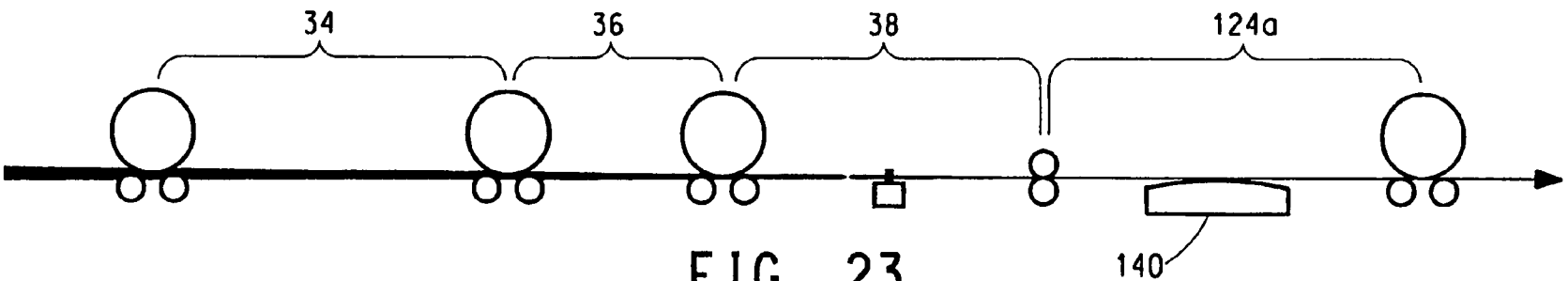
FIG. 23 is a schematic elevation view of the process line of FIG. 9 that includes an annealing zone after the consolidation zone.

FIG. 23 is a schematic elevation view of the process line of FIG. 1 that illustrates addition of an annealing zone 124*a* after the consolidation zone 38. The annealing zone was discussed previously when referring to the draw zone 124 with heating means 140 shown in FIG. 8 that is used without a substantial speed change ratio. This may be useful in a process where the final shrinkage of the yarn must be controlled to a specified value and annealing after formation of the yarn is the most direct way to accomplish this. It may also be useful when the feed fiber consists of two different fibers and the annealing heat treatment causes each fiber in the yarn to respond differently to create a special effect yarn, as when the shrinkages of the fibers are different and the differential shrinkage produces a bulky or loopy yarn.

Figure 24:
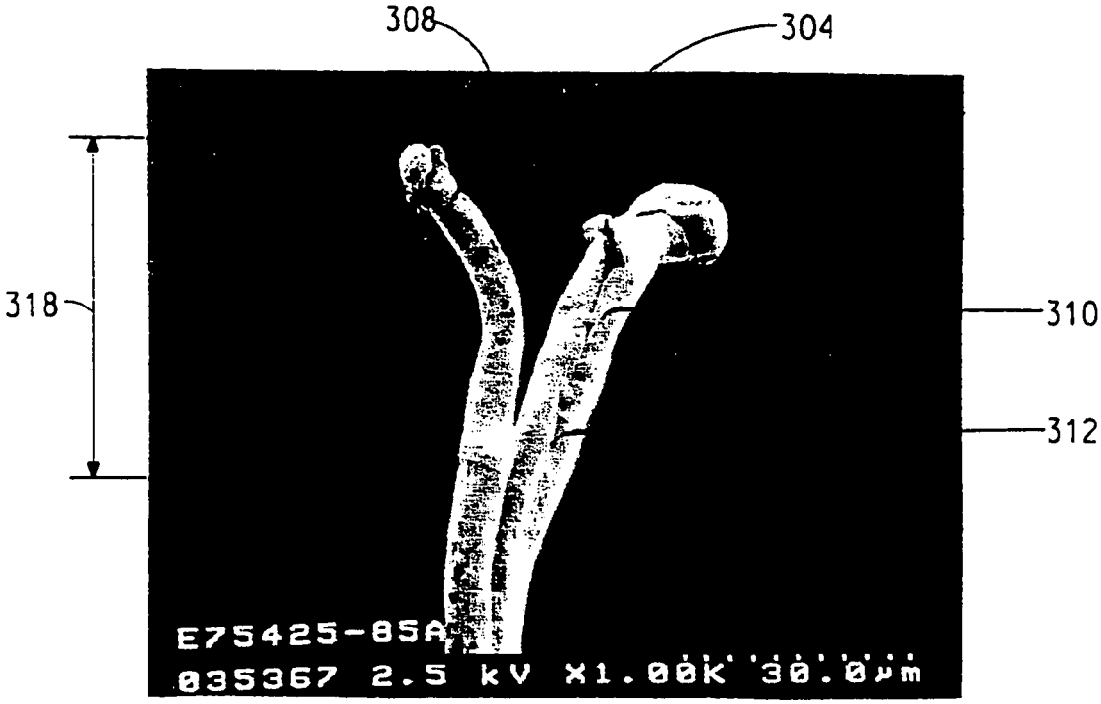
FIG. 24 shows a photomicrograph of a stretch-broken filament that has split ends.
Figure 25:
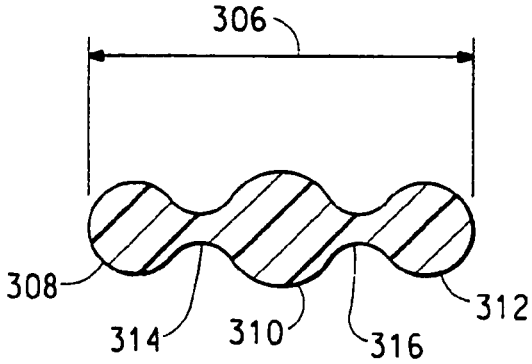
FIG. 25 is a cross section of the filament of FIG. 24.

FIG. 24 shows a photomicrograph of a filament from a novel stretch broken product having the end 304 of each filament split as a result of the stretch breaking process. The feed fiber is a manmade fiber comprising continuous polyester filaments that is known by the E.I. DuPont trademark of Coolmax® and is describe in U.S. Pat. No. 3,914,488 to Gorrafa and U.S. Pat. No. 5,736,243 to Aneja. Referring also to FIG. 25, which shows a cross-section of the filament, the filament has a width 306 and, within that width, a plurality of thick portions 308, 310, and 312 that are connected by thin portions 314 and 316. It is believed that the stretch breaking process causes the thin portions 314 and 316 to become severed at the ends of the filaments when the filaments break. The severing occurs for a length 318 of at least about three filament widths so one or more of the thick portions, such as portion 308, are split apart from the other thick portions, such as portions 310 and 312, at the ends of the filaments. This is believed to result in the appearance and feel of having more filament ends in the yarn, which improves the "hand" of a fabric made from the yarn.

TABLE II

PRODUCT - PROCESS SUMMARY

| | Feed 1 | | Feed 2 | | Feed 3 | | Feed 1 Speed | Draw length | Draw temp | Heat length | D4 | 1st Brk length | D1 |
|---|---|---|---|---|---|---|---|---|---|---|---|---|---|
| Test | material | denier | material | denier | material | denier | ypm | L4 (in) | (deg C.) | (in) | ratio | L1 (in) | ratio |
| 1 | NylonP | 9147 | | | | | 1.5 | 112.0 | 188.0 | 12.0 | 4.20 | 52.0 | 3.25 |
| 2 | NylonP | 9147 | | | | | 3.0 | 112.0 | 188.0 | 12.0 | 4.20 | " | 3.00 |
| 3 | Teflon*W | 1730 | | | | | 7.0 | | n/a | | 1.15 | " | 2.00 |
| 4 | Dacron*W | 7350 | Keviar*W | 1500 | | | 3.0 | 112.0 | 188.0 | 12.0 | 2.43 | " | 2.00 |
| 5 | Keviar*W | 1505 | Teflon*W | 1730 | | | 5.5 | | n/a | | 1.01 | " | 2.50 |
| 6 | Keviar*W | 1505 | Nomex*W | 200 | | | 6.5 | | n/a | | 1.01 | " | 2.50 |
| 7 | Keviar*W | 1505 | | | | | 2.0 | | n/a | | 1.01 | " | 2.50 |
| 8 | Dacron*W | 7350 | Teflon*W | 1730 | | | 2.5 | 112.0 | 188.0 | 12.0 | 2.43 | | |
| 9 | Dacron*W | 7350 | | | | | 3.0 | 112.0 | 188.0 | 12.0 | 2.43 | " | 2.00 |
| 10 | Dacron*W | 7350 | | | Lycra*W | 30 | 3.0 | 112.0 | 188.0 | 12.0 | 2.43 | " | 2.00 |
| 11 | Coolmax*P | 4915 | | | | | 3.0 | 112.0 | 180.0 | 12.0 | 2.55 | 52.0 | 2.70 |
| 12 | NylonP Iris | 3256 | NylonP Aubergine | 3256 | | | 3.0 | 67.0 | 188.0 | 12.0 | 2.80 | 47.0 | 3.00 |
| 13 | NylonP Light Steel | 3256 | NylonP Aubergine | 3256 | | | 3.0 | 67.0 | 188.0 | 12.0 | 2.80 | 47.0 | 3.00 |
| 14 | Keviar*W | 1505 | | | Keviar*W | 100 | 6.5 | | n/a | | 1.01 | 52.0 | 2.50 |
| 15 | Dacron*W | 7350 | Teflon*W | 1730 | Lycra*W | 30 | 2.0 | 112.0 | 188.0 | 12.0 | 2.43 | 52.0 | 3.00 |
| 16 | Dacron*W | 9736 | Dacron*W | 9736 | | | 3.0 | 66.2 | # | 36.0 | 3.30 | 47.0 | 4.50 |
| 17 | Dacron*P | 9700 | | | | | 3.1 | 66.0 | 188.0 | 12.0 | 3.40 | 46.0 | 4.60 |
| 18 | Nylon | 12660 | | | | | 4.5 | 66.0 | 195.0 | 36.0 | 3.60 | 47.0 | 6.11 |
| 19 | Dacron* | 9700 | | | | | 5.5 | 66.0 | 188.0 | 12.0 | 3.40 | 47.0 | 4.37 |
| 20 | Dacron* | 9700 | | | | | 4.3 | 66.0 | 188.0 | 12.0 | 3.40 | 47.0 | 4.60 |
| 21 | Dacron* | 7800 | | | | | 5.6 | 66.0 | 188.0 | 12.0 | 2.80 | 48.0 | 4.60 |
| 22 | Dacron* | 7800 | | | | | 5.6 | 66.0 | 188.0 | 12.0 | 2.80 | 25.7 | 4.60 |
| 23 | Dacron* | 7836 | | | | | 7.7 | 66.0 | 188.0 | 12.0 | 2.80 | 47.0 | 1.00 |
| 24 | Dacron* | 7800 | | | | | 5.2 | 66.0 | 188.0 | 12.0 | 2.80 | 30.0 | 4.37 |
| 25 | BC23W | 1200 | | | | | 9.9 | 66.0 | 180.0 | 40.0 | 1.02 | 48.0 | 3.00 |
| 26 | BC23W | 4714 | | | | | 9.9 | 66.2 | 160.0 | 40.0 | 3.00 | 48.0 | 3.83 |

TABLE II-continued

PRODUCT - PROCESS SUMMARY

| Test | 2nd Brk length L2 (in) | D2 ratio | Draft length L5 (in) | D5 ratio | Consol length L3 (in) | D3 ratio | Jet psi | Yarn final denier | D Ratio d2-1 d1-1 | L Ratio L2/L1 | Avg fil. (in.) | Prod Spd YPM |
|---|---|---|---|---|---|---|---|---|---|---|---|---|
| 1 | 17.0 | 2.25 | 16.5 | 2.50 | 10.0 | 0.87 | 90 | 137 | 0.56 | 0.33 | | |
| 2 | " | 2.00 | " | 2.00 | " | 0.87 | 90 | 209 | 0.50 | " | | |
| 3 | " | 2.20 | " | 2.00 | " | 0.94 | 70 | 182 | 1.20 | " | | |
| 4 | " | 3.00 | " | 2.00 | " | 0.95 | 70 | 397 | 2.00 | " | | |
| 5 | " | 2.00 | " | 2.50 | " | 0.94 | 80 | 274 | 0.67 | " | | |
| 6 | " | 2.00 | " | 1.50 | " | 0.98 | 80 | 230 | 0.67 | " | | |
| 7 | " | 2.00 | " | 3.10 | " | 0.95 | 80 | 101 | 0.67 | " | | |
| 8 | " | 3.00 | " | 2.00 | " | 0.95 | 85 | 278 | 1.00 | " | | |
| 9 | " | 2.00 | " | 3.00 | " | 0.92 | 70 | 274 | 1.00 | " | | |
| 10 | " | 2.00 | " | 3.00 | " | 0.88 | 70 | 316 | 1.00 | " | | |
| 11 | 17.0 | 2.00 | 16.5 | 1.30 | 10.0 | 0.99 | 70 | 277 | 0.59 | 0.33 | | |
| 12 | 13.5 | 2.00 | 16.0 | 1.45 | 25.0 | 0.89 | 110 | 280 | 0.50 | 0.29 | | |
| 13 | 13.5 | 2.00 | 16.0 | 1.45 | 25.0 | 0.89 | 100 | 280 | 0.50 | 0.29 | | |
| 14 | 15.0 | 2.00 | 16.5 | 1.50 | 10.0 | 0.94 | 80 | 311 | 0.67 | 0.29 | | |
| 15 | 17.0 | 3.00 | 16.5 | 3.00 | 10.0 | 0.94 | 70 | 217 | 0.63 | 0.33 | | |
| 16 | 14.0 | 3.20 | 16.0 | 1.54 | 25.5 | 0.96 | 80 | 277 | 0.63 | 0.30 | | |
| 17 | 11.5 | 3.20 | | | 20.0 | 0.96 | @ | 192 | 0.61 | 0.25 | | |
| 18 | 14.0 | 3.16 | | | 27.0 | 0.97 | 80 | 186 | 0.42 | 0.30 | | 303 |
| 19 | 14.0 | 3.36 | | | 31.5 | 0.98 | 80 | 198 | 0.7 | 0.30 | | 269 |
| 20 | 14.0 | 3.20 | | | 20.5 | 0.94 | @ | 206e | 0.61 | 0.30 | 6.9" s | 202 |
| 21 | 28.0 | 3.00 | | | 32.0 | 0.94 | @ | 200 | 0.56 | 0.58 | 17.5" s | 203 |
| 22 | 10.0 | 3.00 | | | 20.5 | 0.94 | @ | 198 | 0.56 | 0.39 | 6.4" s | 203 |
| 23 | 14.0 | 10.0 | | | 20.5 | 0.94 | @ | 279 | — | — | 8.0" s | 203 |
| 24 | 10.5 | 3.36 | | | 20.5 | 0.94 | @ | 203 | 0.7 | 0.35 | 6.7" s | 200 |
| 25 | 16.0 | 2.50 | | | 20.5 | 0.97 | @ | 160 | 0.75 | 0.33 | | 73e |
| 26 | 16.0 | 2.10 | | | 20.5 | 0.97 | 80 | 176 | 0.39 | 0.33 | | 232 |

P = piddle;
W = wound
100 C. for 24", then 188 C. for 12" @ see tandem jet table
*TM E.I. DuPont
s = result from simulation
e = estimated from data, not actually measured Table II illustrates various products made following the teachings of the invention, in general practicing the process illustrated in FIG. 9 using the apparatus in FIG. 11. Feed material deniers totaling about 1,500-20,000 produce yarns with deniers from about 100-400. Fibers that are drawn in the process are usually fully drawn so that the elongation to break going into the first break zone is about 10%.

Test 1 shows a process condition for making a nylon yarn having a final denier of 137. The process had a draw zone, a first break zone, a second break zone, a draft zone, and a consolidation zone similar to the process in FIG. 9. The feed yarn came from a piddle container as at 160 in FIG. 11 (and designated P in the Table II) and the final yarn product was wound up on a winder as at 222 in FIG. 11. The consolidation jet 83*a* (FIGS. 9 and 26) had a fluid orifice with angle 340 at 60 degrees in the direction of yarn travel that was the same for all tests using this jet 83*a*. The jet exterior surface 328 is spaced from the nip between rolls 150 and 152 of roll set 148 by a distance of about 6.0 inches. It is believed this process produced a yarn having the characteristics of the invention with an average filament length greater than or equal to 6", the maximum length of 99% of the filaments is less than 25", and the middle 98% of the filament lengths defines a length range value that is greater than or equal to the value of the average filament length; and wherein 5% to less than 15% of the filaments were greater in length than 1.5 times the average filament length.

Test 2 shows a process condition similar to test 1 which has a draw zone, a first break zone, and a second break zone approximately the same as that used to make the product illustrated in FIG. 15. The product was completed by processing the fiber further in a draft zone and a consolidation zone to form a 209 denier yarn. This product would be expected to have a filament distribution similar to that shown in FIG. 15.

Test 3 shows a product made using a polymer that has an interfilament friction coefficient less that 0.1 which is a fluoropolymer made by E. I. DuPont de Nemours & Company (hereinafter "DuPont") under the trade name Teflon®. The process produced a staple Teflon® product which is difficult to produce economically by other means. An "omega" wrap as depicted in FIG. 1A was used on the roll sets 50*a*, 62*a*, and 148*a* of FIG. 11 to control slippage of the fiber in the roll sets. The feed fiber was supplied from a wound package 162 as in FIG. 11 (designated W in the Table II). The process differed from test 1 in that the fiber was not heated or drawn in the draw zone. It is believed this product has an average filament length greater than 6.0 inches and other characteristics similar to those of test 1.

Test 4 shows a product made by a process similar to that illustrated in FIG. 21 where a high strength aramid fiber (DuPont trademark Kevlar®) was fed in upstream of the roll set 42 (42*a* in FIG. 11) after the polyester fiber (DuPont trademark Dacron®) was drawn. The aramid and polyester were then stretch broken, drafted, and consolidated together to produce a blended yarn with a 397 denier. An "omega" wrap as depicted in FIG. 1A was used on the roll sets 50*a*, 62*a*, and 148*a* of FIG. 11 to control slippage of the fiber in the roll sets since the aramid fiber required a high force to break. It is believed this product has filament length characteristics similar to those of test 1.

Test 5 shows a product made by a process similar to that in test 3 where an aramid fiber (DuPont trademark Kevlar®) and a fluoropolymer (DuPont trademark Teflon®) fiber were fed in together and were neither heated nor drawn in the draw zone; the draw zone was only used as a convenient way to transport the fibers to the first break zone. The Kevlar® and Teflon® were then stretch broken, drafted, and consolidated together to produce a blended yarn with a 274 denier. An "omega" wrap as depicted in FIG. 1A was used on the roll sets 50*a*, 62*a*, and 148*a* of FIG. 11 to control slippage of the fiber in the roll sets since the aramid fiber required a high force to break and the fluoropolymer required more surface contact to avoid slippage. Such a yarn is useful for making reinforcing fabric useful in industrial timing belts where high strength and low wear friction are valued. It is believed this product has filament length characteristics similar to those of test 1.

Test 6 shows a product made by a process similar to that in test 5 where an aramid fiber (DuPont trademark Kevlar®) and a high temperature fiber (DuPont trademark Nomex®) were fed in together and were neither heated nor drawn in the draw zone; the draw zone was only used as a convenient way to transport the fibers to the first break zone. The Kevlar® and Nomex® were then stretch broken, drafted, and consolidated together to produce a blended yarn with a 230 denier. An "omega" wrap as depicted in FIG. 1A was used on the roll sets 50*a*, 62*a*, and 148*a* of FIG. 11 to control slippage of the fiber in the roll sets since the aramid fiber required a high force to break. It is believed this product has filament length characteristics similar to those of test 1.

Test 7 shows a product made by a process similar to that in test 3 where an aramid fiber (DuPont trademark Kevlar®) was fed in and was neither heated nor drawn in the draw zone; the draw zone was only used as a convenient way to transport the fiber to the first break zone. An "omega" wrap was used. A Kevlar® yarn with a low denier of 101 was produced that would be difficult to produce economically by other means. It is believed this product has filament length characteristics similar to those of test 1.

Test 8 shows a product made by a process similar to that illustrated in test 4 except a fluoropolymer fiber (DuPont trademark Teflon®) was fed in upstream of the roll set 42 (42*a* in FIG. 11) after the polyester fiber (DuPont trademark Dacron®) was drawn. The fluoropolymer and polyester were then stretch broken, drafted, and consolidated together to produce a blended yarn with a 278 denier. Such a product may be useful for making socks that minimize the formation of blisters on the wearer's feet. It is believed this product has filament length characteristics similar to those of test 1.

Test 9 shows a process similar to that in test 1 except a polyester fiber is used. A yarn is made having a denier of 274. It is believed this product has filament length characteristics similar to those of test 1.

Test 10 shows a product made by a process similar to that illustrated in FIG. 20, where a continuous filament elastic fiber (DuPont trademark Lycra®) was fed in upstream of the roll set 148 (148*a* in FIG. 11) after the polyester fiber (DuPont trademark Dacron®) was drawn, stretch broken, and drafted. The Lycra® was tensioned to extend it about 100% before joining the Dacron® fiber and being consolidated together, with the Lycra® filaments remaining continuous. When the finished yarn was held under no tension, the Lycra® contracted and created a bulky loopy yarn that was highly elastic.

Test 11 shows a process similar to that in test 9, except the polyester filaments had a cross-section like that illustrated in FIG. 25, and a 277 denier yarn having split ends as in FIG. 24 was produced. It is believed this product has filament length characteristics similar to those of test 1.

Test 12 shows a process similar to that in test 1, except the feed fiber consisted of two different fibers, each a different color. The colored fibers were combined before drawing and were drawn and stretch broken together as a single bundle of fiber. The first fiber was a distinct pink color and the second was a distinct purple color. It is believed these two colors would each be non-neutral colors having a lightness less than 90%, and they would have a color difference of at least 2.0 CIELAB units. The resultant yarn had a color distinctly different than either of the feed fiber colors and it is believed that when this yarn would be woven into a fabric, the fabric would have a heather look.

Test 13 shows a process similar to test 12, except the pink colored fiber was replaced with a light gray fiber that it is believed would be a neutral color having a lightness of greater than 90%. The resultant yarn had a color distinctly different than either of the feed colors and the yarn itself had a distinct heather look.

Test 14 shows a process similar to that of FIG. 20 where a first feed fiber of Kevlar® was stretch broken (as in test 7) and a second fiber of continuous filament Kevlar® was fed in just upstream of roll set 148*a* in FIG. 11. The continuous filaments were consolidated with the discontinuous stretch broken filaments of Kevlar® to form a reinforced staple yarn having a denier of 311.

Test 15 shows a process similar to that in FIG. 22 where a Teflon fiber is fed in upstream of roll set 42 (42*a* in FIG. 11) (as in test 8) and a Lycra® fiber is fed in upstream of roll set 148 (148*a* in FIG. 11). The Teflon fiber is stretch broken, and drafted with the drawn Dacron® fiber and this blended discontinuous filament fiber is consolidated with the continuous filament Lycra® fiber as was discussed in test 10. This makes a stretchy, bulky, low friction yarn that would be useful in stretch socks that minimize blistering.

Test 16 shows a process similar to test 1 where two separate feed fibers were supplied to the process to create a large denier feed fiber of close to 20,000 denier going into the draw zone. In the draw zone two temperature zones were used on the heater 140 of FIG. 11. A first zone consisted of a 24 inch length at 100° C. followed by a second zone of a 12 inch length at 188° C. A total process speed ratio of over 70× produced a yarn of 277 denier.

Test 17 illustrates a product made following the teachings of the invention, in particular practicing the process illustrated in FIG. 8 using the apparatus in FIG. 11. To set up the process of FIG. 8 using the apparatus of FIG. 11 involved removing the drafting zone 144 and roll set 148*a* in FIG. 11 and moving the consolidation zone 38 into place adjacent roll set 62*a* since the process of FIG. 8 does not use a drafting zone. The consolidation device of FIG. 28 was used, alternatively referred to as a tandem jet device, and the process was operated at a total draw of 48 to make a 192 denier product that demonstrates a low L2/L1 ratio of 0.25. Table III tabulates the tandem jet parameters.

TABLE III

TANDEM JET DATA FOR SELECTED TESTS

| | | First Nozzle | | | | Second Nozzle | | | | Nozzle Locations | | | | |
|---|---|---|---|---|---|---|---|---|---|---|---|---|---|---|
| Test | Feed Speed (ypm) | Yarn bore & length (mm) | Num orifices & dia (mm) | Orifice pos. "$I_I$" (mm) | Orifice twist direction | Yarn bore & length (mm) | Num orifices & dia (mm) | Orifice pos. "$I_D$" (mm) | Orifice twist direction | R62-N1 Dist. (in.) | R62-Dist. (in.) "X" | N1-N2 Dist. (in.) "a" | Average filament length avg (in.) | a/avg ratio |
| 17 | 3.1 | 3.5 × 37.0 | 3 × 0.5 | 12.32 | S | 2.5 × 38.0 | 8 × 0.3 | 18.14 | Z | 1.72 | 10.7 | 9.0# | | |
| 20 | 4.3 | 3.5 × 37.0 | 3 × 0.5 | 12.32 | S | 2.5 × 38.0 | 8 × 0.3 | 18.14 | Z | 1.72 | 11 | 9.2* | 8.9 s | 1.03 |
| 21 | 5.6 | 3.5 × 37.0 | 3 × 0.5 | 12.32 | S | 2.5 × 38.0 | 8 × 0.3 | 18.14 | Z | 1.72 | 14.7 | 13.0* | 17.5 s | 0.74 |
| 22 | 5.6 | 3.5 × 37.0 | 3 × 0.5 | 12.32 | S | 2.5 × 38.0 | 8 × 0.3 | 18.14 | Z | 1.72 | — | — | 6.4 s | — |
| 23 | 7.7 | 3.5 × 37.0 | 3 × 0.5 | 12.32 | S | 2.5 × 38.0 | 8 × 0.3 | 18.14 | Z | 1.72 | 14 | 12.2* | 8.0 s | 1.53 |
| 24 | 5.2 | 3.5 × 37.0 | 3 × 0.5 | 12.32 | S | 2.5 × 38.0 | 8 × 0.3 | 18.14 | Z | 1.72 | 7 | 5.2# | 6.7 s | 0.78 |
| 25 | 9.9 | 3.5 × 37.0 | 3 × 0.5 | 12.32 | S | 2.5 × 38.0 | 8 × 0.3 | 18.14 | Z | 1.72 | 8.7 | 7.0# | | |

*"a" optimized for product average filament length
#"a" NOT optimized for product average filament length
s = simulated result Test 18 is the same process as test 17 except the interlace jet of FIGS. 26 and 27 was used. The feed yarn consisted of two tows each of 6280 denier black colored nylon that were combined before the draw zone and resulted in a final yarn denier of 186. The process operated at a total draw of 67.4 for a high output speed of 303 ypm that is close to the speed limitations of the machine used for the test. It is expected that higher speeds exceeding 500 ypm could be achieved using the process of the invention and a higher speed machine.

Test 19 shows results similar to test 18 where the final output speed was 269 ypm making a 198 denier Dacron® product.

Tests 20, 21, 22, and 23 were run with a setup similar to test 17 to examine the preferred distance "a" between the nozzles of the consolidation device of FIG. 28. Each test was set up to produce a yarn with a different average filament length as determined by simulation. For each average filament length, several runs were made where the distance "a" between the nozzles of the consolidation device was varied by leaving the first nozzle, N1, in place at a distance of 1.72 inches to where the fluid passages intersect the fiber bore; the second nozzle was moved to various positions and a consolidated yarn sample was collected. The sample for each position was measured for strength using a Lea Product process and the strength was recorded in grams per denier for each position of the second nozzle.

Test 20 was set up to produce a yarn with an average filament length of 8.9 inches as determined by simulation. The results were plotted in FIG. 35 as the curve labeled 8.9. The maximum strength occurred at a nozzle spacing "a" of 9.2 inches as recorded in Table III for test 20. This gave a ratio of a/avg of 1.03. A simulation of the filament distribution was also run for the conditions used in this test and are displayed in Table I for test 20. The simulation indicated the distribution of filaments greater than 1.5 times the average filament length could be expected to be 12.4%; the distribution of filaments less than 0.5 times the average filament length could be expected to be 14.7%.

Test 21 was run the same as test 20 except the break zone lengths were changed to produce a yarn made of Dacron® polyester fiber with an average filament length of 17.5 inches. This set of conditions also was run with a high L2/L1 ratio of 0.58. The results were plotted in FIG. 35 as the curve labeled 17.5. The maximum strength occurred at a nozzle spacing "a" of 13.0 inches as recorded in Table III for test 21. This gave a ratio of a/avg of 0.74. A simulation of the filament distribution was also run for the conditions used in this test and are displayed in Table I for test 21. The simulation indicated the distribution of filaments greater than 1.5 times the average filament length could be expected to be 12.4%; the distribution of filaments less than 0.5 times the average filament length could be expected to be 13.9%.

Test 22 was run the same as test 20 except the break zone lengths were changed to produce a yarn made of Dacron® polyester fiber with an average filament length of 6.4 inches. The results were plotted in FIG. 35 as the curve labeled 6.4. There was not a distinct value for the maximum strength; the curve was essentially flat except for a dip down to a strength of about 0.8 which was an estimated value since the sample made at this distance of about 4 inches was so weak a full size skein could not be wound for the standard Lea Product test. Either the nozzle spacing is not determinative of strength at a low average length for the filaments or there was an unexplained problem with the test. A simulation of the filament distribution was also run for the conditions used in this test and are displayed in Table I for test 22. The simulation indicated the distribution of filaments greater than 1.5 times the average filament length could be expected to be 12.3%; the distribution of filaments less than 0.5 times the average filament length could be expected to be 13.9%.

Test 23 was run without breaking the fiber in the first break zone and only breaking it in the second zone to simulate a single break zone process. It was set up to produce a yarn with an average filament length of 8.0 inches. The results were plotted in FIG. 35 as the curve labeled 8.0. The maximum strength occurred at a nozzle spacing "a" of 12.2 inches as recorded in Table III for test 23. This gave a ratio of a/avg of 1.53. A simulation of the filament distribution was also run for the conditions used in this test and are displayed in Table I for test 23. The simulation indicated the distribution of filaments greater than 1.5 times the average filament length could be expected to be 18.4%; the distribution of filaments less than 0.5 times the average filament length could be expected to be 18.3%. This product made with a single break zone has product characteristics that fall outside the limits of the invention using two break zones, but it shows that the nozzle spacing has an optimum value for best yarn strength and the nozzle spacing invention is effective with a variety of processes that make a yarn with an average filament length greater than 6 inches.

Looking at the results of tests 20, 21, 22, and 23, the value for the spacing "a" between the first nozzle and second nozzle ranges from 0.74 to 1.53, or about 0.5 to 2.0 times the average filament length for fibers/yarns with an average filament length greater than about 6.0 inches. Taking the three values of "a" and averaging them, the preferred value for "a" is about 1.1 times the average filament length. Although test 22 did not have a point of maximum strength, it did have a point of diminished strength that could be avoided in the set up of the process if the teachings of the invention were followed and the nozzles were set to the preferred value of 1.1 avg. This would result in a value of "a" of 1.1×6.4=7.0 inches. This avoids the 5.0 inch position of diminished strength.

Test 24 was run with a setup similar to test 17 using the consolidation device of FIG. 28 and the L2/L1 ratio was run at 0.35 to produce a yarn with an average filament length of 6.7 inches.

Test 25 uses a process similar to that in test 17. The feed material in test 21 is a bicomponent elastic yarn wherein each filament has a circular cross section with one half of the cross-section comprising 2GT polyester and the other half cross-section comprising 3GT polyester. Such a feed material is described in U.S. Pat. Nos. 3,671, 379 to Evans et al., hereby incorporated herein by reference. Related patents to others are U.S. Pat. Nos. 3,562,093; 3,454,460; and 2,439, 815. The two different polymers in the cross-section have different shrinkage characteristics after spinning so that after heat treatment, the fiber becomes a crimped fiber where the filaments curls into a coiled springy structure. Before heat treatment to activate the fiber latent elasticity, the fiber still has a significant amount of elasticity or crimp, which has caused a problem in the past making staple yarn using conventional combing and carding equipment. As a result, it is believed that staple yarn of bicomponent fiber is not known in the textile trade. The resultant multifilament yarn is very springy and has a substantial elasticity from no tension to a maximum tension, where all the elasticity is removed without plastic deformation of the filaments. This elasticity is characterized as percent crimp development, CD, that can be developed with wet heat and measured following the guidelines in the '379 and '460 reference above. The finished yarn must be heat treated after stretch breaking to recover its latent elasticity and obtain its final elastic characteristics.

Test 25 shows a process condition for making a bicomponent yarn of 2GT polyester and 3GT polyester components (designated BC23) having a final denier of 160. The process has a heat treating zone, a first break zone, a second break zone, and a consolidation zone similar to the process in FIG. 8; a draft zone is not used. The feed yarn comes from 12 wound packages of 100 denier yarn each similar to 162 in FIG. 11. The feed yarn is pre-drawn, but has not been heat treated to develop the latent elasticity of the fiber, although the fiber possesses some partial elasticity or crimp. The final yarn product was wound up on a winder 222 shown in FIG. 11. The consolidation device used is the tandem jet type in FIG. 28. The tensioner at 164 was adjusted to provide enough tension on the feed yarn so that all of the partial stretch (crimp) was removed from the feed yarn at roll 168. The yarn is heated treated to a temperature of 180° C. by fiber heater 140 while maintaining tension, but without drawing the filaments. Although the fiber was not drawn in draw zone 124, it was surprisingly necessary to heat the fiber to maintain good operability in the break zones. The yarn was stretch broken and rebroken in zones D1 and D2 and was then forwarded to the consolidation jet 83*b* without drafting to form a yarn of 160 denier. The yarn was then wound on a package as at 222 with enough tension that the stretch in the yarn was substantially removed. To develop the elastic character of the yarn it is necessary for the yarn to undergo heating to about 100 degrees C. to form a helically coiled elastic yarn structure (having crimp and curl) having good bulk and elastic recovery. Such heating may be accomplished in a separate step or the yarn may be woven into a fabric and the heat supplied by the dying process for the fabric. The crimped discontinuous filament yarn is believed to have a crimp development of from about 35-40% as measured according to the procedure described in the '379 referenced patent to Evans et al. It is believed that this process produces a yarn where the crimp and curl are deregistered due to the random breaking of the filaments so this yarn would be very useful in making a stretch staple fabric with low "orange peel" (a fabric surface with a mottled look like the surface of an orange). Fabrics made with crimped or curled yarn, which has not been deregistered frequently, possess orange peel.

Test 26 shows a process condition for making a bicomponent yarn of 2GT and 3GT components (BC23) with a 50:50 ratio of components and the consolidated yarn having a final denier of 176. The process has a drawing and heat treating (annealing) zone, a first break zone, a second break zone, and a consolidation zone similar to the process in FIG. 8; a draft zone is not used. The feed yarn comes from 24 wound packages to make up a 4714 denier undrawn yarn. The final yarn product was wound up on a winder as at 222 in FIG. 11. The consolidation interlace jet 83*a* (FIGS. 26 and 27) had a fluid inlet orifice angled at 60 degrees in the direction of yarn travel. The tensioner at 164 was adjusted to provide enough tension on the feed yarn so that all of the stretch was removed from the feed yarn at roll 168. The yarn is drawn at a temperature of 160° C. by fiber heater 140 while undergoing a draw ratio of 3.0×. The yarn was stretch broken and rebroken in zones D1 and D2 and was then forwarded to the consolidation jet 83*a* without drafting to form a yarn of 176 denier. The yarn was then wound on a package as at 222 (FIG. 11). If the yarn was heat treated with (hot air or) steam to raise the temperature to 100° C. which would served to redevelop the shrinkage and curl in the filaments the yarn would be expected have a CD of about 50-60%. This is slightly higher than what would be expected with the yarn from test 25 that was consolidated with the tandem jet arrangement that makes a fasciated yarn. If the same fiber had only been drawn and not stretch broken, it is believed it would have a CD of about 55-65% that is only slightly higher than the staple fiber yarn of the invention which has more desireable hand than a continuous filament bicomponent yarn.

The results of test 24 and 25 are surprising in that a staple stretch broken yarn can be made with good runnability from either pre-drawn or undrawn fiber by first removing all feed yarn stretch with pretension, and then heating the yarn to anneal both the pre-drawn or just-drawn fiber before stretch breaking the filaments. The stretch characteristics of the feed yarn are substantially retained in the finished staple yarn.

It is believed that other elastic fibers, i.e. crimped fibers, can also be successfully processed using the teachings of the invention. Other fibers may comprise different polymer combinations, such as a different nylon polymers, or different structures, such as biconstituent fibers. A biconstituent fiber is typically one with a core polymer that is highly elastic (or "soft"), such as a Lycras elastomer, that has "wings" of an inelastic ("hard") polymer attached as longitudinal ribs during the spinning process. After spinning, the latent elasticity of the fiber can be activated by heat that causes the soft core polymer to shrink considerably more than the hard wing polymer which causes the composite structure to helically coil up to look like a screw thread. This fiber structure also has some "crimp" after spinning and drawing and before heat treating, similar to the bicomponent fiber. Polymer pairs should be compatible so they stick together, and can be cospun. For that, they have to have a similar thermal response and functional spinning viscosity. Useful pairs are therefore usually pretty similar chemically, or have some specific interaction. Common bicomponents are two polyesters, two nylons, etc., while the biconstituents are e.g. 4GT/4GT-4GO (HYTREL®) and nylon/PEBAX®; homopolymer/block copolymer pairs in which one block of the copolymer is the same as the homopolymer. Ratios can vary considerably, but are generally limited to somewhere between 80/20 and 20/80, preferably 70/30 to 30/70. Other conventional crimped fibers, such as those crimped by jets, gear crimpers, stuffer box crimpers and the like could also be converted to a staple yarn using the process of the invention.

It is, therefore apparent that there has been provided in accordance with the present invention, methods for stretch-breaking continuous filament fibers to form discontinuous filament fibers and consolidating these fibers into yarns, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for stretch breaking a fiber comprising continuous filaments, discontinuous filaments or a combination thereof, wherein the apparatus comprises (a) a first break zone and a second break zone, wherein the first break zone has a length L1, the second break zone has a length L2, and $0.6\ L1 \geqq L2 \geqq 0.2\ L1$; (b) a first roll set that imparts to the fiber a speed D1 in the first break zone, and a second roll set that imparts to the fiber a speed D2 in the second break zone, wherein $(D2-1)/(D1 \cdot 1) \geqq 0.15$; and (c) and a consolidation zone.

2. An apparatus according to claim 1 wherein the consolidation zone comprises an interlace jet, a single fluid jet, multiple fluid jets, a true twisting device, an alternate ply twisting device, an adhesive applicator or a wrapping device.

3. An apparatus according to claim 1 further comprising a draw zone.

4. An apparatus according to claim 3 wherein the draw zone functions as an annealing zone.

5. An apparatus according to claim 3 wherein the apparatus comprises a first fiber feed upstream of the draw zone and a second fiber feed after the draw zone and before the first break zone.

6. An apparatus according to claim 5 further comprising a third fiber feed after the second break zone and before the consolidation zone.

7. An apparatus according to claim 1 further comprising a draft zone between the second break zone and the consolidation zone, or between the first break zone and the second break zone.

8. An apparatus according to claim 7 which further comprises a draw zone, and wherein the apparatus comprises a first fiber feed upstream of the draw zone and a second fiber feed at the downstream end of the draft zone.

9. An apparatus according to claim 8 further comprising a third fiber feed at the downstream end of the draft zone.

10. An apparatus according to claim 1 wherein the path of the fiber through one or more of the functional zones is arranged to be folded so when a path vector in a first functional zone is placed tail to tail with a path vector in a next sequential functional zone there is defined an included angle that is between 45 degrees and 180 degrees.

* * * * *